US006461803B1

(12) United States Patent
Suga et al.

(10) Patent No.: US 6,461,803 B1
(45) Date of Patent: Oct. 8, 2002

(54) SILVER HALIDE COLOR PHOTOGRAPHIC LIGHTSENSITIVE MATERIAL

(75) Inventors: Yoichi Suga; Takanori Hioki; Jun Okamoto, all of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/655,837

(22) Filed: Sep. 6, 2000

(30) Foreign Application Priority Data

Sep. 6, 1999 (JP) ..... 11-251428

(51) Int. Cl.[7] ..... G03C 1/46

(52) U.S. Cl. ..... 430/505; 430/567; 430/570; 430/572; 430/581; 430/583; 430/599; 430/603; 430/604; 430/605

(58) Field of Search ..... 430/502, 503, 430/505, 567, 570, 572, 583, 581, 599, 603, 604, 605

(56) References Cited

U.S. PATENT DOCUMENTS

| | | | | |
|---|---|---|---|---|
| 3,986,878 A | * | 10/1976 | Himata et al. | 430/581 |
| 3,988,155 A | * | 10/1976 | Himata et al. | 430/581 |
| 4,232,118 A | * | 11/1980 | Okauchi et al. | 430/574 |
| 5,576,157 A | | 11/1996 | Eikenberry et al. | |
| 5,919,613 A | * | 7/1999 | Missfeldt | 430/583 |

* cited by examiner

*Primary Examiner*—Geraldine Letscher
(74) *Attorney, Agent, or Firm*—Birch, Stewart, Kolasch & Birch, LLP

(57) ABSTRACT

A silver halide color photographic lightsensitive material comprising at least one red-sensitive silver halide emulsion layer, at least one green-sensitive silver halide emulsion layer and at least one blue-sensitive silver halide emulsion layer on a support, wherein the lightsensitive material has an ISO speed of 640 or more, and has a variation, in terms of a $SN_{GR}$ ratio, of magenta and cyan colors of 0 dB or more when the lightsensitive material is subjected to each of white light exposure, white fluorescent lamp exposure and three band fluorescent lamp exposure.

14 Claims, No Drawings

SILVER HALIDE COLOR PHOTOGRAPHIC LIGHTSENSITIVE MATERIAL

CROSS-REFERENCE TO RELATED APPLICATIONS

This application is based upon and claims the benefit of priority from the prior Japanese Patent Application No. 11-251428, filed Sep. 6, 1999, the entire contents of which are incorporated herein by reference.

BACKGROUND OF THE INVENTION

The present invention relates to a silver halide color photographic lightsensitive material. More particularly, the present invention relates to a color photographic lightsensitive material which is highly sensitive and has an excellent light source adaptability.

In recent years, highly sensitive lightsensitive materials have been placed on market in succession in accordance with the progress of the technology of photographic lightsensitive materials. Highly sensitive films are "usable for photographing in dark scenes", so that the frequency of use thereof in dark indoor places is increasing. On the other hand, especially in Japan, fluorescent lamps are very often used as indoor illuminants, and scenes illuminated by fluorescent lamps are printed greenish. The higher the sensitivity of the film, the greater the influence of the background light source on the film. Accordingly, the occurrence of greenish printing attributed to fluorescent lamps is greater with ISO-400 films than with ISO-100 films and greater with ISO-800 films than with ISO-400 films. A means for improving the fluorescent lamp adaptability of such a highly sensitive film was reported at the 1999 annual general meeting of the Society of Photographic Science and Technology of Japan. However, the means relates to improvement in a mixed light from a three band fluorescent lamp and a strobe and is not satisfactory with respect to the photographing under a white fluorescent lamp or at indoor exposure without the use of any strobe.

On the other hand, Fuji Photo Film Co., Ltd. have developed color negative film "SUPER-400" realizing a color reproduction that is faithful to human sight and have improved the light source adaptability of ISO-400 film. This faithful color reproduction has been realized by the fourth color-sensitive layer and the regulation of the spectral sensitivity of the red-sensitive layer to a shorter wave. Although it can be easily anticipated to apply this technology to the ISO-800 film to thereby improve the light source adaptability thereof, the introduction of the fourth color-sensitive layer and the regulation of the spectral sensitivity to a shorter wave are disadvantageous from the viewpoint of sensitivity. Compensating for such a sensitivity insufficiency by increasing the grain size is detrimental to the graininess. Therefore, the introduction of the above technology in the ISO-800 film has not been easy.

BRIEF SUMMARY OF THE INVENTION

The object of the present invention is to provide a silver halide color photographic lightsensitive material which is highly sensitive and which realizes a faithful color reproduction, attaining minimization of, especially, greenishness attributed to fluorescent lamps.

The inventors have found, as a result of extensive and intensive efforts, that the object of the present invention can be attained by the following silver halide color photographic lightsensitive material.

EMBODIMENT 1

A silver halide color photographic lightsensitive material comprising at least one red-sensitive silver halide emulsion layer, at least one green-sensitive silver halide emulsion layer and at least one blue-sensitive silver halide emulsion layer on a support, wherein the lightsensitive material has an ISO speed of 640 or more and a variation, in terms of $SN_{GR}$ ratio, of magenta and cyan colors of 0 dB or more when the lightsensitive material was subjected to (1) white exposure, (2) white fluorescent lamp exposure and (3) three band fluorescent lamp exposure.

EMBODIMENT 2

The lightsensitive material defined in Embodiment 1, wherein the lightsensitive material has a variation, in terms of $SN_{BGR}$ ratio, of yellow, magenta and cyan colors of −4 dB or more when the lightsensitive material is subjected to (1) white exposure, (2) white fluorescent lamp exposure and (3) three band fluorescent lamp exposure.

EMBODIMENT 3

The lightsensitive material defined in Embodiment 2, wherein the blue-sensitive silver halide emulsion layer contains a sensitizing dye selected from a group consisting of sensitizing dyes represented by general formula (I) and general formula (II), and a sensitizing dye represented by general formula (III):

(I)

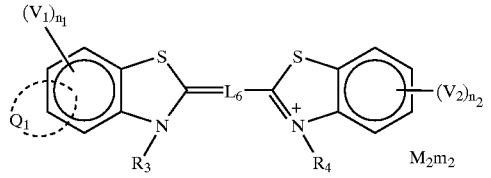

wherein each of $R_3$ and $R_4$ independently represents an alkyl group, an aryl group or a heterocyclic group; $L_6$ represents a methine group; $M_2$ represents a charge balancing counter ion; $m_2$ represents the number required for neutralizing a molecular charge; $Q_1$ represents an aromatic ring; each of $V_1$ and $V_2$ independently represents a monovalent substituent; $n_1$ represents 0, 1 or 2; and $n_2$ represents 0, 1, 2, 3 or 4;

(II)

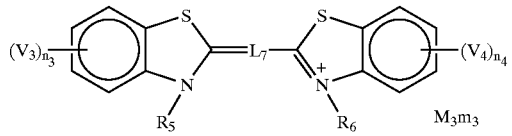

wherein each of $R_5$ and $R_6$ independently represents an alkyl group, an aryl group or a heterocyclic group; $L_7$ represents a methine group; $M_3$ represents a charge balancing counter ion; $m_3$ represents the number required for neutralizing a molecular charge; each of $V_3$ and $V_4$ independently represents a monovalent substituent, provided that when $M_3$ is two or more, two of $V_3$ substituents do not bond with each other to thereby form an aromatic ring and when $M_4$ is two or more, two of $V_4$ substituents do not bond with each other to thereby form an aromatic ring; and each of $n_3$ and $n_4$ independently represents 0, 1, 2, 3 or 4; and (III)

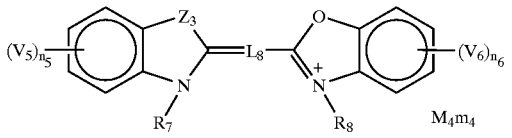

wherein each of $R_7$ and $R_8$ independently represents an alkyl group, an aryl group or a heterocyclic group; $L_8$ represents a methine group; $M_4$ represents a charge balancing counter ion; $m_4$ represents the number required for neutralizing a molecular charge; each of $V_5$ and $V_6$ independently represents a monovalent substituent; each of $n_5$ and $n_6$ independently represents 0, 1, 2, 3 or 4; and $Z_3$ represents an oxygen atom or a sulfur atom.

EMBODIMENT 4

The lightsensitive material defined in Embodiment 2, wherein the blue-sensitive silver halide emulsion layer contains at least one sensitizing dye represented by the above general formula (I), at least one sensitizing dye represented by the above general formula (II) and at least one sensitizing dye represented by the above general formula (III).

DETAILED DESCRIPTION OF THE INVENTION

The present invention will be described in detail below.

The fluorescent lamps can generally be classified into two types, white light fluorescent lamps and three band fluorescent lamps, and the energy distributions thereof vary from each other, depending on the manufacturer. Evaluating the film adaptability to fluorescent lamps on an individual basis wastes enormous labor and time, which is disadvantageous from the viewpoint of reducing the period for merchandise development.

There is few user of color negative film who employs different films according to the type of fluorescent lamp, so that the evaluation of individual. fluorescent lamp adaptability is meaningless to the users. Therefore, a method of collectively evaluating the fluorescent lamp adaptability (evaluation on the basis of SN ratio wherein the type of light source is regarded as noise) has been introduced for the purpose of reducing the period for merchandise research and effecting a development of lightsensitive materials meaningful to the users.

The $SN_{GR}$ ratio for evaluating the light source adaptability in the present invention can be calculated in the following manner.

The method of determining the evaluation value in the case where the data as given in Table 1 have been obtained from the characteristic curves regarding the densities of G (green) and R (red) obtained when exposures have been effected with the use of each of three types of light sources will be described below.

TABLE 1

| | G | | | R | | | |
|---|---|---|---|---|---|---|---|
| | N1 | N2 | N3 | N1 | N2 | N3 | Total |
| M1 | Y11 | Y12 | Y13 | Y14 | Y15 | Y16 | X1 |
| M2 | Y21 | Y22 | Y23 | Y24 | Y25 | Y26 | X2 |

TABLE 1-continued

| | G | | | R | | | |
|---|---|---|---|---|---|---|---|
| | N1 | N2 | N3 | N1 | N2 | N3 | Total |
| M3 | Y31 | Y32 | Y33 | Y34 | Y35 | Y36 | X3 |
| M4 | Y41 | Y42 | Y43 | Y44 | Y45 | Y46 | X4 |
| M5 | Y51 | Y52 | Y53 | Y54 | Y55 | Y56 | X5 |
| M6 | Y61 | Y62 | Y63 | Y64 | Y65 | Y66 | X6 |
| M7 | Y71 | Y72 | Y73 | Y74 | Y75 | Y76 | X7 |
| M8 | Y81 | Y82 | Y83 | Y84 | Y85 | Y86 | X8 |
| M9 | Y91 | Y92 | Y93 | Y94 | Y95 | Y96 | X9 |
| M10 | Y101 | Y102 | Y103 | Y104 | Y105 | Y106 | X10 |
| Total | Y1 | Y2 | Y3 | Y4 | Y5 | Y6 | |

In the table, M1 to M10 represent preselected density values; G and R represent respective colors; N1 to N3 represent noises (types of various light sources); yij represents an exposure amount datum for each individual instance; and each of Y1 to Y6 represents the sum of the exposure amount data of the respective column.

(1) The average $S_m$ of exposure amount variation is calculated by the formula:

$$S_m=(y_{11}+y_{12}+\ldots+y_{106})^2/\text{sum of data}$$

(in this case, sum of data=60)

(2) The exposure amount variation $S_C$ due to the difference between the exposure amount variation obtained for G, which is caused by the three different color sources, and the exposure amount variation obtained for R, which is caused by the three different color sources is calculated by the formula:

$$S_C=[\{(Y1+Y2+Y3)^2+(Y4+Y5+Y6)^2\}/30]-S_m$$

(3) The exposure amount variation $S_N$ due to the noise is calculated by the formula:

$$S_N=[\{(Y1+Y4)^2+(Y2+Y5)^2+(Y3+Y6)^2\}/20]-S_m$$

Of the above variations, $S_C$ is not treated as noise because the density-exposure amount relationship is intentionally changed for color design. With respect to $S_N$, this expresses the average magnitude of influence of various light sources, so that, essentially, it is desired that its value approach to 0. However, although color failure would not occur even if there is some influence on gradation, etc. as long as similar changes between G and R are brought about by various light sources, scattering of behavios between G and R would result in a serious problem in color reproduction. Therefore, in this invention, the following evaluation scale has been set to thereby realize a quantitative evaluation of color balance between G and R.

(4) Magnitude of exposure change caused by a specified combination of color and noise:

$$S_{C\times N}=[(Y1^2+Y2^2+Y3^2+Y4^2+Y5^2+Y6^2)/10]-S_m-S_C-S_N$$

Any color balance deviation by light sources has been corrected by bringing this value close to 0.

Actually, prior to an evaluation, the following conversion has been effected so as to render the data additive and so as to bring the values into easily understood form:

$$SN\ \text{ratio}\eta=10\text{Log}(1/(S_{N\times C}/^2)).$$

With respect to the $SN_{GR}$ ratio of light source adaptability in Embodiment 1, the fog to density 1.0 has been equally divided into 100 parts and allocated to Mx of Table 1 as M1 to M100. In this instance, evaluation has been conducted with respect to magenta and cyan densities. The employed light sources consist of (1) reference light source of 4800K color temperature, (2) white fluorescent lamp and (3) three band fluorescent lamp.

The thus calculated $SN_{GR}$ ratio is preferably 0 dB or more, more preferably 3 dB or more.

Likewise, the $SN_{BGR}$ ratio of light source adaptability in Embodiment 2 is one calculated with respect to magenta, cyan and yellow densities. The light sources are the same as mentioned above. The $SN_{BGR}$ ratio is preferably −4 dB or more, more preferably −2 dB or more.

The ISO speed of the silver halide color photographic lightsensitive material of the present invention is 640 or more, preferably 800 or more.

The compounds of the general formulae (I), (II) and (III) for use in the present invention will be described in detail below.

The substituent represented by V, referred to in the following description, is not particularly limited. For example, it can be any of a halogen atom (for example, chlorine, bromine, iodine or fluorine), a mercapto group, a cyano group, a carboxyl group, a phosphoric group, a sulfo group, a hydroxy group, a carbamoyl group having 1 to 10 carbon atoms, preferably 2 to 8 carbon atoms, and more preferably 2 to 5 carbon atoms (for example, methylcarbamoyl, ethylcarbamoyl or morpholinocarbonyl), a sulfamoyl group having 0 to 10 carbon atoms, preferably 2 to 8 carbon atoms, and more preferably 2 to 5 carbon atoms (for example, methylsulfamoyl, ethylsulfamoyl or piperidinosulfonyl), a nitro group, an alkoxy group having 1 to 20 carbon atoms, preferably 1 to 10 carbon atoms, and more preferably 1 to 8 carbon atoms (for example, methoxy, ethoxy, 2-methoxyethoxy or 2-phenylethoxy), an aryloxy group having 6 to 20 carbon atoms, preferably 6 to 12 carbon atoms, and more preferably 6 to 10 carbon atoms (for example, phenoxy, p-methylphenoxy, p-chlorophenoxy or naphthoxy), an acyl group having 1 to 20 carbon atoms, preferably 2 to 12 carbon atoms, and more preferably 2 to 8 carbon atoms (for example, acetyl, benzoyl or trichloroacetyl), an acyloxy group having 1 to 20 carbon atoms, preferably 2 to 12 carbon atoms, and more preferably 2 to 8 carbon atoms (for example, acetyloxy or benzoyloxy), an acylamino group having 1 to 20 carbon atoms, preferably 2 to 12 carbon atoms, and more preferably 2 to 8 carbon atoms (for example, acetylamino), a sulfonyl group having 1 to 20 carbon atoms, preferably 1 to 10 carbon atoms, and more preferably 1 to 8 carbon atoms (for example, methanesulfonyl, ethanesulfonyl or benzenesulfonyl), a sulfinyl group having 1 to 20 carbon atoms, preferably 1 to 10 carbon atoms, and more preferably 1 to 8 carbon atoms (for example, methanesulfinyl or benzenesulfinyl), a sulfonylamino group having 1 to 20 carbon atoms, preferably 1 to 10 carbon atoms, and more preferably 1 to 8 carbon atoms (for example, methanesulfonylamino, ethanesulfonylamino or benzenesulfonylamino), an amino group, a substituted amino group having 1 to 20 carbon atoms, preferably 1 to 12 carbon atoms, and more preferably 1 to 8 carbon atoms (for example, methylamino, dimethylamino, benzylamino, anilino or diphenylamino), an ammonium group having 0 to 15 carbon atoms, preferably 3 to 10 carbon atoms, and more preferably 3 to 6 carbon atoms (for example, trimethylammonium or triethylammonium), a hydrazino group having 0 to 15 carbon atoms, preferably 1 to 10 carbon atoms, and more preferably 1 to 6 carbon atoms (for example, trimethylhydrazino), a ureido group having 1 to 15 carbon atoms, preferably 1 to 10 carbon atoms, and more preferably 1 to 6 carbon atoms (for example, ureido or N,N-dimethylureido), an imido group having 1 to 15 carbon atoms, preferably 1 to 10 carbon atoms, and more preferably 1 to 6 carbon atoms (for example, succinimido), an alkyl- or arylthio group having 1 to 20 carbon atoms, preferably 1 to 12 carbon atoms, and more preferably 1 to 8 carbon atoms (for example, methylthio, ethylthio, carboxyethylthio, sulfobutylthio or phenylthio), an alkoxycarbonyl group having 2 to 20 carbon atoms, preferably 2 to 12 carbon atoms, and more preferably 2 to 8 carbon atoms (for example, methoxycarbonyl, ethoxycarbonyl or benzyloxycarbonyl), an aryloxycarbonyl group having 6 to 20 carbon atoms, preferably 6 to 12 carbon atoms, and more preferably 6 to 8 carbon atoms (for example, phenoxycarbonyl), an unsubstituted alkyl group having 1 to 18 carbon atoms, preferably 1 to 10 carbon atoms, and more preferably 1 to 5 carbon atoms (for example, methyl, ethyl, propyl or butyl), a substituted alkyl group having 1 to 18 carbon atoms, preferably 1 to 10 carbon atoms, and more preferably 1 to 5 carbon atoms (for example, hydroxymethyl, trifluoromethyl, benzyl, carboxyethyl, ethoxycarbonylmethyl or acetylaminomethyl; provided that the substituted alkyl groups include an unsaturated hydrocarbon group preferably having 2 to 18 carbon atoms, more preferably 3 to 10 carbon atoms, and most preferably 3 to 5 carbon atoms (for example, vinyl, ethynyl, 1-cyclohexenyl, benzylidyne or benzylidene)), a substituted or unsubstituted aryl group having 6 to 20 carbon atoms, preferably 6 to 15 carbon atoms, and more preferably 6 to 10 carbon atoms (for example, phenyl, naphthyl, p-carboxyphenyl, p-nitrophenyl, 3,5-dichlorophenyl, p-cyanophenyl, m-fluorophenyl or p-tolyl) and a heterocyclic group that may be substituted, having 1 to 20 carbon atoms, preferably 2 to 10 carbon atoms, and more preferably 4 to 6 carbon atoms (for example, pyridyl, 5-methylpyridyl, thienyl, furyl, morpholino or tetrahydrofurfuryl).

In the above general formulae (I), (II) and (III), each of $L_6$, $L_7$ and $L_8$ independently represents a methine group.

The methine group represented by $L_6$, $L_7$ and $L_8$ may have a substituent. The substituent can be the same as that represented by the aforementioned V. For example, it can be any of a substituted or unsubstituted alkyl group having 1 to 15 carbon atoms, preferably 1 to 10 carbon atoms, and more preferably 1 to 5 carbon atoms (for example, methyl, ethyl or 2-carboxyethyl), a substituted or unsubstituted aryl group having 6 to 20 carbon atoms, preferably 6 to 15 carbon atoms, and more preferably 6 to 10 carbon atoms (for example, phenyl or o-carboxyphenyl), a substituted or unsubstituted heterocyclic group having 3 to 20 carbon atoms, preferably 4 to 15 carbon atoms, and more preferably 6 to 10 carbon atoms (for example, N,N-diethylbarbituric group), a halogen atom (for example, chlorine, bromine, fluorine or iodine), an alkoxy group having 1 to 15 carbon atoms, preferably 1 to 10 carbon atoms, and more preferably 1 to 5 carbon atoms (for example, methoxy or ethoxy), an alkylthio group having 1 to 15 carbon atoms, preferably 1 to 10 carbon atoms, and more preferably 1 to 5 carbon atoms (for example, methylthio or ethylthio), an arylthio group having 6 to 20 carbon atoms, preferably 6 to 15 carbon atoms, and more preferably 6 to 10 carbon atoms (for example, phenylthio) and an amino group having 0 to 15 carbon atoms, preferably 2 to 10 carbon atoms, and more preferably 4 to 10 carbon atoms (for example, N,N-diphenylamino, N-methyl-N-phenylamino or N-methylpiperadino). $L_6$, $L_7$ and $L_8$ can form a ring in cooperation with any one of $V_1$, $V_2$, $R_3$, $R_4$ and $Q_1$; with any one of $V_3$, $V_4$, $R_5$ and $R_6$; with any one of $V_5$, $V_6$, $R_7$ and $R_8$, respectively.

Each of $L_6$, $L_7$ and $L_8$ preferably represents an unsubstituted methine group.

$Z_3$ represents an oxygen atom or a sulfur atom, preferably a sulfur atom.

Each of $R_3$, $R_4$, $R_5$, $R_6$, $R_7$ and $R_8$ independently represents an alkyl group, an aryl group or a heterocyclic group. Examples thereof include an unsubstituted alkyl group having 1 to 18 carbon atoms, preferably 1 to 7 carbon atoms, and more preferably 1 to 4 carbon atoms (for example, methyl, ethyl, propyl, isopropyl, butyl, isobutyl, hexyl, octyl, dodecyl or octadecyl), a substituted alkyl group having 1 to 18 carbon atoms, preferably 1 to 7 carbon atoms, and more preferably 1 to 4 carbon atoms {for example, alkyl groups substituted with the aforementioned V, preferred examples of which include an aralkyl group (e.g., benzyl or 2-phenylethyl), an unsaturated hydrocarbon group (e.g., allyl), a hydroxyalkyl group (e.g., 2-hydroxyethyl or 3-hydroxypropyl), a carboxyalkyl group (e.g., 2-carboxyethyl, 3-carboxypropyl, 4-carboxybutyl or carboxymethyl), an alkoxyalkyl group (e.g., 2-methoxyethyl or 2-(2-methoxyethoxy)ethyl), an aryloxyalkyl group (e.g., 2-phenoxyethyl or 2-(1-naphthoxy)ethyl), an alkoxycarbonylalkyl group (e.g., ethoxycarbonylmethyl or 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylsulfamoylmethyl), a sulfoalkyl group (e.g., 2-sulfoethyl, 3-sulfopropyl, 3-sulfobutyl, 4-sulfobutyl, 2-[3-sulfopropoxy]ethyl, 2-hydroxy-3-sulfopropyl or 3-sulfopropoxyethoxyethyl), a sulfoalkenyl group, a sulfatoalkyl group (e.g., 2-sulfatoethyl, 3-sulfatopropyl or 4-sulfatobutyl), an alkyl group substituted with a heterocycle (e.g., 2-(pyrrolidin-2-on-1-yl)ethyl or tetrahydrofurfuryl), an alkylsulfonylcarbamoylalkyl group (e.g., methanesulfonylcarbamoylmethyl), an acylcarbamoylalkyl group (e.g., acetylcarbamoylmethyl), an acylsulfamoylalkyl group (e.g., acetylsulfamoylmethyl) and an alkylsulfonylsulfamoylalkyl group (e.g., methanesulfonylsulfamoylmethyl)}, an unsubstituted aryl group having 6 to 20 carbon atoms, preferably 6 to 10 carbon atoms, and more preferably 6 to 8 carbon atoms (for example, phenyl or 1-naphthyl), a substituted aryl group having 6 to 20 carbon atoms, preferably 6 to 10 carbon atoms, and more preferably 6 to 8 carbon atoms (for example, aryl groups substituted with the aforementioned V, examples of which include p-methoxyphenyl, p-methylphenyl and p-chlorophenyl), an unsubstituted heterocyclic group having 1 to 20 carbon atoms, preferably 3 to 10 carbon atoms, and more preferably 4 to 8 carbon atoms (for example, 2-furyl, 2-thienyl, 2-pyridyl, 3-pyrazolyl, 3-isoxazolyl, 3-isothiazolyl, 2-imidazolyl, 2-oxaxolyl, 2-thiazolyl, 2-pyridazyl, 2-pyrimidyl, 3-pyrazyl, 2-(1,3,5-triazolyl), 3-(1,2,4-triazolyl) or 5-tetrazolyl) and a substituted heterocyclic group having 1 to 20 carbon atoms, preferably 3 to 10 carbon atoms, and more preferably 4 to 8 carbon atoms (for example, heterocyclic groups substituted with the aforementioned V, examples of which include 5-methyl-2-thienyl and 4-methoxy-2-pyridyl).

Each of $R_3$, $R_4$, $R_5$, $R_6$, $R_7$ and $R_8$ preferably represents the above substituted or unsubstituted alkyl group; more preferably the above mentioned carboxyalkyl group, sulfoalkyl group or alkylsulfonylcarbamoylalkyl group; and most preferably the sulfoalkyl group.

$Q_1$ represents an aromatic ring that condensates to the benzene nuclei. The aromatic ring is, for example, a hydrocarbon aromatic ring or a heterocyclic aromatic ring. Further, the aromatic ring may be a polycyclic condensed ring resulting from condensation of hydrocarbon aromatic rings or heterocyclic aromatic rings, or may be a polycyclic condensed ring consisting of a combination of a hydrocarbon aromatic ring and a heterocyclic aromatic ring. The aromatic ring may be substituted with, for example, the aforementioned substituent V. Examples of preferred aromatic rings include benzene, naphthalene, anthracene, phenanthrene, fluorene, naphthacene, pyrrole, furan, thiophene, imidazole, oxazole, thiazole, pyridine, pyrazine, pyrimidine, pyridazine, indolizine, indole, benzofuran, benzothiophene, isobenzofuran, quinolizine, quinoline, phthalazine, naphthyridine, quinoxaline, quinoxazoline, carbazole, phenanthridine, acridine, phenanthroline, thianthrene, chromene, xanthene, phenoxathiin, phenothiazine and phenazine.

Benzene, naphthalene, pyrrole, furan, thiophene, pyridine and quinoline are more preferred, and benzene is much more preferred.

$Q_1$ may be condensed at any position of the benzothiazole nucleus. When benzene ring is condensed to the benzothiazole nucleus, the general formula (I) can be represented by the following formulae:

(Ia)

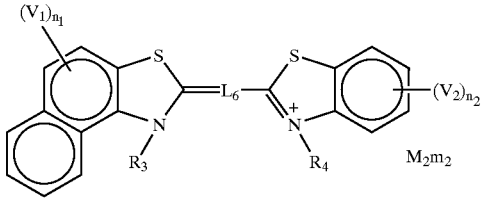

(Ib)

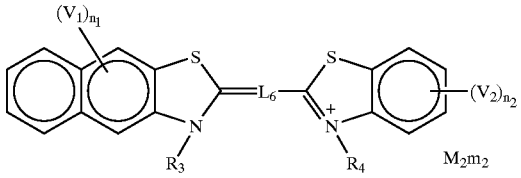

(Ic)

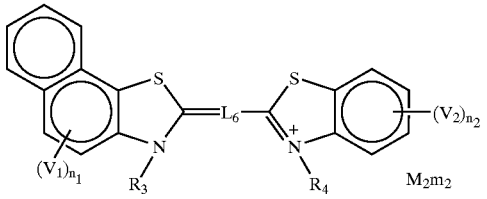

Preferred condensation position is shown in the above general formulae (Ia) and (Ib), and more preferred condensation position is shown in the general formula (Ia).

Each of $V_1$, $V_2$, $V_3$, $V_4$, $V_5$ and $V_6$ independently represents a monovalent substituent. The substituent, although not particularly limited, is preferably represented by the aforementioned V. Provided however that, in the presence of a plurality of $V_3$ substituents, it does not occur that two neighboring $V_3$ substituents are bonded with each other to thereby form an aromatic ring (hydrocarbon aromatic ring or heterocyclic aromatic ring). In the presence of a plurality of $V_4$ substituents as well, it does not occur that two neighboring $V_4$ substituents are bonded with each other to thereby form an aromatic ring.

$V_1$ is preferably any of alkyl groups, alkoxy groups and halogen atoms whose examples have been set forth as being represented by V mentioned above. $V_2$ is preferably any of alkyl groups, aryl groups, alkoxy groups, halogen atoms, acyl groups, alkoxycarbonyl groups, and cyano groups whose examples have been set forth as being represented by V, and a benzene ring condensate. More preferably, $V_2$ represents an alkyl group, an aryl group, an alkoxy group, a halogen atom or a cyano group. Especially preferably, $V_2$ represents a methyl group, a phenyl group, a methoxy group, a fluorine atom, a chlorine atom, a bromine atom, an iodine atom or a cyano group. Most preferably, $V_2$ represents a methoxy group or a chlorine atom. Each of $V_3$ and $V_4$ is preferably any of alkyl groups, aryl groups, alkoxy groups, halogen atoms, alkoxycarbonyl groups and cyano groups whose examples have been set forth as being represented by V. More preferably, each of $V_3$ and $V_4$ represents a methyl group, a phenyl group, a methoxy group, a fluorine atom, a chlorine atom, a bromine atom, an iodine atom or a cyano group. Especially preferably, each of $V_3$ and $V_4$ represents a chlorine atom. Each of $V_5$ and $V_6$ is preferably any of alkyl groups, aryl groups, alkoxy groups, halogen atoms, acyl groups, alkoxycarbonyl groups, and cyano groups whose examples have been set forth as being represented by V, and benzene ring condensates. More preferably, each of $V_5$ and $V_6$ represents an alkyl group, an aryl group, an alkoxy group, a halogen atom or a cyano group, or, in the presence of a plurality of $V_5$ or $V_6$ substituents, represents a benzene ring condensate formed by two neighboring $V_5$ substituents or two neighboring $V_6$ substituents. Especially preferably, each of $V_5$ and $V_6$ represents a methyl group, a phenyl group, a methoxy group, a fluorine atom, a chlorine atom, a bromine atom, an iodine atom, a cyano group or a benzene ring condensate. Most preferably, each of $V_5$ and $V_6$ represents a phenyl group, a chlorine atom or a benzene ring condensate. When $Z_3$ represents an oxygen atom, it is preferred that at least one of $n_5$ and $n_6$ be an integer of 2 or more and that two neighboring $V_5$ substituents and/or two neighboring $V_6$ substituents form condensated benzene ring (s).

$n_1$ is 0, 1 or 2. Each of $n_2$, $n_3$, $n_4$, $n_5$ and $n_6$ independently is 0, 1, 2, 3 or 4. $n_1$ is preferably 0 or 1, more preferably 0. Each of $n_2$, $n_3$ and $n_4$ is preferably 1 or 2, more preferably 1.

Each of $n_5$ and $n_6$ is preferably 1 or 2. When $n_1$, $n_2$, $n_3$, $n_4$, $n_5$ and $n_6$ are 2 or more, respective $V_1$, $V_2$, $V_3$, $V_4$, $V_5$ and $V_6$ are plural. In this case, it is not needed at all that the plural substituents are identical with each other.

When $n_2$, $n_3$, $n_4$, $n_5$ and $n_6$ are 1, the substitution position of respective $V_2$, $V_3$, $V_4$, $V_5$ and $V_6$ is preferably 5-position. When each of $n_2$, $n_5$ and $n_6$ is 2 and each of two $V_2$ substituents, two $V_5$ substituents and two $V_6$ substituents is bonded with each other to thereby form a ring, the substitution positions of the two $V_2$ substituents, the two $V_5$ substituents and the two $V_6$ substituents are preferably 4- and 5-positions, or 5- and 6-positions, more preferably 4- and 5-positions. The position numbers are as indicated below.

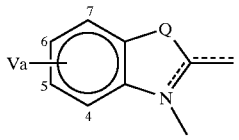

Va = substituent
Q = O or S $M_1$, $M_2$, $M_3$ and $M_4$, when required for neutralizing the ionic charge of the dye, are included in the formulae in order to indicate the presence of a cation or an anion. Typical cation is, for example, an inorganic cation such as hydrogen ion ($H^+$), an alkali metal ion (e.g., sodium ion, potassium ion or lithium ion) or an alkaline earth metal ion (e.g., calcium ion), or an organic ion such as an ammonium ion (e.g., ammonium ion, tetraalkylammonium ion, pyridinium ion or ethylpyridinium ion). The anion may be organic one or inorganic one, which is, for example, a halide anion (e.g., fluoride ion, chloride ion or iodide ion), a substituted arylsulfonic ion (e.g., p-toluenesulfonate ion or p-chlorobenzenesulfonate ion), an aryldisulfonate ion (e.g., 1,3-benzenesulfonate ion, 1,5-naphthalenedisulfonate ion or 2,6-naphthalenedisulfonate ion), an alkylsulfate ion (e.g., methylsulfate ion), sulfate ion, thiocyanate ion, perchlorate ion, tetrafluoroborate ion, picrate ion, acetate ion or trifluoromethanesulfonate ion. Further, use may be made of an ionic polymer or another dye that has a charge counter to that of the dye. $CO_2^-$and $SO_3^-$ can be indicated as $CO_2H$ and $SO_3H$, respectively, when hydrogen ion is possessed as counter ion.

Each of $m_1$, $m_2$, $m_3$ and $m_4$ independently represents the number required for balancing charges, which is preferably a number of 0 to 4, more preferably 0 to 1. When an intramolecular salt is formed, it is 0.

Specific examples of the compounds of the general formulae (I), (II) and (III) according to the present invention, which in no way limit the scope of the present invention, will be set forth below.

Specific examples of the compound represented by formula (I)

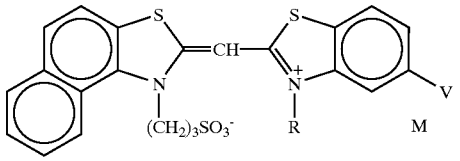

(I-1) V=Cl, R=$(CH_2)_3SO_3^-$, M=$HN^+(C_2H_5)_3$
(I-2) V=$OCH_3$, R=$(CH_2)_3SO_3^-$, M=$HN^+(C_2H_5)_3$
(I-3) V=CN, R=$(CH_2)_3SO_3^-$, M=$HN^+(C_2H_5)_3$
(I-4) V=$CO_2CH_3$, R=$(CH_2)_3SO_3^-$, M=$HN^+(C_2H_5)_3$
(I-5) V=$CH_3$, R=$(CH_2)_4SO_3^-$, M=$Na^+$
(I-6) V=$OCH_3$,

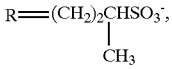

M=$K^+$
(I-7) V=F, R=$CH_2CONHSO_2CH_3$, M=–
(I-8) V=Br, R=$CH_2CO_2H$, M=–
(I-9)

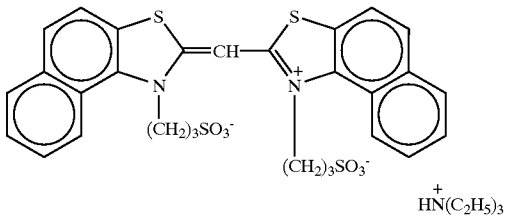

Specific examples of the compound represented by formula (II)

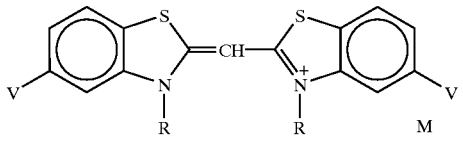

(II-1) V=Cl, R=$(CH_2)_4SO_3^-$, M=$HN^+(C_2H_5)_3$ (II-2, V=Cl,

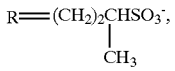

M=$HN^+(C_2H_5)_3$ (II-3) V=Br, R=$(CH_2)_4SO_3^-$, M=$HN^+(C_2H_5)_3$ (II-4) V=F, R=$(CH_2)_3SO_3^-$, M=$Na^+$ (II-5) V=CN, R=$CH_2CO_2H$, M=$Br^-$ (II-6)

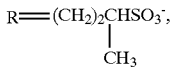

M=$HN^+(C_2H_5)_3$ (II-7) V=Cl, R=$CH_2CONHSO_2CH_3$, M=$Br^-$

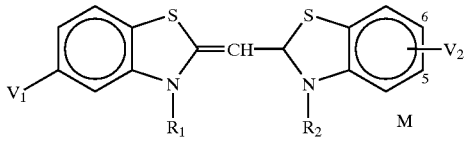

(II-8) $V_1=V_2$=5-Cl, $R_1=(CH_2)_4SO_3^-$, $R_2=CH_2CONHSO_2CH_3$, M=–

(II-9)

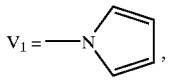

$V_2$=5-Cl, $R_1=R_2=(CH_2)_3SO_3^-$, M=$HN^+(C_2H_5)_3$ (II-10)

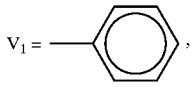

$V_2$=5,6-$(OCH_3)_2$,

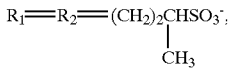

M=$HN^+(C_2H_5)_3$

Specific examples of the compound represented by formula (III)

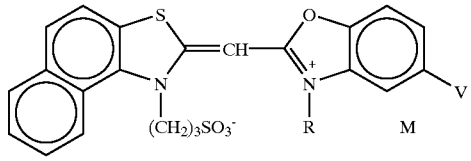

(III-1)

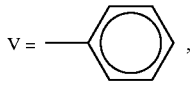

R=$(CH_2)_4SO_3^-$, M=$HN^+(C_2H_5)_3$ (III-2) V=Br, R=$(CH_2)_3SO_3^-$, M=$HN^+(C_2H_5)_3$ (III-3) V=Cl, R=$CH_2CO_2H$, M=–

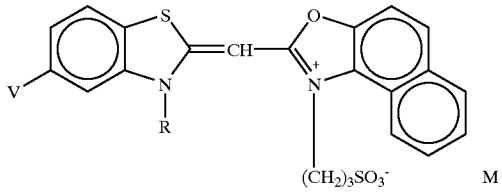

(III-4) V=Cl, R=$(CH_2)_3SO_3^-$, M=$HN^+(C_2H_5)_3$ (III-5)

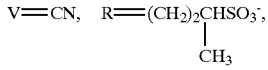

M=$Na^+$ (III-6) V=$OCH_3$, R=$CH_2CONHSO_2CH_3$, M=–

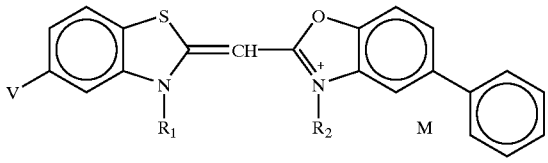

(III-7) V=Cl, $R_1=R_2=(CH_2)_3SO_3^-$, M=$HN^+(C_2H_5)_3$ (III-8) V=Cl,

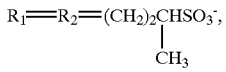

M=$HN^+(C_2H_5)_3$ (III-9) V=F, $R_1$=$CH_2CONHSO_2CH_3$, $R_2$=$(CH_2)_3SO_3^-$, M=–

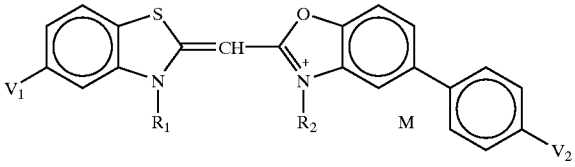

(III-10) $V_1$=Cl, $V_2$=Br, $R_1$=$R_2$=$(CH_2)_4SO_3^-$, M=$HN^+(C_2H_5)_3$ (III-11) $V_1$=Br, $V_2$=H, $R_1$=$R_2$=$(CH_2)_4SO_3^-$, M=$HN^+(C_2H_5)_3$ (III-12) $V_1$=Br, $V_2$=Br, $R_1$=$R_2$=$(CH_2)_4SO_3^-$, M=$HN^+(C_2H_5)_3$

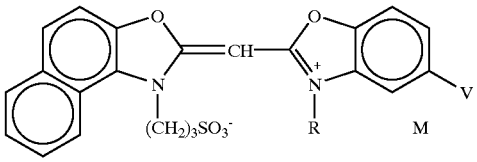

(III-13) V=Cl, R=$(CH_2)_3SO_3^-$, M=$HN^+(C_2H_5)_3$ (III-14)

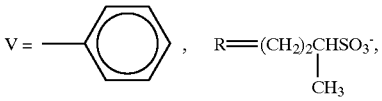

M=$Na^+$ (III-15)

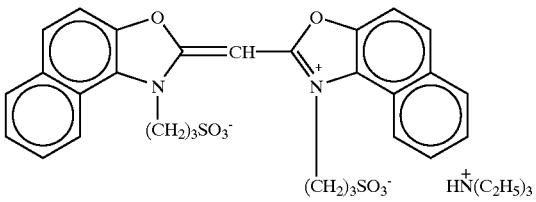

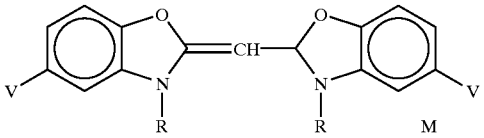

(III-16)

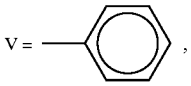

R=$CH_2)_3SO_3^-$, M=$HN^+(C_2H_5)_3$ (III-17) V=Cl, R=$(CH_2)_4SO_3^-$, M=$Na^+$ (III-18)

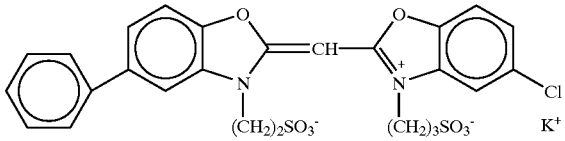

The compounds of the general formulae (I), (II) and (III) according to the present invention can be synthesized by the processes described in, for example, F. M. Harmer, "Heterocyclic Compounds-Cyanine Dyes and Related Compounds", John Wiley & Sons, New York, London, 1964; D. M. Sturmer, "Heterocyclic Compounds—Special topics in heterocyclic chemistry", chapter 18, section 14, pages 482 to 515, John Wiley & Sons, New York, London, 1977; and Rodd's Chemistry of Carbon Compounds, 2nd. Ed. vol. IV, part B, 1977, chapter 15, pages 369 to 422, Elsevier Science Publishing Company Inc., New York.

The sensitizing dyes of the general formulae (I), (II) and (III) according to the present invention, can be mixed at an arbitrary ratio. It is preferable that each of the sensitizing dyes of general formula (I), (II) and (III) is contained in each of the blue-sensitive emulsion layers. The ratio of the dye of formula (I) in each layer to the total sensitizing dyes contained in the each layer, the ratio of the dye of formula (II) in each layer to the total sensitizing dyes contained in the each layer, and the ratio of the dye of formula (III) in each layer to the total sensitizing dyes contained in the each layer are 10 mol % or more, preferably, 20 mol % or more. The absolute amounts of the dyes of formula (I), (II) and (III) can be set depending, for example, on a size of silver halide grains.

At least one sensitizing dye selected from the group consisting of the sensitizing dyes of the general formulae (I) and (II) and at least one sensitizing dye represented by the general formula (III) according to the present invention, although can be contained in any of color-sensitive layers such as a red-sensitive emulsion layer, a green-sensitive emulsion layer and a blue-sensitive emulsion layer, are preferably incorporated in the blue-sensitive emulsion layer.

It is preferred that at least one sensitizing dye represented by the general formula (I), at least one sensitizing dye represented by the general formula (II) and at least one sensitizing dye represented by the general formula (III) be used in combination in the color photographic lightsensitive material of the present invention.

The emulsion which can be used in the lightsensitive material of the present invention is preferably one composed of silver iodobromide, silver bromide or silver chloroiodobromide tabular grains.

With respect to the tabular silver halide grains (hereinafter also simply referred to as "tabular grains"), the terminology "aspect ratio" means the ratio of diameter to thickness of the silver halide. That is, it is a quotient of the diameter divided by the thickness of each individual silver halide grain. The terminology "diameter" used herein refers to the diameter of a circle having an area equal to the projected area of a silver halide grain as obtained when observing the grain through a microscope or an electron microscope.

The color photographic lightsensitive material of the present invention comprises a support and, superimposed thereon, at least one red-sensitive silver halide emulsion layer, at least one green-sensitive silver halide emulsion layer and at least one blue-sensitive silver halide emulsion layer. It is preferred that each color-sensitive silver halide emulsion layer unit consist of two or more silver halide emulsion layers differing from each other in speed, in which at least one emulsion layer of the highest speed contains silver halide grains comprising tabular silver halide grains in a proportion of 50% or more based on the total projected area of the silver halide grains, the tabular silver halide grains having an average aspect ratio of 8 or more, preferably 10 or more, and most preferably 12 or more.

In the present invention, the terminology "average aspect ratio" means an average of the aspect ratios of all the tabular grains of the emulsion.

The method of taking a transmission electron micrograph by the replica technique and measuring the equivalent circular diameter and thickness of each individual grain can be mentioned as an example of aspect ratio determining method. In the mentioned method, the thickness is calculated from the length of replica shadow.

The configuration of tabular grains of the present invention is generally hexagonal. The terminology "hexagonal configuration" means that the shape of the principal plane of tabular grains is hexagonal, the neighboring side ratio (maximum side length/minimum side length) thereof being 2 or less. The neighboring side ratio is preferably 1.6 or less, more preferably 1.2 or less. That the lower limit thereof is 1.0 is needless to mention. In the grains of high aspect ratio, especially, triangular tabular grains are increased in the tabular grains. The triangular tabular grains are produced when the Ostwald ripening has excessively been advanced. From the viewpoint of obtaining substantially hexagonal tabular grains, it is preferred that the period of this ripening be minimized. For this purpose, it is requisite to endeavor to raise the tabular grain ratio by nucleation. It is preferred that one or both of an aqueous silver ion solution and an aqueous bromide ion solution contain gelatin for the purpose of raising the probability of occurrence of hexagonal tabular grains at the time of adding silver ions and bromide ions to a reaction mixture according to the double jet technique, as described in Japanese Patent Application KOKAI Publication (hereinafter referred to as JP-A-) 63-11928 by Saito.

The hexagonal tabular grains for use in the present invention are formed through the steps of nucleation, Ostwald ripening and growth. Although all of these steps are important for suppressing the spread of grain size distribution, especial attention should be paid so as to prevent the spread of size distribution at the first nucleation step because the spread of size distribution brought about in a previous step cannot be narrowed by an ensuing step. What is important in the nucleation step is the relationship between the temperature of reaction mixture and the period of nucleation comprising adding silver ions and bromide ions to a reaction mixture according to the double jet technique and producing precipitates. JP-A-63-92942 by Saito describes that it is preferred that the temperature of the reaction mixture at the time of nucleation be in the range of from 20 to 45° C. for realizing a monodispersity enhancement. Further, JP-A-2-222940 by Zola et al describes that the suitable temperature at nucleation is 60° C. or below.

Gelatin may be further added during the grain formation in order to obtain monodisperse tabular grains of high aspect ratio. The added gelatin preferably consists of a chemically modified gelatin as described in JP-A-10-148897 and JP-A-11-143002, the disclosures of which are incorporated herein by reference. The modified gelatin has at least two —COOH groups newly introduced at a chemical modification of —$NH_2$ groups contained in the gelatin. This chemically modified gelatin is a gelatin characterized in that at least two carboxyl groups have newly been introduced at a chemical modification of amino groups contained in the gelatin, it is preferred that trimellitated gelatin be used as the same. Also, succinated gelatin is also preferably used. The chemically modified gelatin is preferably added prior to the growth step, more preferably immediately after the nucleation. The addition amount thereof is preferably at least 60%, more preferably at least 80%, and especially preferably at least 90%, based on the total weight of dispersion medium used in grain formation.

The tabular grain emulsion is composed of silver iodobromide or silver chloroiodobromide. Although silver chloride may be contained, the silver chloride content is preferably 8 mol % or less, more preferably 3 mol % or less, or 0 mol %. The silver iodide content is preferably 20 mol % or less since the variation coefficient of the grain size distribution of the tabular grain emulsion is preferably 30% or less. The lowering of the variation coefficient of the distribution of equivalent circular diameter of the tabular grain emulsion can be facilitated by lowering the silver iodide content. The variation coefficient of the grain size distribution of the tabular grain emulsion is more preferably 20% or less, and the silver iodide content is more preferably 10 mol % or less.

It is preferred that the tabular grain emulsion have some intragranular structure with respect to the silver iodide distribution. The silver iodide distribution may have a double structure, a treble structure, a quadruple structure or a structure of higher order.

In the present invention, the tabular grains have dislocation lines. The dislocation lines of the tabular grains can be observed by the direct method using a transmission electron microscope at low temperatures as described in, for example, J. F. Hamilton, Phot. Sci. Eng., 11, 57 (1967) and T. Shiozawa, J. Soc. Phot. Sci. Japan, 3, 5, 213 (1972). Illustratively, silver halide grains are harvested from the emulsion with the care that the grains are not pressurized with such a force that dislocation lines occur on the grains, are put on a mesh for electron microscope observation and, while cooling the specimen so as to prevent damaging (printout, etc.) by electron beams, are observed by the transmission method. The greater the thickness of the above grains, the more difficult the transmission of electron beams. Therefore, the use of an electron microscope of high voltage type (at least 200 kV on the grains of 0.25 $\mu$m in thickness) is preferred for ensuring clearer observation. The thus obtained photograph of grains enables determining the position and number of dislocation lines in each grain viewed in the direction perpendicular to the principal planes.

The number of dislocation lines of the tabular grains for use in the present invention is preferably at least 10 per grain on the average and more preferably at least 20 per grain on the average. When dislocation lines are densely present or when dislocation lines are observed in the state of crossing each other, it happens that the number of dislocation lines per grain cannot accurately be counted. However, in this instance as well, rough counting on the order of, for example, 10, 20 or 30 dislocation lines can be effected, so that a clear distinction can be made from the presence of only a few dislocation lines. The average number of dislocation lines per grain is determined by counting the number of dislocation lines of each of at least 100 grains and calculating a number average thereof. There are instances when hundreds of dislocation lines are observed.

Dislocation lines can be introduced in, for example, the vicinity of the periphery of tabular grains. In this instance, the dislocation is nearly perpendicular to the periphery, and each dislocation line extends from a position corresponding to x % of the distance from the center of tabular grains to the side (periphery) to the periphery. The value of x preferably ranges from 10 to less than 100, more preferably from 30 to less than 99, and most preferably from 50 to less than 98. In this instance, the figure created by binding the positions from which the dislocation lines start is nearly similar to the configuration of the grain. The created figure may be one which is not a complete similar figure but deviated. The dislocation lines of this type are not observed around the center of the grain. The dislocation lines are crystallographically oriented approximately in the (211) direction. However, the dislocation lines often meander and may also cross each other.

Dislocation lines may be positioned either nearly uniformly over the entire zone of the periphery of the tabular grains or local points of the periphery. That is, referring to, for example, hexagonal tabular silver halide grains, dislocation lines may be localized either only in the vicinity of six apexes or only in the vicinity of one of the apexes. Contrarily, dislocation lines can be localized only in the sides excluding the vicinity of six apexes.

Furthermore, dislocation lines may be formed over regions including the centers of two mutually parallel principal planes of tabular grains. In the case where dislocation lines are formed over the entire regions of the principal planes, the dislocation lines may crystallographically be oriented approximately in the (211) direction when viewed in the direction perpendicular to the principal planes, and the formation of the dislocation lines may be effected either in the (110) direction or randomly. Further, the length of each dislocation line may be random, and the dislocation lines may be observed as short lines on the principal planes or as long lines extending to the side (periphery). The dislocation lines may be straight or often meander. In many instances, the dislocation lines cross each other.

The position of dislocation lines may be localized on the periphery, principal planes or local points as mentioned above, or the formation of dislocation lines may be effected on a combination thereof. That is, dislocation lines may be concurrently present on both the periphery and the principal planes.

The introduction of dislocation lines in the tabular grains can be accomplished by disposing a specified phase of high silver iodide content within the grains. In the dislocation line introduction, the phase of high silver iodide content may be provided with discontinuous regions of high silver iodide content. Practically, the phase of high silver iodide content within the grains can be obtained by first preparing base grains, providing them with a phase of high silver iodide content and covering the outside thereof with a phase of silver iodide content lower than that of the phase of high silver iodide content. The silver iodide content of the base tabular grains is lower than that of the phase of high silver iodide content, and is preferably 0 to 20 mol %, more preferably 0 to 15 mol %.

The terminology "phase of high silver iodide content within the grains" refers to a silver halide solid solution containing silver iodide. The silver halide of this solid solution is preferably silver iodide, silver iodobromide or silver chloroiodobromide, more preferably silver iodide or silver iodobromide (the silver iodide content is in the range of 10 to 40 mol % based on the silver halides contained in the phase of high silver iodide content). For selectively causing the phase of high silver iodide content within the grains (hereinafter referred to as "internal high silver iodide phase") to be present on any place of the sides, corners and faces of the base grains, it is desirable to control forming conditions for the base grains, forming conditions for the internal high silver iodide phase and forming conditions for the phase covering the outside thereof. With respect to the forming conditions for the base grains, the pAg (logarithm of inverse number of silver ion concentration), the presence or absence, type and amount of silver halide solvent and the temperature are important factors. Regulating the pAg at base grain growth to 8.5 or less, preferably 8 or less, enables selectively causing the internal high silver iodide phase to be present near the apex or on the face of the base grains in the subsequent step of forming the internal high silver iodide phase. On the other hand, regulating the pAg at base grain growth to at least 8.5, preferably at least 9, enables causing the internal high silver iodide phase to be present on the side of the base grains in the subsequent step of forming the internal high silver iodide phase. The threshold value of the pAg is changed upward or downward depending on the temperature and the presence or absence, type and amount of silver halide solvent. When, for example, a thiocyanate is used as the silver halide solvent, the threshold value of the pAg is deviated toward a higher value. What is most important as the pAg at growth is the pAg at the termination of growth of base grains. On the other hand, even when the pAg at growth does not satisfy the above value, the selected position of the internal high silver iodide phase can be controlled by carrying out, after the growth of base grains, the regulation to the above pAg and a ripening. Ammonia, an amine compound, a thiourea derivative or a thiocyanate salt is effective as the silver halide solvent. For the formation of the internal high silver iodide phase, use can be made of the so-called conversion methods. These conversion methods include one in which, during grain formation, halide ions whose salts formed with silver ions exhibit a solubility lower than that of the salts formed with the halide ions that are forming the grains or the vicinity of the surface of the grains occurring at the time of grain formation, are added. In the present invention, it is preferred that the amount of added low-solubility halide ions be at least some value (relating to halogen composition) relative to the surface area of grains occurring at the time of the addition. For example, it is preferred that, during grain formation, KI be added in an amount not smaller than some amount relative to the surface area of silver halide grains occurring at the time of the grain formation. Specifically, it is preferred that an iodide salt be added in an amount of at least $8.2\times10^{-5}$ mol/m$^2$.

Preferred process for forming the internal high silver iodide phase comprises adding an aqueous solution of a silver salt simultaneously with the addition of an aqueous solution of halide salts containing an iodide salt.

For example, an aqueous solution of $AgNO_3$ is added simultaneously with the addition of an aqueous solution of KI by the double jet. The addition initiating times and addition completing times of the aqueous solution of KI and the aqueous solution of $AgNO_3$ may be differed from each other, that is, the one may be earlier or later than the other. The addition molar ratio of an aqueous solution of $AgNO_3$ to an aqueous solution of KI is preferably at least 0.1, more preferably at least 0.5, and most preferably at least 1. The total addition molar amount of an aqueous solution of $AgNO_3$ relative to halide ions within the system and added iodide ions may fall in a silver excess region. It is preferred that the pAg exhibited when the aqueous solution of halide containing such iodide ions and the aqueous solution of silver salt are added by the double jet be decreased in accordance with the passage of double jet addition time. The pAg prior to the addition initiation is preferably in the range of 6.5 to 13, more preferably 7.0 to 11. The pAg at the time of addition completion is most preferably in the range of 6.5 to 10.0.

In the performing of the above process, it is preferred that the solubility in the mixture system be as low as possible. Accordingly, the temperature of the mixture system exhibited at the time of formation of the high silver iodide phase is preferably in the range of 30 to 80° C., more preferably 30 to 70° C.

Furthermore, the formation of the internal high silver iodide phase can preferably be performed by adding fine grains of silver iodide, fine grains of silver iodobromide, fine grains of silver chloroiodide or fine grains of silver chloroiodobromide. It is especially preferred that the formation be effected by adding fine grains of silver iodide. Although these fine grains generally have a size of 0.01 to 0.1 μm, use can also be made of fine grains with a size of not greater than 0.01 μm, or 0.1 μm or more. With respect to the process for preparing these fine grains of silver halide, reference can be made to descriptions of JP-A's-1-183417, 2-44335, 1-183644, 1-183645, 2-43534 and 2-43535. The internal high silver iodide phase can be provided by adding these fine grains of silver halide and conducting a ripening. When the fine grains are dissolved by ripening, use can be made of the aforementioned silver halide solvent. It is not needed that all these added fine grains be immediately dissolved and disappear. It is satisfactory if, when the final grains have been completed, they are dissolved and disappear.

The position of the internal high silver iodide phase, as measured from the center of, for example, a hexagon resulting from grain projection, is preferably present in the range of 5 to less than 100 mol %, more preferably 20 to less than 95 mol %, and most preferably 50 to less than 90 mol %, based on the amount of silver of the whole grain. The amount of silver halide forming this internal high silver iodide phase, in terms of the amount of silver, is 50 mol % or less, preferably 20 mol % or less, based on the amount of silver of the whole grain. With respect to the above high silver iodide phase, there are provided recipe values of the production of silver halide emulsion, not values obtained by measuring the halogen composition of final grains according to various analytical methods. The internal high silver iodide phase is often caused to completely disappear in final grains by, for example, recrystallization during the shell covering step, and all the above silver amounts relate to recipe values thereof.

Therefore, although the observation of dislocation lines can be easily performed in the final grains by the above method, the internal silver iodide phase introduced for the introduction of dislocation lines often cannot be confirmed as a clear phase because the boundary silver iodide composition is continuously changed. The halogen composition at each grain part can be determined by a combination of X-ray diffractometry, the EPMA method (also known as the XMA method, in which silver halide grains are scanned by electron beams to thereby detect the silver halide composition), the ESCA method (also known as the XPS method, in which X rays are irradiated and photoelectrons emitted from grain surface are separated into spectra), etc.

The outside phase which covers the internal high silver iodide phase has a silver iodide content lower than that of the internal high silver iodide phase. The silver iodide content of the covering outside phase is preferably in the range of 0 to 30 mol %, more preferably 0 to 20 mol %, and most preferably 0 to 10 mol %, based on the silver halide contained in the covering outside phase.

Although the temperature and pAg employed at the formation of the outside phase which covers the internal high silver iodide phase are arbitrary, the temperature preferably ranges from 30 to 80° C., most preferably from 35 to 70° C., and the pAg preferably ranges from 6.5 to 11.5. The use of the aforementioned silver halide solvent is occasionally preferred, and the most preferred silver halide solvent is a thiocyanate salt.

Another method of introducing dislocation lines in the tabular grains comprises using an iodide ion-releasing agent as described in JP-A-6-11782, which can preferably be employed.

Also, dislocation lines can be introduced by appropriately combining this method of introducing dislocation lines with the aforementioned method of introducing dislocation lines.

The variation coefficient of the intergranular iodine distribution of silver halide grains for use in the present invention is preferably 20% or less, more preferably 15% or less, and much more preferably 10% or less. When the variation coefficient of the iodine content distribution of each silver halide is greater than 20%, unfavorably, a high contrast is not realized and a sensitivity lowering is intense when a pressure is applied.

Any known processes such as the process of adding fine grains as described, for example, in JP-A-1-183417 and the process of using an iodide ion-releasing agent as described in JP-A-2-68538 can be employed either individually or in combination for the production of silver halide grains whose intergranular iodine distribution is narrow for use in the present invention.

The silver halide grains for use in the present invention preferably have a variation coefficient of intergranular iodine distribution of 20% or less. The process described in JP-A-3-213845 can be used as the most suitable process for converting the intergranular iodine distribution to a monodispersion. That is, a monodisperse intergranular iodine distribution can be accomplished by a process in which fine silver halide grains containing silver iodide in an amount of at least 95 mol % are formed by mixing together an aqueous solution of a water soluble silver salt and an aqueous solution of a water soluble halide (containing at least 95 mol % of iodide ions) by means of a mixer provided outside a reactor vessel for crystal growth and, immediately after the formation, fed in the reactor vessel. The terminology "reactor vessel" used herein means the vessel in which the nucleation and/or crystal growth of tabular silver halide grains is carried out.

With respect to the above process of mixer preparation followed by adding procedure and the preparatory means for use therein, the following three techniques can be employed as described in JP-A-3-213845:

(i) immediately after formation of fine grains in a mixer, the fine grains are transferred into a reactor vessel;

(ii) powerful and effective agitation is carried out in the mixer; and (iii) an aqueous solution of protective colloid is injected into the mixer.

The protective colloid used in technique (iii) above may be separately injected in the mixer, or may be incorporated in the aqueous solution of silver halide or the aqueous solution of silver nitrate before the injection in the mixer. The concentration of protective colloid is at least 1% by weight, preferably in the range of 2 to 5% by weight. Examples of polymeric compounds exhibiting a protective colloid function to the silver halide grains for use in the present invention include polyacrylamide polymers, amino polymers, polymers having thioether groups, polyvinyl alcohol, acrylic polymers, hydroxyquinoline having polymers, cellulose, starch, acetal, polyvinylpyrrolidone and ternary polymers. Low-molecular-weight gelatin can preferably be used as the above polymeric compound. The molecular weight of low-molecular-weight gelatin is preferably 30,000 or less, more preferably 10,000 or less.

The grain formation temperature in the preparation of fine silver halide grains is preferably 35° C. or below, more preferably 25° C. or below. The temperature of the reactor vessel in which fine silver halide grains are incorporated is at least 50° C., preferably at least 60° C., and more preferably at least 70° C.

The grain size of fine-size silver halide for use in the present invention can be determined by placing grains on a mesh and making a direct observation through a transmission electron microscope. The size of fine grains of the present invention is 0.3 μm or less, preferably 0.1 μm or less, and more preferably 0.01 μm or less. This fine silver halide may be added simultaneously with the addition of other halide ions and silver ions, or may be separately added. The fine silver halide grains are mixed in an amount of 0.005 to 20 mol %, preferably 0.01 to 10 mol %, based on the total silver halide.

The silver iodide content of each individual grain can be measured by analyzing the composition of each individual grain by means of an X-ray microanalyzer. The terminology "variation coefficient of intergranular iodine distribution" means a value defined by the formula:

variation coefficient=(standard deviation/av. silver iodide content)×100 wherein the standard deviation, specifically the standard deviation of silver iodide content, and the average silver iodide content are obtained by measuring the silver iodide contents of at least 100, preferably at least 200, and more preferably at least 300 emulsion grains. The measuring of the silver iodide content of each individual grain is described in, for example, EP No. 147,868. There are cases in which a correlation exists between the silver iodide content Yi (mol %) of each individual grain and the equivalent spherical diameter Xi (μm) of each individual grain and cases in which no such correlation exists. It is preferred that no correlation exist therebetween. The structure associated with the silver halide composition of grains of the present invention can be identified by, for example, a combination of X-ray diffractometry, the EPMA method (also known as the XMA method, in which silver halide grains are scanned by electron beams to thereby detect the silver halide composition) and the ESCA method (also known as the XPS method, in which x rays are irradiated and photoelectrons emitted from grain surface are separated into spectra). In the measuring of silver iodide content in the present invention, the terminology "grain surface" refers to the region whose depth from surface is about 50 Å, and the terminology "grain internal part" refers to the region other than the above surface. The halogen composition of such a grain surface can generally be measured by the ESCA method.

In the present invention, use can be made of not only the above tabular grains but also regular crystal grains such as cubic, octahedral and tetradecahedral grains and, further, amorphous twinned crystal grains.

The emulsions for use in the silver halide lightsensitive material of the present invention are preferably subjected to selenium sensitization.

Selenium compounds disclosed in hitherto published patents can be used as the selenium sensitizer in the present invention. In the use of unstable selenium compound and/or nonunstable selenium compound, generally, it is added to an emulsion and the emulsion is agitated at high temperature, preferably 40° C. or above, for a given period of time. Compounds described in, for example, Jpn. Pat. Appln. KOKOKU Publication No. (hereinafter referred to as JP-B-) 44-15748, JP-B-43-13489, JP-A's-4-25832 and 4-109240 are preferably used as the unstable selenium compound.

Specific examples of the unstable selenium sensitizers include isoselenocyanates (for example, aliphatic isoselenocyanates such as allyl isoselenocyanate), selenoureas, selenoketones, selenoamides, selenocarboxylic acids (for example, 2-selenopropionic acid and 2-selenobutyric acid), selenoesters, diacyl selenides (for example, bis(3-chloro-2,6-dimethoxybenzoyl)selenide), selenophosphates, phosphine selenides and colloidal metal selenium.

The unstable selenium compounds, although preferred types thereof are as mentioned above, are not limited thereto. It is generally understood by persons of ordinary skill in the art to which the invention pertains that the structure of the unstable selenium compound as a photographic emulsion sensitizer is not so important as long as the selenium is unstable and that the unstable selenium compound plays no other role than having its selenium carried by organic portions of selenium sensitizer molecules and causing it to present in unstable form in the emulsion. In the present invention, the unstable selenium compounds of this broad concept can be used advantageously.

Compounds described in JP-B's-46-4553, 52-34492 and 52-34491 can be used as the nonunstable selenium compound in the present invention. Examples of the nonunstable selenium compounds include selenious acid, potassium selenocyanate, selenazoles, quaternary selenazole salts, diaryl selenides, diaryl diselenides, dialkyl selenides, dialkyl diselenides, 2-selenazolidinedione, 2-selenoxazolidinethione and derivatives thereof.

Of these selenium compounds, those of the following general formula (A) and general formula (B) are preferred.

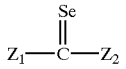

(A)

In the formula, $Z_1$ and $Z_2$ may be identical with or different from each other, and each represent an alkyl group (for example, methyl, ethyl, t-butyl, adamantyl or t-octyl), an alkenyl group (for example, vinyl or propenyl), an aralkyl group (for example, benzyl or phenethyl), an aryl group (for example, phenyl, pentafluorophenyl, 4-chlorophenyl, 3-nitrophenyl, 4-octylsulfamoylphenyl or α-naphthyl), a heterocyclic group (for example, 2-pyridyl, 3-thienyl, 2-furyl or 2-imidazolyl), $—NR_1(R_2)$, $—OR_3$ or $—SR_4$.

$R_1$, $R_2$, $R_3$ and $R_4$ may be identical with or different from each other, and each represent a hydrogen atom, an alkyl group, an aralkyl group, an aryl group, a heterocyclic group or an acyl group. Examples of the alkyl, aralkyl, aryl and heterocyclic groups are the same as mentioned with respect to $Z_1$. Provided that each of $R_1$ and $R_2$ may represent a hydrogen atom or an acyl group (for example, acetyl, propanoyl, benzoyl, heptafluorobutanoyl, difluoroacetyl, 4-nitrobenzoyl, α-naphthoyl or 4-trifluoromethylbenzoyl).

In the general formula (A), it is preferred that $Z_1$ represent an alkyl group, an aryl group or $—NR_1$ $(R_2)$ and that $Z_2$ represent $—NR_5(R_6)$. $R_1$, $R_2$, $R_5$ and $R_6$ may be identical with or different from each other, and each represent a hydrogen atom, an alkyl group, an aryl group or an acyl group.

The general formula (A) more preferably represents N,N-dialkylselenoureas, N,N,N'-trialkyl-N'-acylselenoureas, tetraalkylselenoureas, N,N-dialkylarylselenoamides and N-alkyl-N-arylarylselenoamides.

(B)

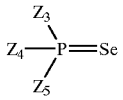

In the formula, $Z_3$, $Z_4$ and $Z_5$ may be identical with or different from each other, and each represent an alkyl group, an alkenyl group, an alkynyl group, an aralkyl group, an aryl group, a heterocyclic group, —$OR_7$, —$NR_8(R_9)$, —$SR_{10}$, —$SeR_{11}$, X or a hydrogen atom.

Each of $R_7$, $R_{10}$ and $R_{11}$ represents an alkyl group, an alkenyl group, an alkynyl group, an aralkyl group, an aryl group, a heterocyclic group, a hydrogen atom or a cation. Each of $R_8$ and $R_9$ represents an alkyl group, an alkenyl group, an alkynyl group, an aralkyl group, an aryl group, a heterocyclic group or a hydrogen atom. x represents a halogen atom.

In the general formula (B), the alkyl group, alkenyl group, alkynyl group and aralkyl group represented by $z_3$, $Z_4$, $Z_5$, $R_7$, $R_8$, $R_9$, $R_{10}$ and $R_{11}$ are linear, branched or cyclic alkyl group, alkenyl group, alkynyl group and aralkyl group, respectively (for example, methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl and phenethyl).

In the general formula (B), the aryl group represented by $Z_3$, $Z_4$, $Z_5$, $R_7$, $R_8$, $R_9$, $R_{10}$ and $R_{11}$ is a monocyclic or condensed-ring aryl group (for example, phenyl, pentafluorophenyl, 4-chlorophenyl, 3-sulfophenyl, α-naphthyl or 4-methylphenyl).

In the general formula (B), the heterocyclic group represented by $Z_3$, $Z_4$, $Z_5$, $R_7$, $R_8$, $R_9$, $R_{10}$ and $R_{11}$ is a saturated or an unsaturated heterocyclic group of 3 to 10 membered ring containing at least one of nitrogen, oxygen and sulfur atoms (for example, 2-pyridyl, 3-thienyl, 2-furyl, 2-thiazolyl, 2-imidazolyl or 2-benzimidazolyl). The heterocyclic group may have a condensed ring attached thereto.

In the general formula (B), the cation represented by $R_7$, $R_{10}$ and $R_{11}$ is an alkali metal atom (for example, $Na^+$or $K^+$) or ammonium. The halogen atom represented by x is, for example, a fluorine atom, a chlorine atom, a bromine atom or an iodine atom.

In the general formula (B), it is preferred that each of $Z_3$, $Z_4$ and $Z_5$ represent an alkyl group, an aryl group or —$OR_7$ and that $R_7$ represent an alkyl group or an aryl group.

The general formula (B) more preferably represents a trialkylphosphine selenide, a triarylphosphine selenide, a trialkyl selenophosphate or a triaryl selenophosphate.

Specific examples of the compounds of the general formulae (A) and (B) will be shown below, which in no way limit the present invention.

1

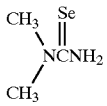

2

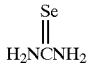

-continued

3

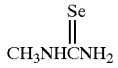

4

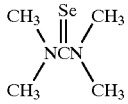

5

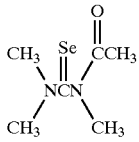

6

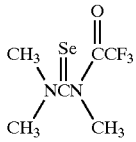

7

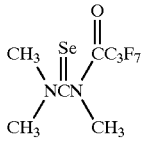

8

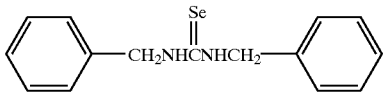

9

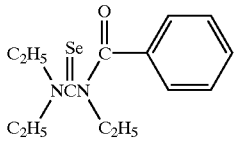

10

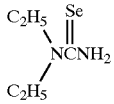

11

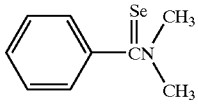

12

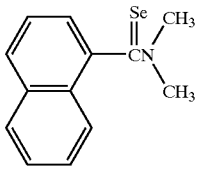

13

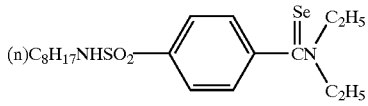

14

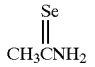

-continued
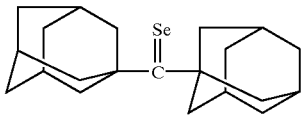
16
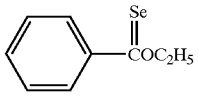
17
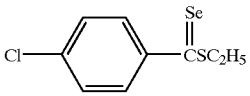
18
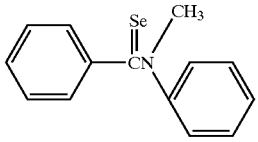
19
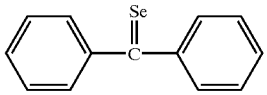
20
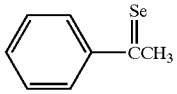
21
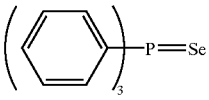
22
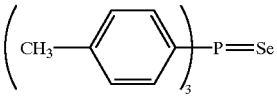
23
$(nC_4H_9)_3P{=}Se$
24
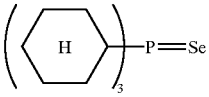
25
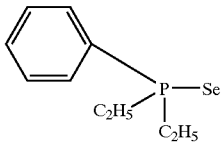
26
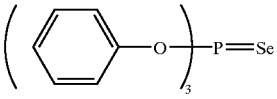
27
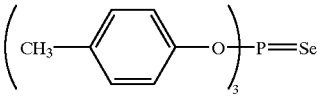
28
$(nC_4H_9O)_3P{=}Se$
-continued
29
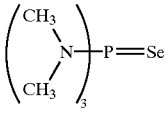
30
$(C_2H_5O)_3P{=}Se$
31
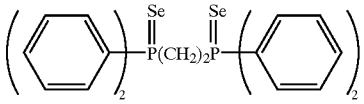
32
$(nC_8H_{17})_3P{=}Se$
33
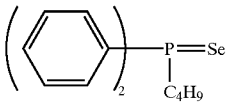
34
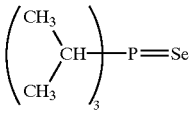
35
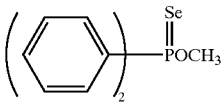
36
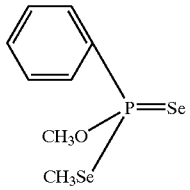
37
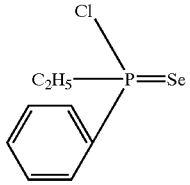
38
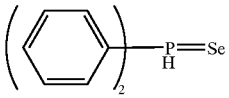
39
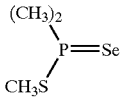
40
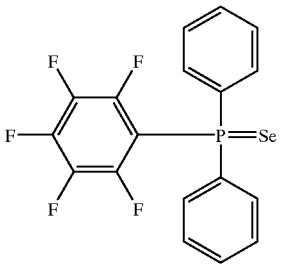

These selenium sensitizers are dissolved in a single solvent or a mixture of solvents selected from among water and organic solvents such as methanol and ethanol and added at the time of chemical sensitization. The above selenium sensitizers can be used either individually or in combination. The joint use of an unstable selenium compound and a nonunstable selenium compound is preferred.

The addition amount of selenium sensitizer for use in the present invention, although varied depending on the activity of employed selenium sensitizer, the type and size of silver halide, the ripening temperature and time, etc., is preferably in the range of $2\times10^{-6}$ to $5\times10^{-6}$ mol per mol of silver halide. The temperature of chemical sensitization in the use of a selenium sensitizer is preferably between 40° C. and 80° C. The pAg and pH are arbitrary. For example, with respect to pH, the effect of the present invention can be exerted even if it widely ranges from 4 to 9.

The selenium sensitization can more effectively be accomplished by performing it in the presence of a silver halide solvent.

Examples of the silver halide solvents which can be employed in the present invention include (a) organic thioethers described in U.S. Pat. Nos. 3,271,157, 3,531,289, and 3,574,628, and JP-A's-54-1019 and 54-158917, (b) thiourea derivatives described in, for example, JP-A's-53-82408, 55-77737 and 55-2982, (c) silver halide solvents having a thiocarbonyl group interposed between an oxygen or sulfur atom and a nitrogen atom, described in JP-A-53-144319, (d) imidazoles described in JP-A-54-100717, (e) sulfites and (f) thiocyanates.

Thiocyanates and tetramethylthiourea can be mentioned as especially preferred silver halide solvents. The amount of added solvent, although varied depending on the type thereof, is, for example, preferably in the range of $1\times10^{-4}$ to $1\times10^{-2}$ mol per mol of silver halide.

The emulsion for use in the present invention is preferably subjected to gold sensitization in combination with the selenium sensitization. The oxidation number of gold of the gold sensitizer used in the gold sensitization may be either +1 or +3, and gold compounds customarily used as gold sensitizers can be employed. Representative examples thereof include chloroauric acid salts, potassium chloroaurate, auric trichloride, potassium auric thiocyanate, potassium iodoaurate, tetracyanoauric acid, ammonium aurothiocyanate, pyridyltrichlorogold, gold sulfide and gold selenide. The addition amount of gold sensitizer, although varied depending on various conditions, is preferably between $1\times10^{-7}$ mol and $5\times10^{-5}$ mol per mol of silver halide as a yardstick.

With respect to the emulsion for use in the present invention, it is desired to perform the chemical sensitization in combination with sulfur sensitization.

The sulfur sensitization is generally performed by adding a sulfur sensitizer and agitating the emulsion at high temperature, preferably 40° C. or above, for a given period of time.

In the above sulfur sensitization, those known as sulfur sensitizers can be used. For example, use can be made of thiosulfates, allylthiocarbamidothiourea, allyl isothiacyanate, cystine, p-toluenethiosulfonates and rhodanine. Use can also be made of other sulfur sensitizers described in, for example, U.S. Pat. Nos. 1,574,944, 2,410,689, 2,278,947, 2,728,668, 3,501,313, and 3,656,955, and DE No. 1,422,869, JP-B-56-24937 and JP-A-55-45016. The addition amount of sulfur sensitizer is satisfactory if it is sufficient to effectively increase the sensitivity of the emulsion. This amount, although varied to a large extent under various conditions such as the pH, temperature and size of silver halide grains, is preferably in the range of $1\times10^{-7}$ to $5\times10^{-5}$ mol per mol of silver halide.

The silver halide emulsion for use in the lightsensitive material of the present invention can be subjected to a reduction sensitization during the grain formation, or after the grain formation but before the chemical sensitization, during the chemical sensitization or after the chemical sensitization.

The reduction sensitization can be performed by a method selected from among the method in which a reduction sensitizer is added to the silver halide emulsion, the method commonly known as silver ripening in which growth or ripening is carried out in an environment of pAg as low as 1 to 7 and the method commonly known as high-pH ripening in which growth or ripening is carried out in an environment of pH as high as 8 to 11. At least two of these methods can be used in combination.

The above method in which a reduction sensitizer is added is preferred from the viewpoint that the level of reduction sensitization can be finely regulated.

Examples of known reduction sensitizers include stannous salts, ascorbic acid and derivatives thereof, amines and polyamines, hydrazine derivatives, formamidinesulfinic acid, silane compounds and borane compounds. In the reduction sensitization according to the present invention, appropriate one may be selected from among these known reduction sensitizers and used or at least two may be selected and used in combination. Preferred reduction sensitizers are stannous chloride, thiourea dioxide, dimethylaminoborane, ascorbic acid and derivatives thereof. Although the addition amount of reduction sensitizer must be selected because it depends on the emulsion manufacturing conditions, it is preferred that the addition amount range from $10^{-7}$ to $10^{-3}$ mol per mol of silver halide.

Each reduction sensitizer is dissolved in water or any of organic solvents such as alcohols, glycols, ketones, esters and amides and added during the grain growth. Although the reduction sensitizer may be put in a reaction vessel in advance, it is preferred that the addition be effected at an appropriate time during the grain growth. It is also suitable to add in advance the reduction sensitizer to an aqueous solution of a water-soluble silver salt or a water-soluble alkali halide and to precipitate silver halide grains with the use of the resultant aqueous solution. Alternatively, the reduction sensitizer solution may preferably be either divided and added a plurality of times in accordance with the grain growth or continuously added over a prolonged period of time.

An oxidizer capable of oxidizing silver is preferably used during the process of producing the emulsion for use in the lightsensitive material of the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2].6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen-releasing compounds (e.g., N-bromosuccinimide, chloramine T and chloramine B).

Oxidizers preferred in the present invention are inorganic oxidizers selected from among ozone, hydrogen peroxide and its adducts, halogen elements and thiosulfonates and organic oxidizers selected from among quinones.

The use of the silver oxidizer in combination with the above reduction sensitization is preferred. This combined use can be effected by performing the reduction sensitization after the use of the oxidizer or vice versa or by simultaneously performing the reduction sensitization and the use of the oxidizer. These methods can be performed during the step of grain formation or the step of chemical sensitization.

The emulsion for use in the photographic lightsensitive material of the present invention can be subjected to a spectral sensitization with a methine dye other than the sensitizing dyes defined by the general formulae (I) to (III) according to the present invention, or the like. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. These dyes may contain any of nuclei commonly used in cyanine dyes as basic heterocyclic nuclei. Examples of such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have substituents on carbon atoms thereof.

The merocyanine dye or composite merocyanine dye may have a 5 or 6-membered heterocyclic nucleus such as a pyrazolin-5-one nucleus, a thiohydantoin nucleus, a 2-thioxazolidine-2,4-dione nucleus, a thiazolidine-2,4-dione nucleus, a rhodanine nucleus or a thiobarbituric acid nucleus as a nucleus having a ketomethylene structure.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, GB Nos. 1,344,281 and 1,507,803, JP-B's-43-4936 and 53-12375, and JP-A's-52-110618 and 52-109925.

The emulsion used in the present invention may contain with a dye which itself exerts no spectral sensitizing effect or a substance which absorbs substantially none of visible radiation and exhibits supersensitization, together with the above spectral sensitizing dye.

The addition timing of the spectral sensitizing dye to the emulsion may be performed at any stage of the process for preparing the emulsion which is known as being useful. Although the doping is most usually conducted at a stage between the completion of the chemical sensitization and the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization and, also, the spectral sensitizing dye can be added prior to the completion of silver halide grain precipitation to thereby initiate the spectral sensitization as described in JP-A-58-113928. Further, the above sensitizing dye can be divided prior to addition, that is, part of the sensitizing dye can be added prior to the chemical sensitization with the rest of the sensitizing dye added after the chemical sensitization as taught in U.S. Pat. No. 4,225,666. Still further, the spectral sensitizing dye can be added at any stage during the formation of silver halide grains according to the method disclosed in U.S. Pat. No. 4,183,756 and other methods.

In the addition of a plurality of sensitizing dyes, the optimum addition method can be selected, depending on the selected type of sensitizing dye and desired spectral sensitivity, from among various methods such as the method in which individual sensitizing dyes are separately added with intervals, the method in which the sensitizing dyes are mixed together and added and the method in which part of a sensitizing dye is added in advance and the rest thereof is mixed with the other sensitizing dyes and added.

Although the sensitizing dye can be used in an amount of $4\times10^{-6}$ to $8\times10^{-3}$ mol per mol of silver halide contained in the addition layer, the use thereof in an amount of about $5\times10^{-5}$ to $2\times10^{-3}$ mol per mol of silver halide is more effective when the size of silver halide grains is in the preferred range of 0.2 to 1.2 $\mu$m.

The silver halide grains for use in the present invention preferably have a twin face spacing of 0.017 $\mu$m or less, more preferably 0.007 to 0.017 $\mu$m, and especially preferably 0.007 to 0.015 $\mu$m.

The fogging during aging of the silver halide emulsion for use in the present invention can be improved by adding and dissolving a previously prepared silver iodobromide emulsion at the time of chemical sensitization. Although the timing of the addition is arbitrary as long as it is performed during chemical sensitization, it is preferred that the silver iodobromide emulsion be first added and dissolved and, thereafter, a sensitizing dye and a chemical sensitizer be added in this order. The employed silver iodobromide emulsion has an iodine content lower than the surface iodine content of host grains, which is preferably a pure silver bromide emulsion. This silver iodobromide emulsion, although the size thereof is not limited as long as it is completely dissolvable, preferably has an equivalent spherical diameter of 0.1 $\mu$m or less, more preferably 0.05 $\mu$m or less. Although the addition amount of silver iodobromide emulsion depends on employed host grains, basically, it preferably ranges from 0.005 to 5 mol %, more preferably from 0.1 to 1 mol %, based on the mole of silver.

The emulsion for use in the present invention is preferably doped with hexacyanoiron (II) complex or hexacyanoruthenium complex (hereinafter also referred to simply as "metal complex"). The addition amount of the metal complex is preferably in the range of $10^{-7}$ to $10^{-3}$ mol per mol of silver halide, more preferably $1.0\times10^{-5}$ to $5\times10^{-4}$ mol per mol of silver halide.

The addition and incorporation of the metal complex for use in the present invention may be performed at any stage through the process of preparing silver halide grains which consists of nucleation, growth, physical ripening and chemical sensitization. Also, the addition and incorporation may be performed in some divisions. However, it is preferred that at least 50% of the total content of metal complex contained in each silver halide grain be contained in a layer underlying the outermost surface of silver halide grain where ½ or less of the silver content from the surface is present. The layer containing the metal complex may be overlaid with a layer which does not contain any metal complex.

The incorporation of the above metal complex is preferably accomplished by dissolving the metal complex in water or a suitable solvent and directly adding the solution to the reaction mixture during the formation of silver halide grains, or by adding the metal complex solution to the aqueous solution of halide, aqueous solution of silver salt or other solution for preparation of silver halide grains and thereafter conducting grain formation. Alternatively, the incorporation of metal complex is also preferably accomplished by adding silver halide grains in which the metal complex has been introduced in advance, dissolving them and depositing them on other silver halide grains.

With respect to the hydrogen ion concentration of the reaction mixture to which the metal complex is added, the pH value is preferably in the range of 1 to 10, more preferably 3 to 7.

In the lightsensitive material of the present invention, it is only required that at least one red-sensitive, at least one green-sensitive and at least one blue-sensitive lightsensitive layer be formed on a support. A typical example thereof is a silver halide photographic lightsensitive material having, on its support, at least one lightsensitive layer constituted by a plurality of silver halide emulsion layers which have substantially the same color sensitivity but have different speeds. Each of the lightsensitive layers is a unit lightsensitive layer which is sensitive to any of blue light, green light and red light. In a multilayered silver halide color photographic lightsensitive material, these unit lightsensitive layers are generally arranged in the order of red-, green- and blue-sensitive layers from a support side. However, according to the intended use, this arrangement order may be reversed, or an arrangement order can be employed in which a different lightsensitive layer is interposed between the layers of the same color sensitivity. Nonlightsensitive layers can be formed between the silver halide lightsensitive layers and as the uppermost layer and the lowermost layer. These may contain, e.g., couplers, DIR compounds and color mixing inhibitors described later. As a plurality of silver halide emulsion layers constituting each unit lightsensitive layer, a two-layered structure of high- and low-speed emulsion layers is preferably arranged so that the sensitivity is sequentially decreased toward a support as described in DE No. 1,121,470 or GB No. 923,045, the disclosures of which are incorporated herein by reference. Also, as described in JP-A's-57-112751, 62-200350, 62-206541 and 62-206543, the disclosures of which are incorporated herein by reference, layers can be arranged so that a low-speed emulsion layer is formed on a side apart from a support while a high-speed emulsion layer is formed on a side close to the support.

Specifically, layers can be arranged, from the farthest side from a support, in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, the disclosure of which is incorporated herewith by reference, layers can be arranged, from the farthest side from a support, in the order of blue-sensitive layer/GH/RH/GL/RL. Furthermore, as described in JP-A's-56-25738 and 62-63936, the disclosures of which are incorporated herein by reference, layers can be arranged, from the farthest side from a support, in the order of blue-sensitive layer/GL/RL/GH/RH.

As described in JP-B-49-15495, the disclosures of which are incorporated herein by reference, three layers can be arranged so that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged so that the sensitivity is sequentially decreased toward the support. Even when a layer structure is constituted by three layers having different sensitivities as mentioned above, these layers can be arranged in the order of medium-speed emulsion layer/high-speed emulsion layer/low-speed emulsion layer from the farthest side from a support in a layer sensitive to one color as described in JP-A-59-202464 the disclosures of which are incorporated herein by reference.

In addition, the order of high-speed emulsion layer/low-speed emulsion layer/medium-speed emulsion layer or low-speed emulsion layer/medium-speed emulsion layer/high-speed emulsion layer can be adopted.

Furthermore, the arrangement can be changed as described above even when four or more layers are formed.

In the silver halide photographic lightsensitive material of the present invention, it is preferred that the respective spectral sensitivities $S_R(580)$ and $S_G(580)$ of the red-sensitive layer and green-sensitive layer simultaneously satisfy the below given relationships. The $S_G(580)$ and $S_R(580)$ are defined as the respective logarithms of inverse number of exposure required for obtaining densities of magenta color minimum density and cyan color minimum density, respectively, plus 0.1 at the respective wavelengths. The $S_G(\max)$ and $S_R(\max)$ refers to the sensitivities at highest sensitivity wavelength of the green-sensitive layer and red-sensitive layer, respectively. It is preferred that the spectral sensitivity do not change from underexposure portion through overexposure portion.

$$0.4 \leqq S_R(\max) - S_R(580) \leqq 1.1,$$

$$0.3 \leqq S_G(\max) - S_G(580) \leqq 1.0.$$

The wavelength at which the red-sensitive layer exhibits the highest sensitivity is in the range of 610 to 640 nm, preferably 620 to 640 nm. Furthermore, it is desired that the spectral sensitivity at 650 nm of the red-sensitive layer $S_R(650)$ satisfy the following relationship:

$$S_R(650) \leqq S_R(\max) - 0.1,$$

wherein the definition of the spectral sensitivity is as mentioned above.

The wavelength at which the green-sensitive layer exhibits the highest sensitivity is in the range of 520 to 580 nm, preferably 540 to 565 nm. Furthermore, it is desirable that the spectral sensitivity at 525 nm of the green-sensitive layer $S_G(525)$ satisfy the following relationship:

$$0.1 \leqq S_G(\max) - S_G(525) \leqq 0.5.$$

It is preferable to utilize an interlayer inhibitory effect as means for improving a color reproduction. It is especially preferred that the weight-average wavelength of spectral sensitivity distribution of the green-sensitive silver halide emulsion layer ($\lambda_G$) satisfy the relationship: 520 nm$<\lambda_G \leqq$580 nm; the weight-average wavelength of spectral sensitivity distribution of magnitude of interlayer effect exerted on the red-sensitive silver halide emulsion layer from other silver halide emulsion layers at 500 nm to 600 nm ($\lambda_{-R}$) satisfy the relationship: 500 nm$<\lambda_{-R}<$560 nm; and $\lambda_G-\lambda_{-R}$ is at least 5 nm, preferably at least 10 nm.

For imparting the above interlayer effect to the red-sensitive layer in a specified wavelength region, it is preferred to dispose a separate interlayer effect donor layer containing silver halide grains, subjected to given spectral sensitization. For realizing the spectral sensitivity desired in the present invention, the interlayer sensitivity wavelength of the interlayer effect donor layer is set at 510 to 540 nm.

The weight-average wavelength of wavelength distribution of magnitude of interlayer effect exerted on the red-sensitive silver halide emulsion layer at 500 nm to 600 nm from other silver halide emulsion layers ($\lambda_{-R}$) can be determined by the method described in JP-A-61-34541.

Compounds which react with developing agent oxidation products obtained by development to thereby release a development inhibitor or a precursor thereof are used as the material for exerting the interlayer effect. For example, use can be made of DIR (development inhibitor-releasing type) couplers, DIR-hydroquinone and couplers capable of releasing DIR-hydroquinone or a precursor thereof. When the development inhibitor has a high diffusivity, the development inhibiting effect can be exerted irrespective of the position of the donor layer in the interlayered multilayer structure. However, there also occurs a development inhibiting effect in nonintended directions. Therefore, for correcting this, it is preferred that the donor layer be colored (for example, coloring is made in the same color as that of the layer on which undesirable development inhibitor effect is exerted). From the viewpoint that the lightsensitive material of the present invention obtains desirable spectral sensitivity, it is preferred that the donor layer capable of exerting the interlayer effect realize magenta coloring.

Although, for example, the size and configuration of silver halide grains for use in the layer capable of exerting an interlayer effect on the red-sensitive layer are not particularly limited, it is preferred to use so-called tabular grains of high aspect ratio, a monodisperse emulsion having uniform grain size, or silver iodobromide grains having a layered structure of iodide. Further, for extending an exposure latitude, it is preferred to mix a plurality of emulsions whose grain sizes are different from each other.

Although the donor layer capable of exerting the interlayer effect on the red-sensitive layer may be provided by coating on any position on the support, it is preferred that the donor layer be provided by coating at a position which is closer to the support than the blue-sensitive layer and which is more remote from the support than the red-sensitive layer. It is further preferred that the donor layer be positioned closer to the support than the yellow filter layer.

It is more preferred that the donor layer capable of exerting the interlayer effect on the red-sensitive layer be provided at a position which is closer to the support than the green-sensitive layer and which is more remote from the support than the red-sensitive layer. The donor layer is most preferably arranged at a position neighboring to a side of the green-sensitive layer close to the support. The terminology "neighboring" used herein means that an intermediate layer or any other thing is not interposed therebetween.

There may be a plurality of layers capable of exerting the interlayer effect on the red-sensitive layer. These layers may be positioned so that they neighbor to each other or are apart from each other.

In the present invention, use can be made of solid disperse dyes described in JP-A-7-168311.

The emulsion for use in the lightsensitive material of the present invention may be any of the surface latent image type in which latent images are mainly formed in the surface, the internal latent image type in which latent images are formed in the internal portion of grains and the type in which latent images exist in both the surface and the internal portion of grains. However, it is requisite that the emulsion be a negative type. The emulsion of the internal latent image type may specifically be, for example, a core/shell internal-latent-image type emulsion described in JP-A-63-264740, whose productive process is described in JP-A-59-133542. The thickness of the shell of this emulsion, although varied depending on development processing, etc., is preferably in the range of 3 to 40 nm, more preferably 5 to 20 nm.

The silver halide emulsion is generally subjected to physical ripening, chemical sensitization and spectral sensitization before use. Additives employed in these steps are described in RD Nos. 17643, 18716 and 307105. Positions where the description is made are listed in the following table.

With respect to the lightsensitive material of the present invention, at least two emulsions which are different from each other in at least one of the characteristics, specifically the grain size, grain size distribution, halogen composition, grain configuration and sensitivity of lightsensitive silver halide emulsion, can be mixed together and used in one layer.

It is preferred that silver halide grains having a grain surface fogged as described in U.S. Pat. No. 4,082,553, silver halide grains having a grain internal portion fogged as described in U.S. Pat. No. 4,626,498 and JP-A-59-214852 and colloidal silver be used in lightsensitive silver halide emulsion layers and/or substantially nonlightsensitive hydrophilic colloid layers. The expression "silver halide grains having a grain surface or grain internal portion fogged" refers to silver halide grains which can be developed uniformly (nonimagewise) irrespective of the nonexposed or exposed zone of lightsensitive material. The process for producing the grains is described in U.S. Pat. No. 4,626,498 and JP-A-59-214852. The silver halides constituting internal nuclei of core/shell silver halide grains having a grain internal portion fogged may have different halogen composition. Any of silver chloride, silver chlorobromide, silver iodobromide and silver chloroiodobromide can be used as the silver halide having a grain surface or grain internal portion fogged. The average grain size of these fogged silver halide grains is preferably in the range of 0.01 to 0.75 $\mu$m, more preferably 0.05 to 0.6 $\mu$m. With respect to grain configuration, regular grains may be used and although a polydisperse emulsion can be used, monodispersity (at least 95% of the weight or number of silver halide grains have grain sizes falling within ±40% of the average grain size) is preferred.

In the present invention, it is preferred to use nonlightsensitive fine grain silver halide. The expression "nonlightsensitive fine grain silver halide" refers to silver halide fine grains which are not sensitive at the time of imagewise exposure for obtaining dye image and which are substantially not developed at the time of development processing thereof. Those not fogged in advance are preferred. The fine grain silver halide has a silver bromide content of 0 to 100 mol %, and, if necessary, may contain silver chloride and/or silver iodide. Preferably, silver iodide is contained in an amount of 0.5 to 10 mol %. The average grain size (average of equivalent circular diameter of projected area) of fine grain silver halide is preferably in the range of 0.01 to 0.5 μm, more preferably 0.02 to 0.2 μm.

The fine grain silver halide can be prepared by the same process as used in the preparation of common lightsensitive silver halide. It is not needed to optically sensitize the surface of silver halide grains. Further, a spectral sensitization thereof is also not needed. However, it is preferred to add known stabilizers such as triazole, azaindene, benzothiazolium and mercapto compounds and zinc compounds thereto prior to the addition thereof to a coating liquid. Colloidal silver can be contained in the fine grain silver halide containing layers.

The above various additives can be used in the lightsensitive material according to the present technology, to which other various additives can also be added in conformity with the object.

The additives are described in detail in Research Disclosure Item 17643 (December 1978), Item 18716 (November 1979) and Item 308119 (December 1989), the disclosures of which are incorporated herein by reference. A summary of the locations where they are described will be listed in the following table.

| | Types of additives | RD17643 | RD18716 | RD308119 |
|---|---|---|---|---|
| 1 | Chemical sensitizers | page 23 | page 648 right column | page 996 |
| 2 | Sensitivity-increasing agents | | page 648 right colurun | |
| 3 | Spectral sensitizers, super-sensitizers | pages 23–24 | page 648, right column to page 649, right column | page 996, right column to page 998, right column |
| 4 | Brighteners | page 24 | | page 998 right column |
| 5 | Antifoggants, stabilizers | pages 24–25 | page 649 right column | page 998, right column to page 1000, right column |
| 6 | Light absorbents, filter dyes, ultraviolet absorbents | pages 25–26 | page 649, right column to page 650, left column | page 1003, left column to page 1003, right column |
| 7 | Stain preventing agents | page 25, right column | page 650, left to right columns | page 1002, right column |
| 8 | Dye image stabilizers | page 25 | | page 1002, right column |
| 9 | Film hardeners | page 26 | page 651, left column | page 1004, right column page 1005, left column |
| 10 | Binders | page 26 | page 651, left column | page 1003, right column to page 1004, right column |
| 11 | Plasticizers, lubricants | page 27 | page 650, right column | page 1006, left to right columns |
| 12 | Coating aids, surfactants | pages 26–27 | page 650, right column | page 1005, left column to page 1006, left column |
| 13 | Antistatic agents | page 27 | page 650, right column | page 1006, right column |
| 14 | Matting agents | | | to page 1007, left column page 1008, left column to page 1009, left column. |

With respect to the photographic lightsensitive material of the present invention and the emulsion suitable for use in the photographic lightsensitive material and also with respect to layer arrangement and related techniques, silver halide emulsions, dye forming couplers, DIR couplers and other functional couplers, various additives and development processing which can be used in the photographic lightsensitive material, reference can be made to EP 0565096A1 (published on Oct. 13, 1993) and patents cited therein, the disclosures of which are incorporated herein by reference. Individual particulars and the locations where they are described will be listed below.

1. Layer arrangement: page 61 lines 23 to 35, page 61 line 41 to page 62 line14,
2. Interlayers: page 61 lines 36 to 40,
3. Interlayer effect imparting layers: page 62 lines 15 to 18,
4. Silver halide halogen compositions: page 62 lines 21 to 25,
5. Silver halide grain crystal habits: page 62 lines 26 to 30,
6. Silver halide grain sizes: page 62 lines 31 to 34,
7. Emulsion production methods: page 62 lines 35 to 40,
8. Silver halide grain size distributions: page 62 lines 41 to 42,
9. Tabular grains: page 62 lines 43 to 46,
10. Internal structures of grains: page 62 lines 47 to 53,
11. Latent image forming types of emulsions: page 62 line 54 to page 63 to line 5,
12. Physical ripening and chemical sensitization of emulsion: page 63 lines 6 to 9,
13. Emulsion mixing: page 63 lines 10 to 13,
14. Fogging emulsions: page 63 lines 14 to 31,
15. Nonlightsensitive emulsions: page 63 lines 32 to 43,
16. Silver coating amounts: page 63 lines 49 to 50,
17. Formaldehyde scavengers: page 64 lines 54 to 57,
18. Mercapto antifoggants: page 65 lines 1 to 2,
19. Fogging agent, etc.-releasing agents: page 65 lines 3 to 7,
20. Dyes: page 65, lines 7 to 10,
21. Color coupler summary: page 65 lines 11 to 13,
22. Yellow, magenta and cyan couplers: page 65 lines 14 to 25,
23. Polymer couplers: page 65 lines 26 to 28,
24. Diffusive dye forming couplers: page 65 lines 29 to 31,
25. Colored couplers: page 65 lines 32 to 38,
26. Functional coupler summary: page 65 lines 39 to 44,
27. Bleaching accelerator-releasing couplers: page 65 lines 45 to 48,
28. Development accelerator-releasing couplers: page 65 lines 49 to 53,
29. Other DIR couplers: page 65 line 54 to page 66 to line 4,
30. Method of dispersing couplers: page 66 lines 5 to 28,
31. Antiseptic and mildewproofing agents: page 66 lines 29 to 33,
32. Types of sensitive materials: page 66 lines 34 to 36,
33. Thickness of lightsensitive layer and swell speed: page 66 line 40 to page 67 line 1, 34. Back layers: page 67 lines 3 to 8,
35. Development processing summary: page 67 lines 9 to 11,
36. Developing solution and developing agents: page 67 lines 12 to 30,
37. Developing solution additives: page 67 lines 31 to 44,
38. Reversal processing: page 67 lines 45 to 56,
39. Processing solution open ratio: page 67 line 57 to page 68 line 12,
40. Development time: page 68 lines 13 to 15,
41. Bleach-fix, bleaching and fixing: page 68 line 16 to page 69 line 31,
42. Automatic processor: page 69 lines 32 to 40,
43. Washing, rinse and stabilization: page 69 line 41 to page 70 line 18,
44. Processing solution replenishment and recycling: page 70 lines 19 to 23,
45. Developing agent built-in sensitive material: page 70 lines 24 to 33,
46. Development processing temperature: page 70 lines 34 to 38, and
47. Application to film with lens: page 70 lines 39 to 41.

Moreover, preferred use can be made of a bleaching solution containing 2-pyridinecarboxylic acid or 2,6-pyridinedicarboxylic acid, a ferric salt such as ferric nitrate and a persulfate as described in EP No. 602,600. When this bleaching solution is used, it is preferred that the steps of stop and water washing be conducted between the steps of color development and bleaching. An organic acid such as acetic acid, succinic acid or maleic acid is preferably used as a stop solution. For pH adjustment and bleaching fog, it is preferred that the bleaching solution contains an organic acid such as acetic acid, succinic acid, maleic acid, glutaric acid or adipic acid in an amount of 0.1 to 2 mol/liter (hereinafter liter referred to as "L").

A magnetic recording layer usable in the present invention will be described below.

This magnetic recording layer is formed by coating the surface of a support with an aqueous or organic solvent-based coating solution which is prepared by dispersing magnetic grains in a binder.

As the magnetic grains, it is possible to use grains of, e.g., ferromagnetic iron oxide such as $\gamma$ $Fe_2O_3$, Co-deposited $\gamma Fe_2O_3$, Co-deposited magnetite, Co-containing magnetite, ferromagnetic chromium dioxide, a ferromagnetic metal, ferromagnetic alloy, Ba ferrite of a hexagonal system, Sr ferrite, Pb ferrite, and Ca ferrite. Co-deposited ferromagnetic iron oxide such as Co-deposited $\gamma Fe_2O_3$ is preferable. The grain can take the shape of any of, e.g., a needle, rice grain, sphere, cube, and plate. The specific area is preferably 20 $m^2/g$ or more, and more preferably 30 $m^2/g$ or more as $S_{BET}$. The saturation magnetization ($\sigma s$) of the ferromagnetic substance is preferably $3.0\times10^4$ to $3.0\times10^5$ A/m, and especially preferably $4.0\times10^4$ to $2.5\times10^5$ A/m. A surface treatment can be performed for the ferromagnetic grains by using silica and/or alumina or an organic material. Also, the surface of the ferromagnetic grain can be treated with a silane coupling agent or a titanium coupling agent as described in JP-A-6-161032. A ferromagnetic grain whose surface is coated with an inorganic or organic substance described in JP-A-4-259911 or JP-A-5-81652 can also be used.

As a binder used together with the magnetic grains, it is possible to use a thermoplastic resin described in JP-A-4-219569, thermosetting resin, radiation-curing resin, reactive resin, acidic, alkaline, or biodegradable polymer, natural polymer (e.g., a cellulose derivative and sugar derivative), and their mixtures. The Tg of the resin is −40° C. to 300° C., and its weight average molecular weight is 2,000 to 1,000,000. Examples are a vinyl-based copolymer, cellulose derivatives such as cellulosediacetate, cellulosetriacetate, celluloseacetatepropionate, celluloseacetatebutylate, and cellulosetripropionate, acrylic resin, and polyvinylacetal resin. Gelatin is also preferable. Cellulosedi(tri)acetate is particularly preferable. This binder can be hardened by the addition of an epoxy-, aziridine-, or isocyanate-based crosslinking agent. Examples of the isocyanate-based crosslinking agent are isocyanates such as tolylenediisocyanate, 4,4'-diphenylmethanediisocyanate, hexamethylenediisocyanate, and xylylenediisocyanate, reaction products of these isocyanates and polyalcohol (e.g., a reaction product of 3 mols of tolylenediisocyanate and 1 mol of trimethylolpropane), and polyisocyanate produced by condensation of any of these isocyanates. These examples are described in JP-A-6-59357.

As a method of dispersing the magnetic substance in the binder, as described in JP-A-6-35092, a kneader, pin type mill, and annular mill are preferably used singly or together. Dispersants described in JP-A-5-088283 and other known dispersants can be used. The thickness of the magnetic recording layer is 0.1 to 10 $\mu$m, preferably 0.2 to 5 $\mu$m, and more preferably 0.3 to 3 $\mu$m. The weight ratio of the magnetic grains to the binder is preferably 0.5:100 to 60:100, and more preferably 1:100 to 30:100. The coating amount of the magnetic grains is 0.005 to 3 $g/m^2$, preferably 0.01 to 2 $g/m^2$, and more preferably 0.02 to 0.5 $g/m^2$. The transmitting yellow density of the magnetic recording layer is preferably 0.01 to 0.50, more preferably 0.03 to 0.20, and especially preferably 0.04 to 0.15. The magnetic recording layer can be formed in the whole area of, or into the shape of stripes on, the back surface of a photographic support by coating or printing. As a method of coating the magnetic recording layer, it is possible to use any of an air doctor, blade, air knife, squeegee, impregnation, reverse roll, transfer roll, gravure, kiss, cast, spray, dip, bar, and extrusion. A coating solution described in JP-A-5-341436 is preferable.

The magnetic recording layer can be given a lubricating property improving function, curling adjusting function, antistatic function, adhesion preventing function, and head polishing function. Alternatively, another functional layer can be formed and these functions can be given to that layer. A polishing agent in which at least one type of grains are aspherical inorganic grains having a Mohs hardness of 5 or more is preferable. The composition of this aspherical inorganic grain is preferably an oxide such as aluminum oxide, chromium oxide, silicon dioxide, titanium dioxide, and silicon carbide, a carbide such as silicon carbide and titanium carbide, or a fine powder of diamond. The surfaces of the grains constituting these polishing agents can be treated with a silane coupling agent or titanium coupling agent. These grains can be added to the magnetic recording layer or overcoated (as, e.g., a protective layer or lubricant layer) on the magnetic recording layer. A binder used together with the grains can be any of those described above and is preferably the same binder as in the magnetic recording layer. Sensitive materials having the magnetic recording layer are described in U.S. Pat. Nos 5,336,589, 5,250,404, 5,229,259, 5,215,874, and EP466,130.

A polyester support used in the present invention will be described below. Details of the polyester support and sensitive materials, processing, cartridges, and examples (to be described later) are described in Journal of Technical Disclosure No. 94-6023 (JIII; Mar. 15, 1994). Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferable. Polyethylene-2,6-naphthalate is especially preferable among other polymers. The average molecular weight ranges between about 5,000 and 200,000. The Tg of the polyester of the present invention is 50° C. or higher, preferably 90° C. or higher.

To give the polyester support a resistance to curling, the polyester support is heat-treated at a temperature of 40° C. to less than Tg, more preferably Tg −20° C. to less than Tg. The heat treatment can be performed at a fixed temperature within this range or can be performed together with cooling. The heat treatment time is 0.1 to 1500 hrs, more preferably 0.5 to 200 hrs. The heat treatment can be performed for a roll-like support or while a support is conveyed in the form of a web. The surface shape can also be improved by roughening the surface (e.g., coating the surface with conductive inorganic fine grains such as $SnO_2$ or $Sb_2O_5$). It is desirable to knurl and slightly raise the end portion, thereby preventing the cut portion of the core from being photographed. These heat treatments can be performed in any stage after support film formation, after surface treatment, after back layer coating (e.g., an antistatic agent or lubricating agent), and after undercoating. A preferable timing is after the antistatic agent is coated.

An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the sensitive material constituting layers. Examples of the surface treatment are surface activation treatments such as a chemical treatment, mechanical treatment, corona discharge treatment, flame treatment, ultraviolet treatment, high-frequency treatment, glow discharge treatment, active plasma treatment, laser treatment, mixed acid treatment, and ozone oxidation treatment. Among other surface treatments, the ultraviolet radiation treatment, flame treatment, corona treatment, and glow treatment are preferable.

An undercoating layer can include a single layer or two or more layers. Examples of an undercoating layer binder are copolymers formed by using, as a starting material, a monomer selected from vinylchloride, vinylidenechloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of a compound which swells a support. Examples of a gelatin hardener added to the undercoating layer are chromium salt (e.g., chromium alum), aldehydes (e.g., formaldehyde and glutaraldehyde), isocyanates, an active halogen compound (e.g., 2,4-dichloro-6-hydroxy-s-triazine), epichlorohydrin resin, and active vinylsulfone compound. $SiO_2$, $TiO_2$, inorganic fine grains, or polymethylmethacrylate copolymer fine grains (0.01 to 10 μm) can also be contained as a matting agent.

In the present invention, an antistatic agent is preferably used. Examples of this antistatic agent are carboxylic acid, carboxylate, a macromolecule containing sulfonate, cationic macromolecule, and ionic surfactant compound.

As the antistatic agent, it is especially preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, and having a volume resistivity of $10^7$ Ω.cm or less, more preferably $10^5$ Ω.cm or less and a grain size of 0.001 to 1.0 μm, fine grains of composite oxides (e.g., Sb, P, B, In, S, Si, and C) of these metal oxides, fine grains of sol metal oxides, or fine grains of composite oxides of these sol metal oxides.

The content in a sensitive material is preferably 5 to 500 $mg/m^2$, and especially preferably 10 to 350 $mg/m^2$. The ratio of a conductive crystalline oxide or its composite oxide to the binder is preferably 1/300 to 100/1, and more preferably 1/100 to 100/5.

A sensitive material of the present invention preferably has a slip property. Slip agent-containing layers are preferably formed on the surfaces of both a sensitive layer and back layer. A preferable slip property is 0.01 to 0.25 as a coefficient of kinetic friction. This represents a value obtained when a stainless steel sphere 5 mm in diameter is conveyed at a speed of 60 cm/min (25° C., 60%RH). In this evaluation, a value of nearly the same level is obtained when the surface of a sensitive layer is used as a sample to be measured.

Examples of a slip agent usable in the present invention are polyorganocyloxane, higher fatty acid amide, higher fatty acid metal salt, and ester of higher fatty acid and higher alcohol. As the polyorganocyloxane, it is possible to use, e.g., polydimethylcyloxane, polydiethylcyloxane, polystyrylmethylcyloxane, or polymethylphenylcyloxane. A layer to which the slip agent is added is preferably the outermost emulsion layer or back layer. Polydimethylcyloxane or ester having a long-chain alkyl group is particularly preferable.

A sensitive material of the present invention preferably contains a matting agent. This matting agent can be added to either the emulsion surface or back surface and is especially preferably added to the outermost emulsion layer. The matting agent can be either soluble or insoluble in processing solutions, and the use of both types of matting agents is preferable. Preferable examples are polymethylmethacrylate grains, poly(methylmethacrylate/methacrylic acid=9/1 or 5/5 (molar ratio)) grains, and polystyrene grains. The grain size is preferably 0.8 to 10 μm, and a narrow grain size distribution is preferable. It is preferable that 90% or more of all grains have grain sizes 0.9 to 1.1 times the average grain size. To increase the matting property, it is preferable to simultaneously add fine grains with a grain size of 0.8 μm or smaller. Examples are polymethylmethacrylate grains (0.2 μm), poly(methylmethacrylate/methacrylic acid=9/1 (molar ratio, 0.3 μm) grains, polystyrene grains (0.25 μm), and colloidal silica grains (0.03 μm).

A film cartridge used in the present invention will be described below. The principal material of the cartridge used in the present invention can be a metal or synthetic plastic.

Preferable plastic materials are polystyrene, polyethylene, polypropylene, and polyphenylether. The cartridge of the present invention can also contain various antistatic agents. For this purpose, carbon black, metal oxide grains, nonion-, anion-, cation-, and betaine-based surfactants, or a polymer can be preferably used. These cartridges subjected to the antistatic treatment are described in JP-A-1-312537 and JP-A-1-312538. It is particularly preferable that the resistance be $10^{12}$ Ω or less at 25° C. and 25%RH. Commonly, plastic cartridges are manufactured by using plastic into which carbon black or a pigment is incorporated in order to give a light-shielding property. The cartridge size can be a presently available 135 size. To miniaturize cameras, it is effective to decrease the diameter of a 25-mm cartridge of 135 size to 22 mm or less. The volume of a cartridge case is 30 $cm^3$ or less, preferably 25 $cm^3$ or less. The weight of plastic used in the cartridge and the cartridge case is preferably 5 to 15 g.

Furthermore, a cartridge which feeds a film by rotating a spool can be used in the present invention. It is also possible to use a structure in which a film leader is housed in a cartridge main body and fed through a port of the cartridge to the outside by rotating a spool shaft in the film feed direction. These structures are disclosed in U.S. Pat. Nos. 4,834,306 and 5,226,613. Photographic films used in the present invention can be so-called raw films before being developed or developed photographic films. Also, raw and developed photographic films can be accommodated in the same new cartridge or in different cartridges.

A color photographic lightsensitive material of the present invention is also suitably used as a negative film for an advanced photo system (to be referred to as an APS hereinafter). Examples are NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as the Fuji Film EPION Series represented by the EPION 300Z.

A color light sensitive film of the present invention is also suited as a film with lens such as Fuji Film FUJICOLOR UTSURUNDESU (Quick Snap) SUPER SLIM or UTSURUNNDESU ACE 800.

A photographed film is printed through the following steps in a miniature laboratory system.

(1) Reception (an exposed cartridge film is received from a customer)
(2) Detaching step (the film is transferred from the cartridge to an intermediate cartridge for development)
(3) Film development
(4) Reattaching step (the developed negative film is returned to the original cartridge)
(5) Printing (prints of three types C, H, and P and an index print are continuously automatically printed on color paper [preferably Fuji Film SUPER FA8])
(6) Collation and shipment (the cartridge and the index print are collated by an ID number and shipped together with the prints)

As these systems, the Fuji Film MINILABO CHAMPION SUPER FA-298, FA-278, FA-258, FA-238 and fuji Film DIGITALLABO SYSTEM, FRONTIER are preferable. Examples of a film processor for the MINILABO CHAMPION are the FP922AL/FP562B/FP562B, AL/FP362B/FP362BL AL and a recommended processing chemical is the FUJICOLOR JUST-IT CN-16L and CN-16Q. Examples of a printer processor are the PP3008AR/PP3008A/PP1828AR/PP1828A/PP1258AR/PP1258A/PP728AR/PP728A, and a recommended processing chemical is the FUJICOLOR JUST-IT CP-47L and CP-40FAII. In the FRONTIER SYSTEM, SCANNER & IMAGE-PROCESSOR SP-1000 and LASER PRINTER & PAPER PROCESSOR LP-1000P, or LASER PRINTER LP-1000W are used. A detacher used in the detaching step and a reattacher used in the reattaching step are preferably the Fuji Film DT200 or DT100 and AT200 or AT100, respectively.

The APS can also be enjoyed by PHOTO JOY SYSTEM whose main component is the Fuji Film Aladdin 1000 digital image scanner. For example, a developed APS cartridge film is directly loaded into the Aladdin 1000, or image information of a negative film, positive film, or print is input to the Aladdin 1000 by using the FE-550 35-mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film Photo Player AP-1. Image information can also be continuously input to a personal computer by loading a developed APS cartridge film into the Fuji Film Photo Scanner AS-1. The Fuji Film Photo Vision FV-10 or FV-5 can be used to input a film, print, or three-dimensional object. Furthermore, image information recorded in a floppy disk, Zip disk, CD-R, or hard disk can be variously processed on a computer by using the Fuji Film Photo Factory application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferable.

EXAMPLE

Examples of the present invention will be described below, which, however, in no way limit the scope of the present invention.

Example 1

Silver halide emulsions Em-A to Em-O were prepared by the following processes.

(Preparation of Em-A)

1200 mL of an aqueous solution containing 1.0 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 6 g of KBr was added and heated to 75° C., and the mixture was ripened. After the completion of ripening, 35 g of succinated gelatin was added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 $\mu$m (grain size) AgI fine grain emulsion was simultaneously added while conducting a flow rate increase so that the silver iodide content was 3.8 mol %, and the silver potential was maintained at −25 mV. Still further, an aqueous solution of KBr and 132 mL of an aqueous solution containing 35 g of $AgNO_3$ were added by the double jet method over a period of 7 min. The addition of the aqueous solution of KBr was regulated so that the potential at the completion of the addition was −20 mV. The temperature was regulated to 40° C., and 5.6 g, in terms of KI, of the following compound 1 was added. Further, 64 mL of a 0.8 M aqueous sodium sulfite solution was added. Still further, an aqueous solution of NaOH was added to thereby increase the pH to 9.0, and held undisturbed for 4 min so that iodide ions were rapidly formed. The pH was returned to 5.5 and the temperature to 55° C., and 1 mg of sodium benzenethiosulfonate was added. Further, 13 g of lime-processed gelatin having a calcium concentration of 1 ppm was added. After the completion of the addition, an aqueous solution of KBr and 250 mL of an aqueous solution containing 70 g of $AgNO_3$ were added over a period of 20 min while maintaining the potential at 60 mV. During this period, yellow prussiate was added in an amount of $1.0\times10^{-5}$ mol per mol of silver. The mixture was washed with water, and 80 g of lime-processed gelatin having a calcium concentration of 1 ppm was added. The pH and pAg were adjusted at 40° C. to 5.8 and 8.7, respectively.

Compound 1

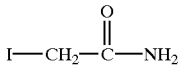

The calcium, magnesium and strontium contents of the thus obtained emulsion were measured by ICP emission spectrochemical analysis. The contents thereof were 15, 2 and 1 ppm, respectively.

The emulsion was heated to 56° C. First, 1 g, in terms of Ag, of an emulsion of 0.05 $\mu$m (grain size) pure AgBr fine grains was added to thereby effect shell covering. Subsequently, the following sensitizing dyes 1, 2 and 3 in the form of solid fine dispersion were added in respective amounts of $5.85\times10^{-4}$ mol, $3.06\times10^{-4}$ mol and $9.00\times10^{-6}$ mol per mol of silver. The solid fine dispersions of sensitizing dyes 1, 2 and 3 were prepared in the following manner. Under the preparative conditions specified in Table 2, inorganic salts were dissolved in ion-exchanged water, and the sensitizing dye was added. The sensitizing dye was dispersed at 60° C. for 20 min under agitation at 2000 rpm by means of a dissolver blade. Thus, the solid fine dispersions of sensitizing dyes 1, 2 and 3 were obtained. When, after the addition of the sensitizing dyes, the sensitizing dye adsorption reached 90% of the equilibrium-state adsorption, calcium nitrate was added so that the calcium concentration became 250 ppm. The adsorption amount of sensitizing dye was determined by separating the mixture into a solid layer and a liquid layer (supernatant) by centrifugal precipitation and measuring the difference between the amount of initially added sensitizing dye and the amount of sensitizing dye present in the supernatant to thereby calculate the amount of adsorbed sensitizing dye. After the addition of calcium nitrate, potassium thiocyanate, chloroauric acid, sodium thiosulfate, N,N-dimethylselenourea and compound 4 were added to thereby effect the optimum chemical sensitization. N,N-dimethylselenourea was added in an amount of $3.40\times10^{-6}$ mol per mol of silver. Upon the completion of the chemical sensitization, the following compounds 2 and 3 were added to thereby obtain emulsion Em-A.

TABLE 2

| Sensitizing dye | Amount of the sensitizing dye (parts by weight) | $NaNO_3/Na_2SO_4$ (parts by weight) | Water (parts by weight) | Dispersing time | Dispersing temperature |
|---|---|---|---|---|---|
| 1 | 3 | 0.8/3.2 | 43 | 20 min | 60° C. |
| 2/3 | 4/0.12 | 0.6/2.4 | 42.8 | 20 min | 60° C. |

Sensitizing dye 1

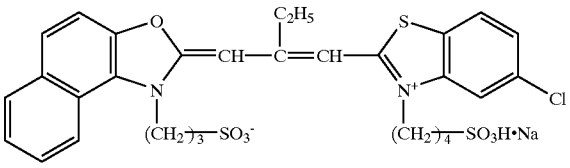

Sensitizing dye 2

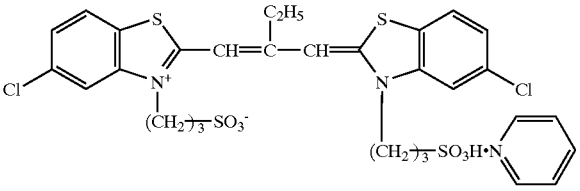

Sensitizing dye 3

TABLE 2-continued

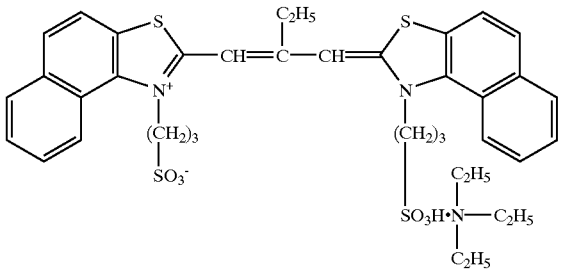

Compound 2

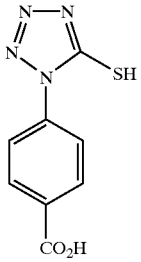

Compound 3

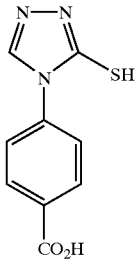

Compound 4

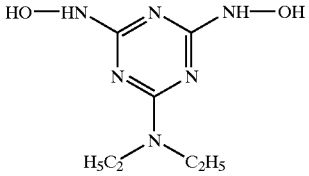

(Preparation of Em-B)

Emulsion Em-B was prepared in the same manner as the emulsion Em-A, except that the amount of KBr added after nucleation was changed to 5 g, that the succinated gelatin was changed to a trimellitated gelatin whose trimellitation ratio is 98%, the gelatin containing methionine in an amount of 35 $\mu$mol per g and having a molecular weight of 100,000, that the compound 1 was changed to the following compound 6 whose addition amount in terms of KI was 8.0 g, that the amounts of sensitizing dyes 1, 2 and 3 added prior to the chemical sensitization were changed to $6.50\times10^{-4}$ mol, $3.40\times10^{-4}$ mol and $1.00\times10^{-5}$ mol, respectively, and that the amount of N,N-dimethylselenourea added at the time of chemical sensitization was changed to $4.00\times10^{-6}$ mol.

Compound 6

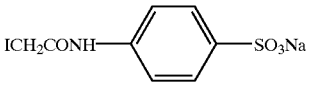

(Preparation of Em-C)

Emulsion Em-C was prepared in the same manner as the emulsion Em-A, except that the amount of KBr added after nucleation was changed to 1.5 g, that the succinated gelatin was changed to a phthalated gelatin whose phthalation ratio is 97%, the gelatin containing methionine in an amount of 35 $\mu$mol per g and having a molecular weight of 100,000, that the compound 1 was changed to the following compound 7 whose addition amount in terms of KI was 7.1 g, that the amounts of sensitizing dyes 1, 2 and 3 added prior to the chemical sensitization were changed to $7.80\times10^{-4}$ mol, $4.08\times10^{-4}$ mol and $1.20\times10^{-5}$ mol, respectively, and that the amount of N,N-dimethylselenourea added at the time of chemical sensitization was changed to $5.00\times10^{-6}$ mol.

Compound 7

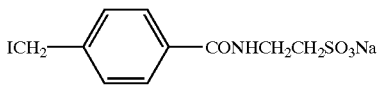

(Preparation of Em-E)

1200 mL of an aqueous solution containing 10 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 6 g of KBr was added and heated to 75° C., and the mixture was ripened. After the completion of ripening, 15 g of succinated gelatin and 20 g of the above gelatin trimellitate were added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 100 g of $AgNO_3$ and an aqueous solution of KBr were added by the double jet method over a period of 15 min while increasing the flow rate so that the final flow rate was 1.2 times the initial flow rate. During this period, a 0.03 $\mu$m (grain size) AgI fine grain emulsion was simultaneously added while conducting a flow rate increase so that the silver iodide content was 3.8 mol %, and the silver potential was maintained at −25 mV. Still further, an aqueous solution of KBr and 132 mL of an aqueous solution containing 35 g of $AgNO_3$ were added by the double jet method over a period of 7 min. The addition of the aqueous solution of KBr was regulated so that the potential at the completion of the addition was −20 mV. KBr was added so that the potential became −60 mV. Thereafter, 1 mg of sodium benzenethiosulfonate was added, and, further, 13 g of lime-processed gelatin having a calcium concentration of 1 ppm was added. After the completion of the addition, while continuously adding 8.0 g, in terms of KI, of AgI fine grain emulsion of 0.008 $\mu$m grain size (equivalent sphere diameter) (prepared by, just prior to addition, mixing together an aqueous solution of a low-molecular-weight gelatin whose molecular weight was 15,000, an aqueous solution of $AgNO_3$ and an aqueous solution of KI in a separate chamber furnished with a magnetic coupling induction type agitator as described in JP-A-10-43570), an aqueous solution of KBr and 250 mL of an aqueous solution containing 70 g of $AgNO_3$ were added over a period of 20 min with the potential maintained at −60 mV. During this period, yellow prussiate was added in an amount of $1.0\times10^{-5}$ mol per mol of silver. The mixture was washed with water, and 80 g of lime-processed gelatin having a calcium concentration of 1 ppm was added. The pH and pAg were adjusted at 40° C. to 5.8 and 8.7, respectively.

The calcium, magnesium and strontium contents of the thus obtained emulsion were measured by ICP emission spectrochemical analysis. The contents thereof were 15, 2 and 1 ppm, respectively.

The chemical sensitization was performed in the same manner as in the preparation of the emulsion Em-A, except that the sensitizing dyes 1, 2 and 3 were changed to the following sensitizing dyes 4, 5 and 6, respectively, whose addition amounts were $7.73\times10^{-4}$ mol, $1.65\times10^{-4}$ mol and $6.20\times10^{-5}$ mol, respectively. Thus, Emulsion Em-E was obtained.

Sensitizing dye 4

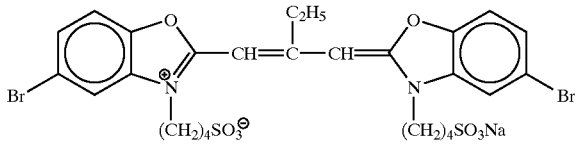

Sensitizing 5

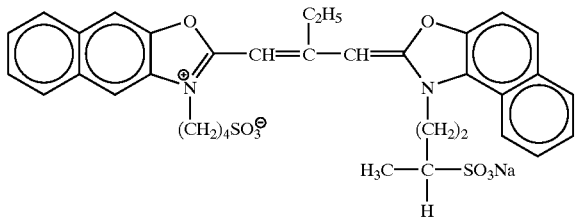

Sensitizing dye 6

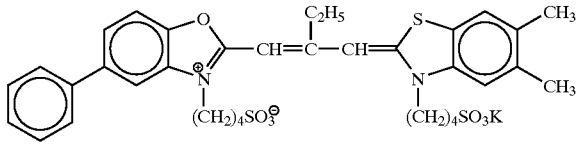

(Preparation of Em-F)

1200 mL of an aqueous solution containing 1.0 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 5 g of KBr was added and heated to 75° C., and the mixture was ripened. After the completion of ripening, 20 g of succinated gelatin and 15 g of phthalated gelatin were added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 $\mu$m (grain size) AgI fine grain emulsion was simultaneously added while conducting a flow rate increase so that the silver iodide content was 3.8 mol %, and the silver potential was maintained at −25 mV. Still further, an aqueous solution of KBr and 132 mL of an aqueous solution containing 35 g of $AgNO_3$ were added by the double jet method over a period of 7 min. An aqueous solution of KBr was added so as to regulate the potential to −60 mV. Thereafter, 9.2 g, in terms of KI, of a 0.03 $\mu$m (grain size) AgI fine grain emulsion was added. 1 mg of sodium benzenethiosulfonate was added, and, further, 13 g of lime-processed gelatin having a calcium concentration of 1 ppm was added. After the completion of the addition, an aqueous solution of KBr and 250 mL of an aqueous solution containing 70 g of $AgNO_3$ were added over a period of 20 min while maintaining the potential at 60 mV. During this period, yellow prussiate was added in an amount of $1.0\times10^{-5}$ mol per mol of silver. The mixture was washed with water, and 80 g of lime-processed gelatin having a calcium concentration of 1 ppm was added. The pH and pAg were adjusted at 40° C. to 5.8 and 8.7, respectively.

The calcium, magnesium and strontium contents of the thus obtained emulsion were measured by ICP emission spectrochemical analysis. The contents thereof were 15, 2 and 1 ppm, respectively.

The chemical sensitization was performed in the same manner as in the preparation of the emulsion Em-B, except that the sensitizing dyes 1, 2 and 3 were changed to the sensitizing dyes 4, 5 and 6, respectively, whose addition amounts were $8.50\times10^{-4}$ mol. $1.82\times10^{-4}$ mol and $6.82\times10^{-5}$ mol, respectively. Thus, Emulsion Em-F was obtained.

(Preparation of Em-G)

1200 mL of an aqueous solution containing 10 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 1.5 g of KBr was added and heated to 75° C., and the mixture was ripened. After the completion of ripening, 15 g of the above trimellitated gelatin and 20 g of the above phthalated gelatin were added. The pH was adjusted to 5.5. An aqueous solution of KBr and 150 mL of an aqueous solution containing 30 g of $AgNO_3$ were added by the double jet method over a period of 16 min. During this period, the silver potential was maintained at −25 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 μm (grain size) AgI fine grain emulsion was simultaneously added while conducting a flow rate increase so that the silver iodide content was 3.8 mol %, and the silver potential was maintained at −25 mV. Still further, an aqueous solution of KBr and 132 mL of an aqueous solution containing 35 g of $AgNO_3$ were added by the double jet method over a period of 7 min. The addition of the aqueous solution of KBr was regulated so that the potential became −60 mV. Thereafter, 7.1 g, in terms of KI, of a 0.03 μm (grain size) AgI fine grain emulsion was added. 1 mg of sodium benzenethiosulfonate was added, and, further, 13 g of lime-processed gelatin having a calcium concentration of 1 ppm was added. After the completion of the addition, an aqueous solution of KBr and 250 mL of an aqueous solution containing 70 g of $AgNO_3$ were added over a period of 20 min while maintaining the potential at 60 mV. During this period, yellow prussiate was added in an amount of $1.0\times10^{-5}$ mol per mol of silver. The mixture was washed with water, and 80 g of lime-processed gelatin having a calcium concentration of 1 ppm was added. The pH and pAg were adjusted at 40° C. to 5.8 and 8.7, respectively.

The calcium, magnesium and strontium contents of the thus obtained emulsion were measured by ICP emission spectrochemical analysis. The contents thereof were 15, 2 and 1 ppm, respectively.

The chemical sensitization was performed in the same manner as in the preparation of the emulsion Em-C, except that the sensitizing dyes 1, 2 and 3 were changed to the sensitizing dyes 4, 5 and 6, respectively, whose addition amounts were $1.00\times10^{-3}$ mol, $2.15\times10^{-4}$ mol and $8.06\times10^{-5}$ mol, respectively. Thus, Emulsion Em-G was obtained.

(Preparation of Em-J)

Emulsion Em-J was prepared in the same manner as the emulsion Em-B, except that the sensitizing dyes added prior to the chemical sensitization were changed to the following sensitizing dyes 7 and 8 whose addition amounts were $7.65\times10^{-4}$ mol and $2.74\times10^{-4}$ mol, respectively.

Sensitizing dye 7

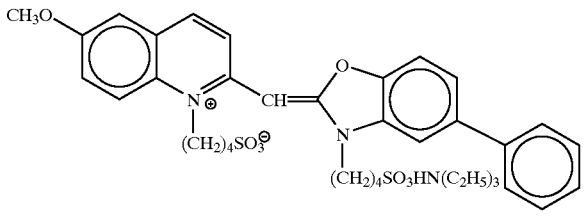

Sensitizing dye 8

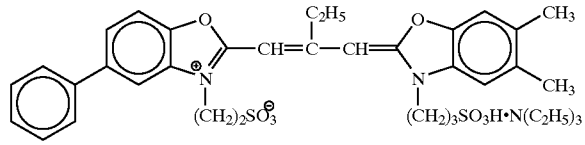

(Preparation of Em-L)

(Preparation of Silver Bromide Seed Crystal Emulsion)

A silver bromide tabular emulsion having an average equivalent sphere diameter of 0.6 μm and an aspect ratio of 9.0 and containing 1.16 mol of silver and 66 g of gelatin per kg of emulsion was prepared.

(Growth Step 1)

0.3 g of a modified silicone oil was added to 1250 g of an aqueous solution containing 1.2 g of potassium bromide and a succinated gelatin whose convertion ratio is 98%. The above silver bromide tabular emulsion was added in an amount containing 0.086 mol of silver and, while maintaining the temperature at 78° C., agitated. Further, an aqueous solution containing 18.1 g of silver nitrate and 5.4 mol, per added silver, of the above 0.037 μm silver iodide fine grains were added. During this period, also, an aqueous solution of potassium bromide was added by double jet while regulating the addition so that the pAg was 8.1.

(Growth Step 2)

2 mg of sodium benzenethiosulfonate was added, and thereafter 0.45 g of disodium salt of 3,5-disulfocatechol and 2.5 mg of thiourea dioxide were added.

Further, an aqueous solution containing 95.7 g of silver nitrate and an aqueous solution of potassium bromide were added by double jet while increasing the flow rate over a period of 66 min. During this period, 7.0 mol, per added silver, of the above 0.037 μm silver iodide fine grains were added. The amount of potassium bromide added by the double jet was regulated so that the pAg was 8.1. After the completion of the addition, 2 mg of sodium benzenethiosulfonate was added.

(Growth Step 3)

An aqueous solution containing 19.5 g of silver nitrate and an aqueous solution of potassium bromide were added by double jet over a period of 16 min. During this period, the amount of the aqueous solution of potassium bromide was regulated so that the pAg was 7.9.

(Addition of Sparingly Soluble Silver Halide Emulsion 4)

The above host grains were adjusted to 9.3 in pAg with the use of an aqueous solution of potassium bromide. Thereafter, 25 g of the above 0.037 μm silver iodide fine grain emulsion was rapidly added within a period of 20 sec.

(Formation of Outermost Shell Layer 5)

Further, an aqueous solution containing 34.9 g of silver nitrate was added over a period of 22 min.

The obtained emulsion consisted of tabular grains having an average aspect ratio of 9.8 and an average equivalent sphere diameter of 1.4 μm, wherein the average silver iodide content was 5.5 mol %.

(Chemical Sensitization)

The emulsion was washed, and a succinated gelatin whose succinated ratio was 98% and calcium nitrate were added. At 40° C., the pH and pAg were adjusted to 5.8 and 8.7, respectively. The temperature was raised to 60° C., and $5\times10^{-3}$ mol of 0.07 μm silver bromide fine grain emulsion was added. 20 min later, the following sensitizing dyes 9, 10 and 11 were added. Thereafter, potassium thiocyanate, chloroauric acid, sodium thiosulfate, N,N-dimethylselenourea and compound 4 were added to thereby effect the optimum chemical sensitization. Compound 3 was added 20 min before the completion of the chemical sensitization, and compound 5 was added at the completion of the chemical sensitization. The terminology "optimum chemical sensitization" used herein means that the sensitizing dyes and compounds are added in an amount selected from among the range of $10^{-1}$ to $10^{-8}$ mol per mol of silver halide so that the speed exhibited when exposure is conducted at 1/100 becomes the maximum.

Sensitizing dye 9

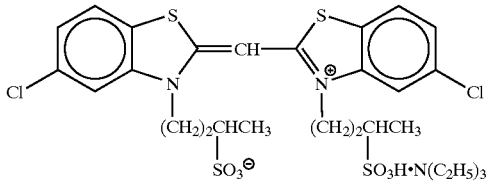

Sensitizing dye 10

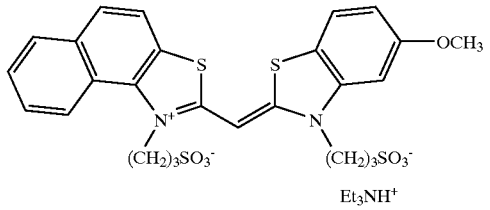

Sensitizing dye 11

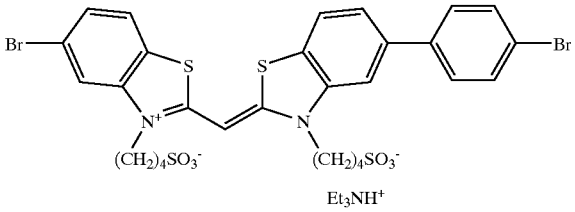

Compound 5

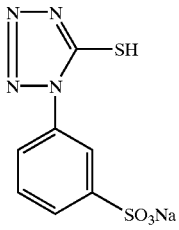

(Preparation of Em-O)

An aqueous solution of gelatin (1250 mL of distilled water, 48 g of deionized gelatin and 0.75 g of KBr) was placed in a reaction vessel equipped with an agitator. The temperature of the aqueous solution was maintained at 70° C. 276 mL of an aqueous solution of $AgNO_3$ (containing 12.0 g of $AgNO_3$) and an equimolar-concentration aqueous solution of KBr were added thereto by the controlled double jet addition method over a period of 7 min while maintaining the pAg at 7.26. The mixture was cooled to 68° C., and 7.6 mL of thiourea dioxide (0.05% by weight) was added.

Subsequently, 592.9 mL of an aqueous solution of $AgNO_3$ (containing 108.0 g of $AgNO_3$) and an equimolar-concentration aqueous solution of a mixture of KBr and KI (2.0 mol % KI) were added by the controlled double jet addition method over a period of 18 min 30 sec while maintaining the pAg at 7.30. Further, 18.0 mL of thiosulfonic acid (0.1% by weight) was added 5 min before the completion of the addition.

The obtained grains consisted of cubic grains having an equivalent sphere diameter of 0.19 μm and an average silver iodide content of 1.8 mol %.

The obtained emulsion Em-O was desalted and washed by the customary flocculation method, and re-dispersed. At 40° C., the pH and pAg were adjusted to 6.2 and 7.6, respectively.

The resultant emulsion Em-O was subjected to the following spectral and chemical sensitization.

Based on silver, $3.37\times10^{-4}$ mol/mol of each of sensitizing dyes 10, 11 and 12, $8.82\times10^{-4}$ mol/mol of KBr, $8.83\times10^{-4}$ mol/mol of sodium thiosulfate, $5.95\times10^{-4}$ mol/mol of water-soluble potassium thiocyanate and $3.07\times10^{-5}$ mol/mol of potassium chloroaurate were added. Ripening thereof was performed at 68° C. for a period, which period was regulated so that the speed exhibited when exposure was conducted at 1/100 became the maximum.

Sensitizing dye 12

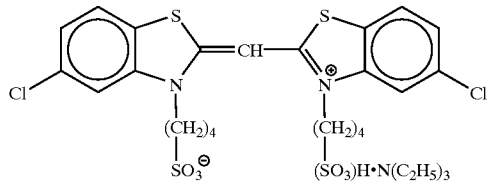

(Em-D, H, I, K, M, N)

In the preparation of tabular grains, a low-molecular-weight gelatin was used in conformity with Examples of JP-A-1-158426. Gold sensitization, sulfur sensitization and selenium sensitization were carried out in the presence of spectral sensitizing dye listed in Table 2 and sodium thiocyanate in conformity with Examples of EP No. 443453A. Emulsions D, H, I and K contained the optimum amount of Ir and Fe. For the emulsions M and N, reduction sensitization was carried out with the use of thiourea dioxide and thiosulfonic acid at the time of grain preparation in conformity with Examples of EP No. 348934A.

TABLE 3

| Emulsion | Sensitizing dye | Addition amount (mol/mol silver) |
|---|---|---|
| Em-D | Sensitizing dye 1 | $5.44\times10^{-4}$ |
| | Sensitizing dye 2 | $2.35\times10^{-4}$ |
| | Sensitizing dye 3 | $7.26\times10^{-6}$ |
| Em-H | Sensitizing dye 8 | $6.52\times10^{-4}$ |
| | Sensitizing dye 13 | $1.35\times10^{-4}$ |
| | Sensitizing dye 6 | $2.48\times10^{-5}$ |

TABLE 3-continued

| Emulsion | Sensitizing dye | Addition amount (mol/mol silver) |
|---|---|---|
| Em-I | Sensitizing dye 8 | $6.09 \times 10^{-4}$ |
| | Sensitizing dye 13 | $1.26 \times 10^{-4}$ |
| | Sensitizing dye 6 | $2.32 \times 10^{-5}$ |
| Em-K | Sensitizing dye 7 | $6.27 \times 10^{-4}$ |
| | Sensitizing dye 8 | $2.24 \times 10^{-4}$ |
| Em-M | Sensitizing dye 9 | $2.43 \times 10^{-4}$ |
| | Sensitizing dye 10 | $2.43 \times 10^{-4}$ |
| | Sensitizing dye 11 | $2.43 \times 10^{-4}$ |
| Em-N | Sensitizing dye 9 | $3.28 \times 10^{-4}$ |
| | Sensitizing dye 10 | $3.28 \times 10^{-4}$ |
| | Sensitizing dye 11 | $3.28 \times 10^{-4}$ |

Sensitizing dye 13

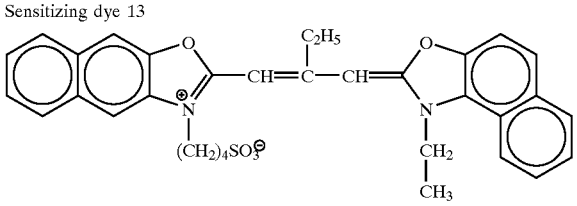

TABLE 4

| Emulsion | Average iodide content (mol %) | Equivalent-sphere diameter (μm) | Aspect ratio | Equivalent-circle diameter (μm) | Grain thickness (μm) | shape |
|---|---|---|---|---|---|---|
| A | 4 | 0.92 | 14 | 2 | 0.14 | Tabular |
| B | 5 | 0.8 | 12 | 1.6 | 0.13 | Tabular |
| C | 4.7 | 0.51 | 7 | 0.85 | 0.12 | Tabular |
| D | 3.9 | 0.37 | 2.7 | 0.4 | 0.15 | Tabular |
| E | 5 | 0.92 | 14 | 2 | 0.14 | Tabular |
| F | 5.5 | 0.8 | 12 | 1.6 | 0.13 | Tabular |
| G | 4.7 | 0.51 | 7 | 0.85 | 0.12 | Tabular |
| H | 3.7 | 0.49 | 3.2 | 0.58 | 0.18 | Tabular |
| I | 2.8 | 0.29 | 1.2 | 0.27 | 0.23 | Tabular |
| J | 5 | 0.8 | 12 | 1.6 | 0.13 | Tabular |
| K | 3.7 | 0.47 | 3 | 0.53 | 0.18 | Tabular |
| L | 5.5 | 1.4 | 9.8 | 2.6 | 0.27 | Tabular |
| M | 8.8 | 0.64 | 5.2 | 0.85 | 0.16 | Tabular |
| N | 3.7 | 0.37 | 4.6 | 0.55 | 0.12 | Tabular |
| O | 1.8 | 0.19 | — | — | — | Cubic |

Referring to Table 4, dislocation lines as described in EP No. 443453A were observed in the tabular grains when the observation was conducted through a high-voltage electron microscope.

1) Support

The support used in this Example was prepared as set forth below:

1) First Layer and Subbing Layer

Both major surfaces of a 90 μm thick polyethylene naphthalate support were treated with glow discharge under such conditions that the treating ambient pressure was 0.2 Torr, the $H_2O$ partial pressure of ambient gas 75%, the discharge frequency 30 kHz, the output 2500W, and the treating strength 0.5 kV.A.min/$m^2$. This support was coated, in a coating amount of 5 mL/$m^2$, with a coating liquid of the following composition to provide the 1st layer in accordance with the bar coating method described in U.S. Pat. No. 4,263,870, the disclosure of which is herein incorporated by reference.

| | |
|---|---|
| Conductive fine grain dispersion ($SnO_2/Sb_2O_5$ grain conc. 10% water dispersion, secondary agglomerate of 0.005 μm diam. primary grains which has an av. grain size of 0.05 μm) | 50 pts. wt. |
| Gelatin | 0.5 pt. wt. |
| Water | 49 pts. wt. |
| Polyglycerol polyglycidyl ether | 0.16 pt. wt. |
| Polyoxyethylene sorbitan monolaurate (polymn. degree 20) | 0.1 pt. wt. |

The support furnished with the first coating layer was wound round a stainless steel core of 20 cm diameter and heated at 110° C. (Tg of PEN support: 119° C.) for 48 hr to thereby effect heat history annealing. The other side of the support opposite to the first layer was coated, in a coating amount of 10 mL/$m^2$, with a coating liquid of the following composition to provide a subbing layer for emulsion in accordance with the bar coating method.

| | |
|---|---|
| Gelatin | 1.01 pts. wt. |
| Salicylic acid | 0.30 pt. wt. |
| Resorcin | 0.40 pt. wt. |
| Polyoxyethylene nonylphenyl ether (polymn. degree 10) | 0.11 pt. wt. |
| Water | 3.53 pts. wt. |
| Methanol | 84.57 pts. wt. |
| n-Propanol | 10.08 pts. wt. |

Furthermore, the following second layer and third layer were superimposed in this sequence on the first layer by coating. Finally, multilayer coating of a color negative lightsensitive material of the composition indicated below was coated on the opposite side. Thus, a transparent magnetic recording medium with silver halide emulsion layers was obtained.

2) Second Layer (Transparent Magnetic Recording Layer)

(1) Dispersion of Magnetic Substance 1100 parts by weight of Co-coated γ-$Fe_2O_3$ magnetic substance (average major axis length: 0.25 μm, $S_{BET}$: 39 $m^2$/g, Hc: 831 Oe, σs: 77.1 emu/g, and σr: 37.4 emu/g), 220 parts by weight of water and 165 parts by weight of silane coupling agent (3-(poly(polymerization Degree 10)oxyethyl)oxypropyltrimethoxysilane) were fed into an open kneader, and blended well for 3 hr. The resultant coarsely dispersed viscous liquid was dried at 70° C. round the clock to thereby remove water, and heated at 110° C. for 1 hr. Thus, surface treated magnetic grains were obtained.

Further, in accordance with the following formulation, a composition was prepared by blending by means of the open kneader once more for 4 hr:

| | |
|---|---|
| Above obtained surface treated magnetic grains | 855 g |
| Diacetylcellulose | 25.3 g |
| Methyl ethyl ketone | 136.3 g |
| Cyclohexanone | 136.3 g. |

Still further, in accordance with the following formulation, a composition was prepared by carrying out fine dispersion by means of a sand mill (¼G sand mill) at 2000 rpm for 4 hr. Glass beads of 1 mm diameter were used as medium.

| | |
|---|---|
| Above obtained blend liquid | 45 g |
| Diacetylcellulose | 23.7 g |
| Methyl ethyl ketone | 127.7 g |
| Cyclohexanone | 127.7 g. |

Moreover, in accordance with the following formulation, a magnetic substance containing intermediate liquid was prepared.

(2) Preparation of Magnetic Substance Containing Intermediate Liquid

| | |
|---|---|
| Above obtained fine dispersion of magnetic substance | 674 g |
| Diacetylcellulose soln. (solid content 4.34%, solvent: methyl ethyl ketone/cyclohexanone = 1/1) | 24,280 g |
| Cyclohexanone | 46 g. |

These were mixed together and agitated by means of a disperser to thereby obtain a "magnetic substance containing intermediate liquid".

An α-alumina abrasive dispersion of the present invention was produced in accordance with the following formulation.

(a) Preparation of Sumicorundum AA-1.5 (Average Primary Grain Diameter: 1.5 μm, Specific Surface Area: 1.3 $m^2/g$) Grain Dispersion

| | |
|---|---|
| Sumicorundum AA-1.5 | 152 g |
| Silane coupling agent KBM903 (produced by Shin-Etsu Silicone) | 0.48 g |
| Diacetylcellulose soln. (solid content 4.5%, solvent: methyl ethyl ketone/cyclohexanone = 1/1) | 227.52 g. |

In accordance with the above formulation, fine dispersion was carried out by means of a ceramic-coated sand mill (¼G sand mill) at 800 rpm for 4 hr. Zirconia beads of 1 mm diameter were used as medium.

(b) Colloidal Silica Grain Dispersion (Fine Grains)

Use was made of "MEK-ST" produced by Nissan Chemical Industries, Ltd.

This is a dispersion of colloidal silica of 0.015 μm average primary grain diameter in methyl ethyl ketone as a dispersion medium, wherein the solid content is 30%.

(3) Preparation of a Coating Liquid for Second Layer

| | |
|---|---|
| Thus obtained magnetic substance containing intermediate liquid | 19,053 g |
| Diacetylcellulose soln. (Solid content 4.5%, solvent: methyl ethyl ketone/cyclohexanone = 1/1) | 264 g |
| Colloidal silica dispersion "MEK-ST" (dispersion b, solid content: 30%) | 128 g |
| AA-1.5 dispersion (dispersion a) | 12 g |
| Millionate MR-400 (produced by Nippon Polyurethane) diluent (solid content 20%, dilution solvent: methyl ethyl ketone/cyclohexanone = 1/1) | 203 g |
| Methyl ethyl ketone | 170 g |
| Cyclohexanone | 170 g. |

A coating liquid obtained by mixing and agitating these was applied in a coating amount of 29.3 $mL/m^2$ with the use of a wire bar. Drying was performed at 110° C. The thickness of magnetic layer after drying was 1.0 μm.

3) Third layer (Higher Fatty Acid Ester Sliding Agent Containing Layer)

(1) Preparation of Raw Dispersion of Sliding Agent

The following liquid A was heated at 100° C. to thereby effect dissolution, added to liquid B and dispersed by means of a high-pressure homogenizer, thereby obtaining a raw dispersion of sliding agent.

| | |
|---|---|
| Liquid A | |
| Compd. of the formula: $C_6H_{13}CH(OH)(CH_2)_{10}COOC_{50}H_{101}$ | 399 pts. wt. |
| Compd. of the formula: n-$C_{50}H_{101}O(CH_2CH_2O)_{16}H$ | 171 pts. wt. |
| Cyclohexanone | 830 pts. wt. |
| Liquid B | |
| Cyclohexanone | 8600 pts. wt. |

(2) Preparation of Spherical Inorganic Grain Dispersion

Spherical inorganic grain dispersion (cl) was prepared in accordance with the following formulation.

| | |
|---|---|
| Isopropyl alcohol | 93.54 pts. wt. |
| Silane coupling agent KBM903 (produced by Shin-Etsu Silicone) Compd. 1-1: $(CH_3O)_3Si—(CH_2)_3—NH_2$) | 5.53 pts. wt. |
| Compd. 2-1 | 2.93 pts. wt. |

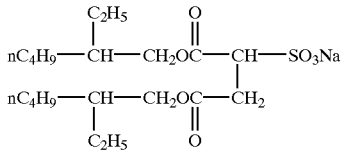

| | |
|---|---|
| Seahostar KEP50 (amorphous spherical silica, av. grain size 0.5 μm, produced by Nippon Shokubai Co., Ltd. | 88.00 pts. wt. |

This composition was agitated for 10 min, and further the following was added.

| | |
|---|---|
| *Diacetone alcohol* | 252.93 pts.wt. |

The resultant liquid was dispersed by means of ultrasonic homogenizer "Sonifier 450 (manufactured by Branson)" for 3 hr while cooling with ice and stirring, thereby finishing spherical inorganic grain dispersion cl.

(3) Preparation of Spherical Organic Polymer Grain Dispersion

Spherical organic polymer grain dispersion (c2) was prepared in accordance with the following formulation.

| | |
|---|---|
| XC99-A8808 (produced by Toshiba Silicone Co., Ltd., spherical crosslinked polysiloxane grain, av. grain size 0.9 μm) | 60 pts. wt. |
| Methyl ethyl ketone | 120 pts. wt. |
| Cyclohexanone | 120 pts. wt. |

This mixture was dispersed by means of ultrasonic homogenizer "Sonifier 450 (manufactured by Branson)" for 2 hr while cooling with ice and stirring, thereby finishing spherical organic polymer grain dispersion c2.

(4) Preparation of Coating Liquid for 3rd Layer

A coating liquid for 3rd layer was prepared by adding the following components to 542 g of the aforementioned raw dispersion of sliding agent:

| | |
|---|---|
| Diacetone alcohol | 5950 g |
| Cyclohexanone | 176 g |
| Ethyl acetate | 1700 g |
| Above Seahostar KEP50 dispersion (c1) | 53.1 g |
| Above spherical organic polymer grain dispersion (c2) | 300 g |
| FC431 (produced by 3M, solid content 50%, solvent: ethyl acetate) | 2.65 g |
| BYK310 (produced by BYK ChemiJapan, solid content 25%) | 5.3 g. |

The above 3rd-layer coating liquid was applied to the 2nd layer in a coating amount of 10.35 mL/m$^2$, dried at 110° C. and further postdried at 97° C. for 3 min.

4) Application of Lightsensitive Layer by Coating

The thus obtained back layers on its side opposite to the support were coated with a plurality of layers of the following respective compositions, thereby obtaining a color negative film.

(Composition of Lightsensitive Layer)

Main materials used in each of the layers are classified as follows:

ExC: cyan coupler, UV: ultraviolet absorber,

ExM: magenta coupler, HBS: high b.p. org. solvent,

ExY: yellow coupler, H: gelatin hardener.

(For each specific compound, in the following description, numeral is assigned after the character, and the formula is shown later).

The numeric value given beside the description of each component is for the coating amount expressed in the unit of g/m$^2$. With respect to the silver halide, the coating amount is in terms of silver quantity.

1st Layer (First Antihalation Layer)

| | | |
|---|---|---|
| Black colloidal silver | silver | 0.122 |
| 0.07 μm silver iodobromide emulsion | silver | 0.01 |
| Gelatin | | 0.919 |
| ExC-1 | | 0.002 |
| ExC-3 | | 0.002 |
| Cpd-2 | | 0.001 |
| HBS-1 | | 0.005 |
| HBS-2 | | 0.002 |

2nd Layer (Second Antihalation Layer)

| | | |
|---|---|---|
| Black colloidal silver | silver | 0.055 |
| Gelatin | | 0.425 |
| ExF-1 | | 0.002 |
| Solid disperse dye ExF-9 | | 0.120 |
| HBS-1 | | 0.074 |

3rd Layer (Low-speed Red-sensitive Emulsion Layer)

| | | |
|---|---|---|
| Em-D | silver | 0.577 |
| Em-C | silver | 0.347 |
| ExC-1 | | 0.188 |
| ExC-2 | | 0.011 |
| ExC-3 | | 0.075 |
| ExC-4 | | 0.121 |
| ExC-5 | | 0.010 |
| ExC-6 | | 0.007 |
| Cpd-2 | | 0.025 |

-continued

| | | |
|---|---|---|
| Cpd-4 | | 0.025 |
| Cpd-7 | | 0.050 |
| Cpd-8 | | 0.050 |
| HBS-1 | | 0.114 |
| HBS-5 | | 0.038 |
| Gelatin | | 1.474 |

4th Layer (Medium-speed Red-sensitive Emulsion Layer)

| | | |
|---|---|---|
| Em-B | silver | 0.431 |
| Em-C | silver | 0.432 |
| ExC-1 | | 0.154 |
| ExC-2 | | 0.068 |
| ExC-3 | | 0.018 |
| ExC-4 | | 0.103 |
| ExC-5 | | 0.023 |
| ExC-6 | | 0.010 |
| ExC-7 | | 0.020 |
| Cpd-2 | | 0.036 |
| Cpd-4 | | 0.028 |
| Cpd-7 | | 0.010 |
| Cpd-8 | | 0.010 |
| HBS-1 | | 0.129 |
| Gelatin | | 1.086 |

5th Layer (High-speed Red-sensitive Emulsion Layer)

| | | |
|---|---|---|
| Em-A | silver | 1.108 |
| ExC-1 | | 0.180 |
| ExC-3 | | 0.035 |
| ExC-6 | | 0.029 |
| ExC-7 | | 0.100 |
| Cpd-2 | | 0.064 |
| Cpd-4 | | 0.077 |
| Cpd-7 | | 0.040 |
| Cpd-8 | | 0.040 |
| HBS-1 | | 0.329 |
| HBS-2 | | 0.120 |
| Gelatin | | 1.245 |

6th Layer (Interlayer)

| | |
|---|---|
| Cpd-1 | 0.094 |
| Cpd-9 | 0.369 |
| Solid disperse dye ExF-4 | 0.030 |
| HBS-1 | 0.049 |
| Polyethyl acrylate latex | 0.088 |
| Gelatin | 0.886 |

7th Layer (Layer Capable of Exerting Interlayer Effect on Red-sensitive Layer)

| | | |
|---|---|---|
| Em-J | silver | 0.293 |
| Em-K | silver | 0.293 |
| Cpd-4 | | 0.030 |
| ExM-2 | | 0.120 |
| ExM-3 | | 0.016 |
| ExY-1 | | 0.016 |
| ExY-6 | | 0.036 |
| Cpd-6 | | 0.011 |
| HBS-1 | | 0.090 |
| HBS-3 | | 0.003 |

-continued

| | | |
|---|---|---|
| HBS-5 | | 0.030 |
| Gelatin | | 0.610 |

8th Layer (Low-speed Green-sensitive Emulsion Layer)

| | | |
|---|---|---|
| Em-H | silver | 0.329 |
| Em-G | silver | 0.333 |
| Em-I | silver | 0.088 |
| ExM-2 | | 0.378 |
| ExM-3 | | 0.047 |
| ExY-1 | | 0.017 |
| ExC-7 | | 0.020 |
| HBS-1 | | 0.098 |
| HBS-3 | | 0.010 |
| HBS-4 | | 0.077 |
| HBS-5 | | 0.548 |
| Cpd-5 | | 0.010 |
| Gelatin | | 1.470 |

9th Layer (Medium-speed Green-sensitive Emulsion Layer)

| | | |
|---|---|---|
| Em-F | silver | 0.457 |
| ExM-2 | | 0.032 |
| ExM-3 | | 0.029 |
| ExM-4 | | 0.029 |
| ExY-1 | | 0.007 |
| ExC-6 | | 0.010 |
| ExC-7 | | 0.030 |
| HBS-1 | | 0.065 |
| HBS-3 | | 0.002 |
| HBS-5 | | 0.020 |
| Cpd-5 | | 0.004 |
| Gelatin | | 0.446 |

10th Layer (High-speed Green-sensitive Emulsion Layer)

| | | |
|---|---|---|
| Em-E | silver | 0.794 |
| ExC-6 | | 0.002 |
| ExM-1 | | 0.013 |
| ExM-2 | | 0.011 |
| ExM-3 | | 0.030 |
| ExM-4 | | 0.017 |
| ExY-5 | | 0.003 |
| ExC-7 | | 0.010 |
| Cpd-3 | | 0.004 |
| Cpd-4 | | 0.007 |
| Cpd-5 | | 0.010 |
| HBS-1 | | 0.148 |
| HBS-5 | | 0.037 |
| Polyethyl acrylate latex | | 0.099 |
| Gelatin | | 0.939 |

11th Layer (Yellow Filter Layer)

| | |
|---|---|
| Cpd-1 | 0.094 |
| Solid disperse dye ExF-2 | 0.150 |
| Solid disperse dye ExF-5 | 0.010 |
| Oil soluble dye ExF-7 | 0.010 |
| HBS-1 | 0.049 |
| Gelatin | 0.630 |

12th Layer (Low-speed Blue-sensitive Emulsion Layer)

| | | |
|---|---|---|
| Em-O | silver | 0.112 |
| Em-M | silver | 0.320 |
| Em-N | silver | 0.240 |
| ExC-1 | | 0.027 |
| ExY-1 | | 0.027 |
| ExY-2 | | 0.890 |
| ExY-6 | | 0.120 |
| Cpd-2 | | 0.100 |
| Cpd-3 | | 0.004 |
| HBS-1 | | 0.222 |
| HBS-5 | | 0.074 |
| Gelatin | | 2.058 |

13th Layer (High-speed Blue-sensitive Emulsion Layer)

| | | |
|---|---|---|
| Em-L | silver | 0.714 |
| ExY-2 | | 0.211 |
| Cpd-2 | | 0.075 |
| Cpd-3 | | 0.001 |
| HBS-1 | | 0.071 |
| Gelatin | | 0.678 |

14th Layer (1st Protective Layer)

| | | |
|---|---|---|
| 0.07 μm silver iodobromide emulsion | silver | 0.301 |
| UV-1 | | 0.211 |
| UV-2 | | 0.132 |
| UV-3 | | 0.198 |
| UV-4 | | 0.026 |
| F-18 | | 0.009 |
| S-1 | | 0.086 |
| HBS-1 | | 0.175 |
| HBS-4 | | 0.050 |
| Gelatin | | 1.984 |

15th Layer (2nd Protective Layer)

| | |
|---|---|
| H-1 | 0.400 |
| B-1 (diameter 1.7 μm) | 0.050 |
| B-2 (diameter 1.7 μm) | 0.150 |
| B-3 | 0.050 |
| S-1 | 0.200 |
| Gelatin | 0.750 |

In addition to the above components, W-1 to W-6, B-4 to B-6, F-1 to F-17, a lead salt, a platinum salt, an iridium salt and a rhodium salt were appropriately added to the individual layers in order to improve the storage life, processability, resistance to pressure, antiseptic and mildew-proofing properties, antistatic properties and coating properties thereof.

Preparation of Dispersion of Organic Solid Disperse Dye

The EXF-2 of the 11th layer was dispersed by the

| | |
|---|---|
| Wet cake of ExF-2 (contg. 17.6 wt. % water) | 2.800 kg |
| Sodium octylphenyldiethoxymethanesulfonate (31 wt. % aq. soln.) | 0.376 kg |

-continued

| | |
|---|---|
| F-15 (7% aq. soln.) | 0.011 kg |
| Water | 4.020 kg |
| Total | 7.210 kg |

(Adjusted to pH=7.2 with NaOH)

Slurry of the above composition was agitated by means of a dissolver to thereby effect a preliminary dispersion, and further dispersed by means of agitator mill LMK-4 under such conditions that the peripheral speed, delivery rate and packing ratio of 0.3 mm-diameter zirconia beads were 10 m/s, 0.6 kg/min and 80%, respectively, until the absorbance ratio of the dispersion became 0.29. Thus, a solid particulate dispersion was obtained, wherein the average particle diameter of dye particulate was 0.29 μm.

Solid dispersions of ExF-4 and ExF-9 were obtained in the same manner. The average particle diameters of these dye particulates were 0.28 μm and 0.49 μm, respectively. ExF-5 was dispersed by the microprecipitation dispersion method described in Example 1 of EP. No. 549,489A. The average particle diameter thereof was 0.06 μm.

The compounds used in the preparation of each of the layers will be listed below.

ExC-1

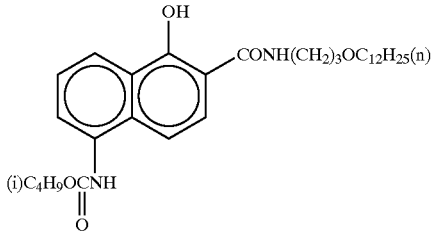

ExC-2

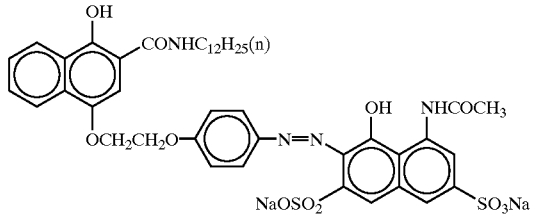

ExC-3

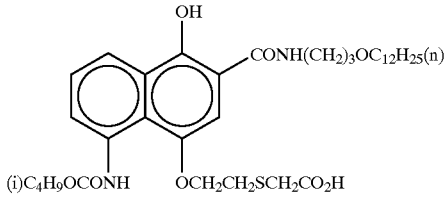

ExC-4

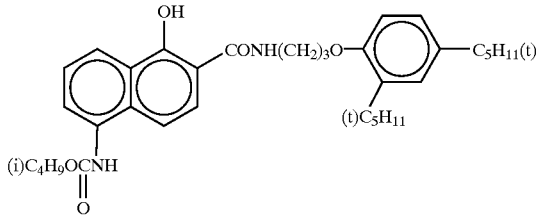

ExC-5

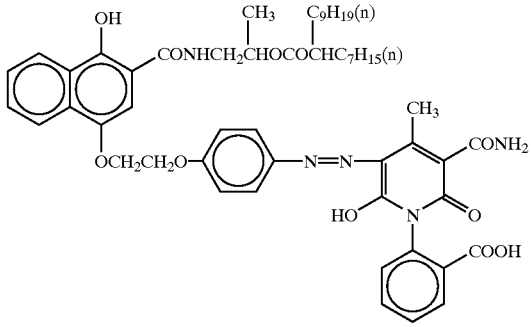

ExC-6

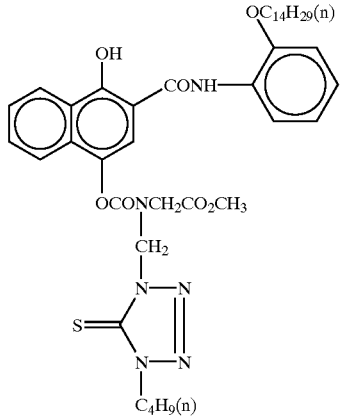

ExC-7

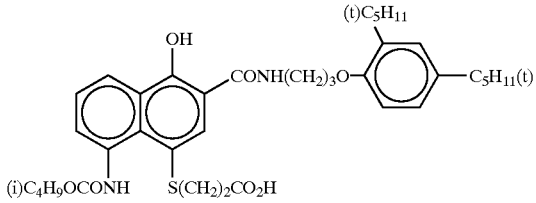

-continued
ExM-1
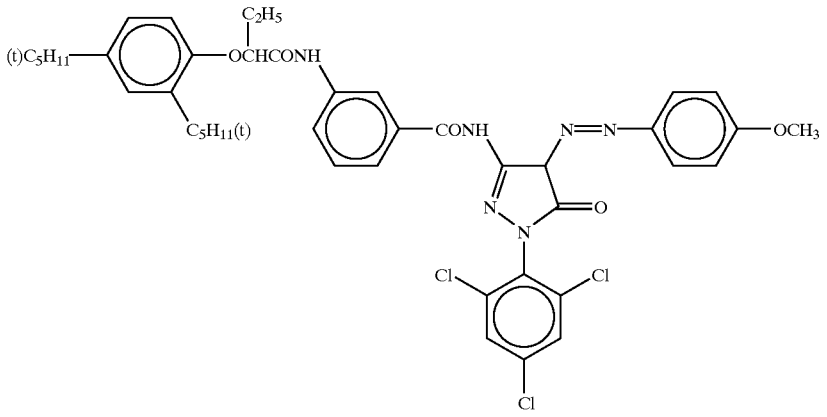
ExM-2
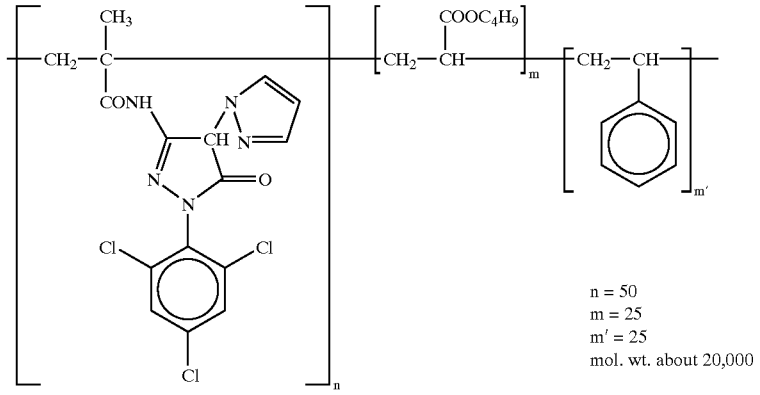
n = 50
m = 25
m′ = 25
mol. wt. about 20,000
ExM-3
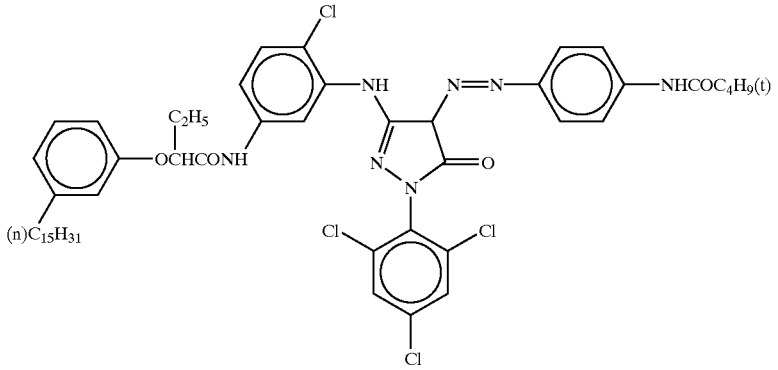
ExM-4
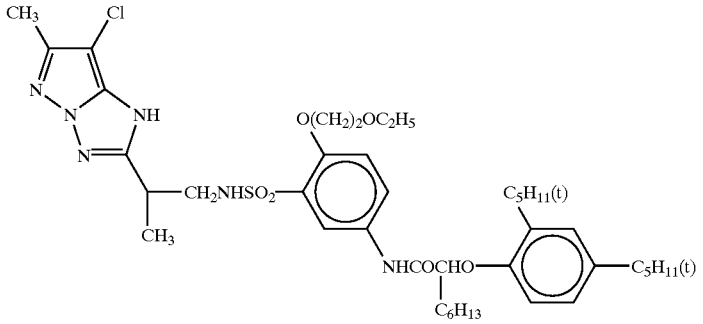

-continued
ExY-1
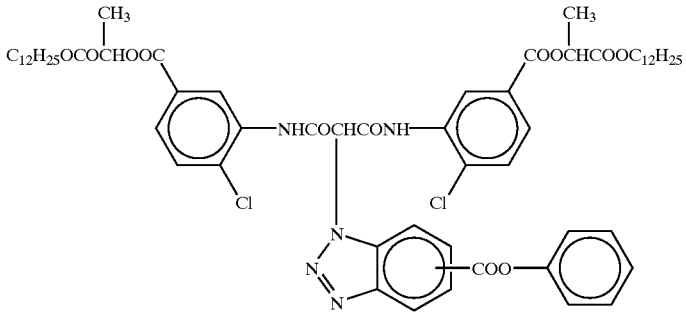
ExY-2
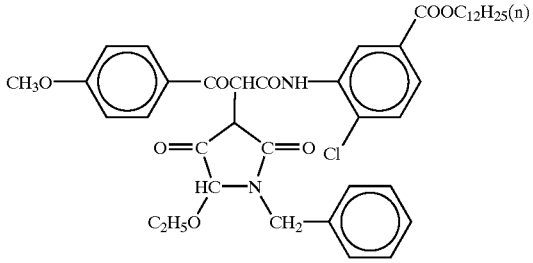
ExY-5
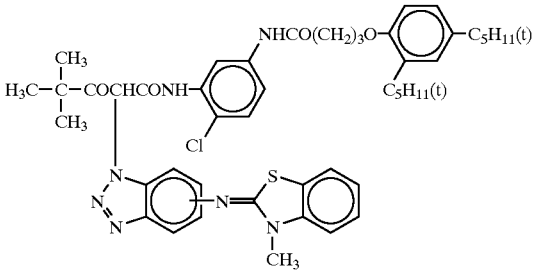
ExY-6
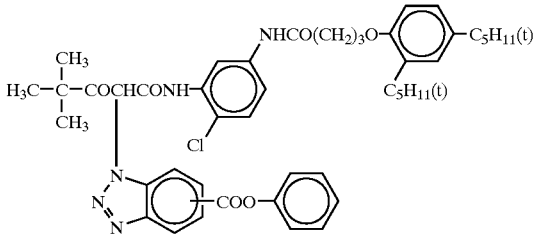
Cpd-1
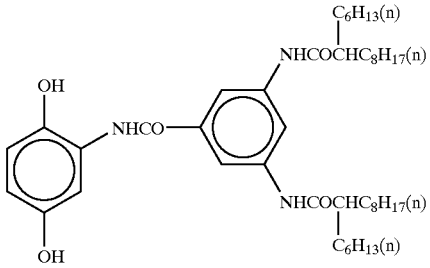
Cpd-2
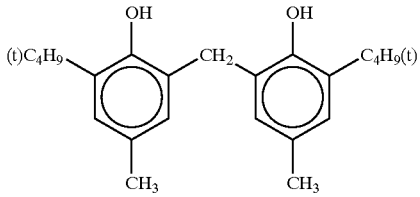
Cpd-3
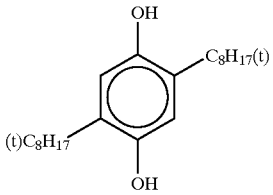
Cpd-4
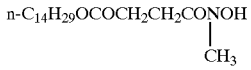
Cpd-5
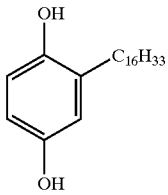
UV-1
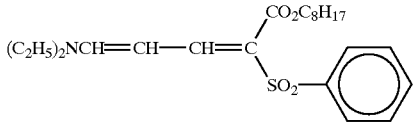
UV-2
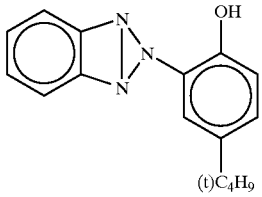

-continued
UV-3
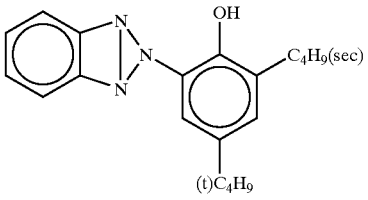
UV-4
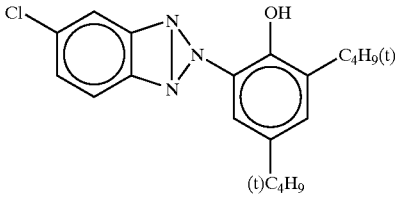
B-1
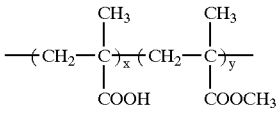
x/y = 10/90 (Weight ratio)
Average mol. wt.: about 35,000
B-2
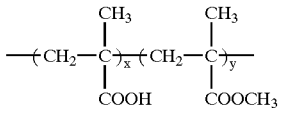
x/y = 40/60 (Weight ratio)
Average mol. wt.: about 20,000
B-3
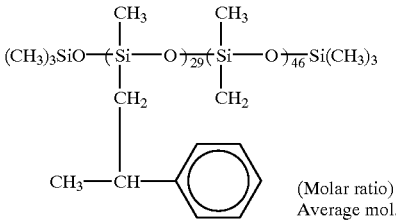
(Molar ratio)
Average mol. wt.: about 8,000
H-1
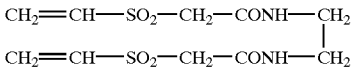
S-1
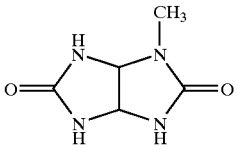
HBS-1
Tricresyl phosphate
HBS-2
Di-n-butyl phthalate
HBS-3
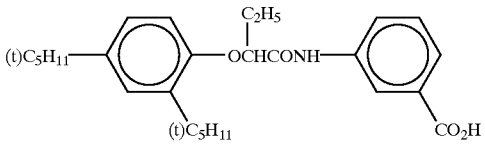
HBS-4
Tri(2-ethylhexyl) phosphate
HBS-5
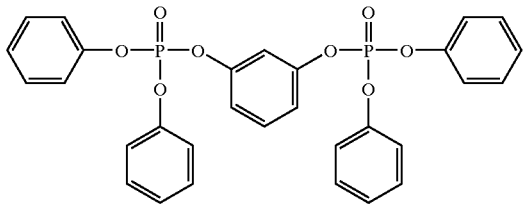
F-1
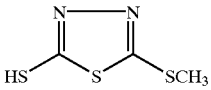
F-2
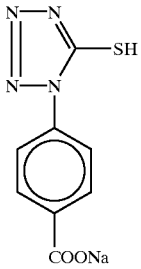

-continued
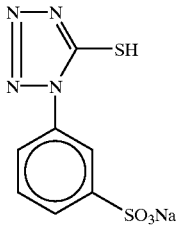
F-3
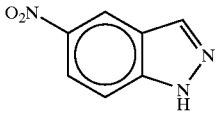
F-4
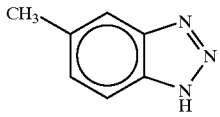
F-5
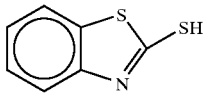
F-6
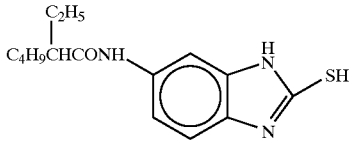
F-7
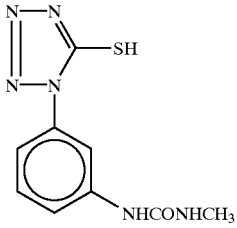
F-8
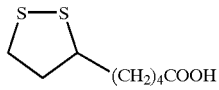
F-9
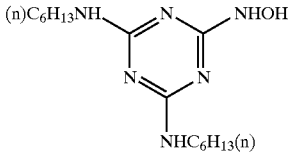
F-10
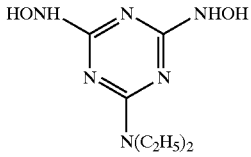
F-11
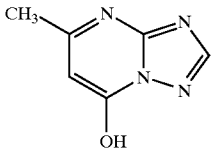
F-12
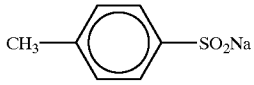
F-13
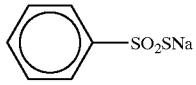
F-14
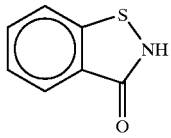
F-15
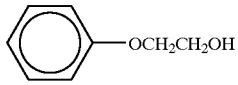
F-16
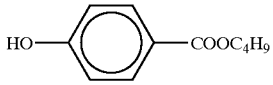
F-17
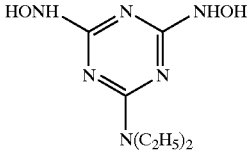
F-18
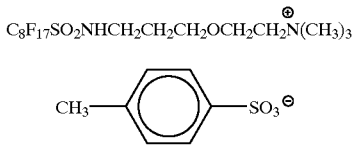
W-1
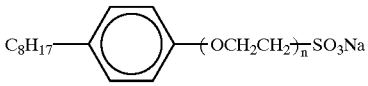
W-2
n = 2–4

-continued
W-3
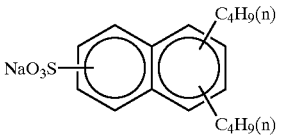
W-4
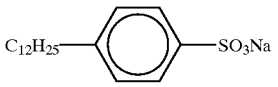
W-5
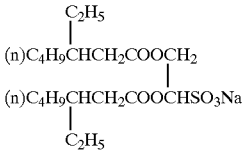
W-6
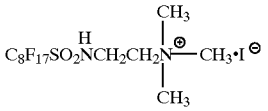
B-4
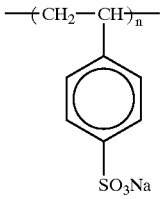
Average mol. wt.: about 750,000
B-5
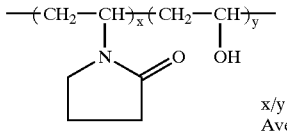
x/y = 70/30 (Weight ratio)
Average mol. wt.: about 17,000
B-6
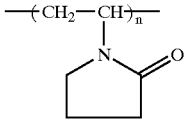
Average mol. wt.: about 10,000
Cpd-6
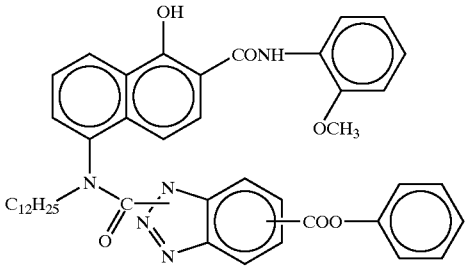
Cpd-7
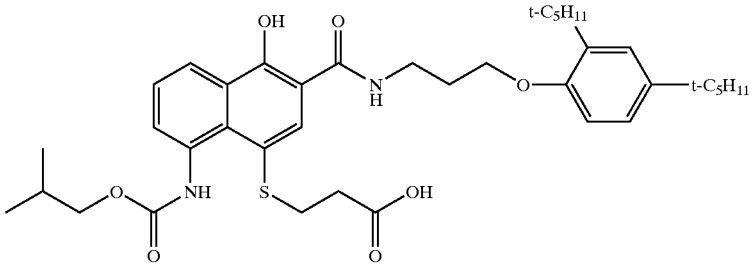
Cpd-8
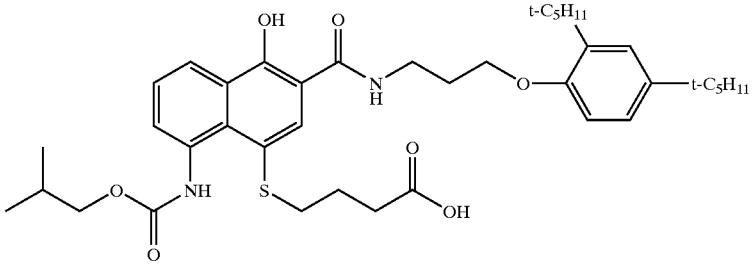
Cpd-9
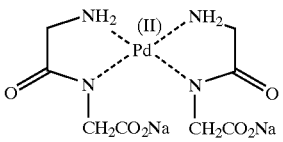
ExF-1
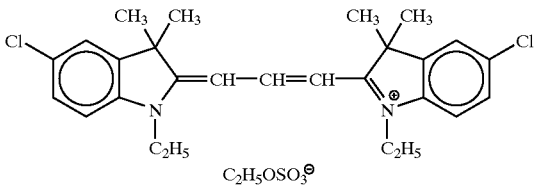

-continued

ExF-2

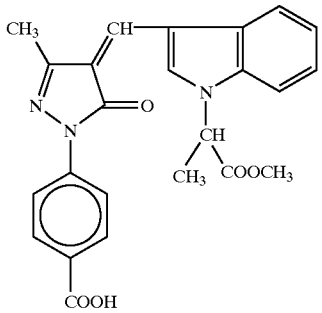

Ex-4

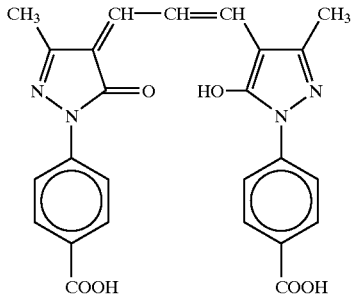

ExF-5

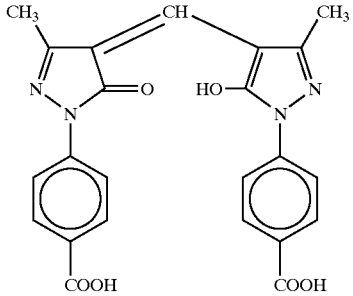

ExF-7

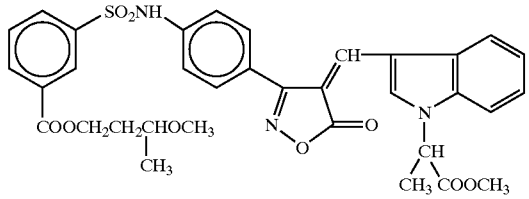

ExF-9

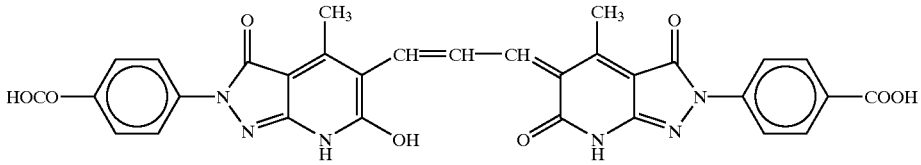

The thus prepared color negative lightsensitive material is designated sample 001.

Sample 001 was exposed through a continuous wedge to (1) reference light source of 4800 K color temperature, (2) white light fluorescent lamp (National FL40S-W(40W)) and (3) three band fluorescent lamp (National FLR40S-EX-N/M-X-36(36W)) for 1/100 sec.

The development was carried out by the use of automatic processor FP-360B manufactured by Fuji Photo Film Co., Ltd. under the following conditions. The apparatus was reworked so as to prevent the flow of overflow solution from the bleaching bath toward subsequent baths and to, instead, discharge all the solution into a waste solution tank. This FP-360B is fitted with an evaporation correcting means described in JIII Journal of Technical Disclosure No. 94-4992 issued by Japan Institute of Invention and Innovation.

The processing steps and compositions of processing solutions are as follows.

(Processing steps)

| Step | Time | Temp. | Qty. of replenisher* | Tank vol. |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |

-continued (Processing steps)

| Step | Time | Temp. | Qty. of replenisher* | Tank vol. |
|---|---|---|---|---|
| Stabilization (1) | 20 sec | 38.0° C. | — | 3 L |
| Stabilization (2) | 20 sec | 38.0° C. | 15 mL | 3 L |
| Drying | 1 min 30 sec | 60° C. | | |

*The replenishment rate is a value per 1.1 m of a 35-mm wide lightsensitive material (equivalent to one 24 Ex. film).

The stabilizer was fed from stabilization (2) to stabilization (1) by counter current, and the fixer was also fed from fixing (2) to fixing (1) by counter current. All the overflow of washing water was introduced into fixing bath (2). The amounts of drag-in of developer into the bleaching step, drag-in of bleaching solution into the fixing step and drag-in of fixer into the washing step were 2.5 mL, 2.0 mL and 2.0 mL, respectively, per 1.1 m of a 35-mm wide lightsensitive material. Each crossover time was 6 sec, which was included in the processing time of the previous step.

The open area of the above processor was 100 $cm^2$ for the color developer, 120 $cm^2$ for the bleaching solution and about 100 $cm^2$ for the other processing solutions.

The composition of each of the processing solutions was as follows.

| (Color developer) | Tank soln. (g) | Replenisher (g) |
|---|---|---|
| Diethylenetriamine-pentaacetic acid | 3.0 | 3.0 |
| Disodium catechol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonatoethyl) hydroxylamine | 1.5 | 2.0 |
| Potassium bromide | 1.3 | 0.3 |
| Potassium iodide | 1.3 mg | — |
| 4-Hydroxy-6-methyl-1,3,3a,7-tetrazaindene | 0.05 | — |
| Hydroxylamine sulfate | 2.4 | 3.3 |
| 2-Methyl-4-[N-ethyl-N-(β-hydroxyethyl)amino]-aniline sulfate | 4.5 | 6.5 |
| Water | q.s. ad 1.0 L | |
| pH | 10.05 | 10.18 |

This pH was adjusted by the use of potassium hydroxide and sulfuric acid.

| (Bleaching soln.) | Tank soln. (g) | Replenisher (g) |
|---|---|---|
| Fe(III) ammonium 1,3-diamino-propanetetraacetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water | q.s. ad 1.0 L | |
| pH | 4.6 | 4.0 |

This pH was adjusted by the use of aqueous ammonia.

(Fixing (1) Tank Soln.)

5:95 (by volume) mixture of the above bleaching tank soln. and the following fixing tank soln, pH 6.8.

| (Fixing (2)) | Tank soln. (g) | Replenisner (g) |
|---|---|---|
| Aq. soln. of ammonium thiosulfate (750 g/L) | 240 mL | 720 mL |
| Imidazole | 7 | 21 |
| Ammonium methanethiosulfonate | 5 | 15 |
| Ammonium methanesulfinate | 10 | 30 |
| Ethylenediaminetetraacetic acid | 13 | 39 |
| Water | q.s. ad 1.0 L | |
| pH | 7.4 | 7.45 |

This pH was adjusted by the use of aqueous ammonia and acetic acid.

(Washing Water)

Tap water was passed through a mixed-bed column filled with H-type strongly acidic cation exchange resin (Amberlite IR-120B produced by Rohm & Haas Co.) and OH-type strongly basic anion exchange resin (Amberlite IR-400 produced by the same maker) so as to set the concentration of calcium and magnesium ions at 3 mg/L or less. Subsequently, 20 mg/L of sodium dichloroisocyanurate and 150 mg/L of sodium sulfate were added. The pH of the solution ranged from 6.5 to 7.5.

| (Stabilizer): common to tank solution and replenisher. | (g) |
|---|---|
| Sodium p-toluenesulfinate | 0.03 |
| Polyoxyethylene p-mononylphenyl ether (average polymerization degree 10) | 0.2 |
| Sodium salt of 1,2-benzoisothiazolin-3-one | 0.10 |
| Disodium ethylenediaminetetraacetate | 0.05 |
| 1,2,4-triazole | 1.3 |
| 1,4-bis(1,2,4-triazol-1-ylmethyl) piperazine | 0.75 |
| Water | q.s. ad 1.0 L |
| pH | 8.5 |

(Preparation of Samples 002 to 012)

The samples were prepared in the same manner as the sample 001, except that the sensitizing dyes of the emulsions of the 12th and 13th layers (blue-sensitive emulsion layers) thereof were changed as specified in Table 5. With respect to the samples 006 to 010, the 7th layer (layer exerting an interlayer effect on the red-sensitive layer) was removed therefrom, the amount of DIR coupler was regulated so as to realize the exertion of an interlayer effect of the 8th, 9th and 10th layers (green-sensitive emulsion layers) on the red-sensitive layer, and the densities of Y, M and C were regulated so as to be equal to those of the samples furnished with the 7th layer.

TABLE 5

| Sample | Presence or absence of 7th layer | Sensitizing dye of 12th layer | Sensitizing dye of 13th layer | $SN_{GR}$ ratio (dB) | $SN_{BGR}$ ratio (dB) |
|---|---|---|---|---|---|
| 001 | Present | Emulsion O: Sensitizing dyes 10, 11 and 12 (Sensitizing dyes I-2, III-12 and II-1 of the invention) Emulsions M and N: Sensitizing dyes 9, 10 and 11 (Sensitizing dyes II-2, I-2 and III-12 of the invention) | Emulsion L: Sensitizing dyes 9, 10 and 11 (Sensitizing dyes II-2, I-2 and III-12 of the invention) | +4.0 | −1.5 |
| 002 | Present | Emulsion O: same as above Emulsions M and N: Sensitizing dye 9 | Same as above | +3.5 | −4.5 |
| 003 | Present | Sensitizing dye 9 only | Same as left | +3.5 | −4.5 |
| 004 | Present | Sensitizing dyes 9 and 10 (Mixing ratio 1/1) | Same as left | +3.5 | −2.0 |
| 005 | Present | Sensitizing dyes 9 and III-16 (Mixing ratio 1/1) | Same as left | +3.0 | −3.0 |
| 006 | Absent | Same as Sample 001 | Same as left | −1.0 | −2.5 |
| 007 | Absent | Same as Sample 002 | Same as left | −1.5 | −5.5 |
| 008 | Absent | Same as Sample 003 | Same as left | −1.5 | −5.5 |
| 009 | Absent | Same as Sample 004 | Same as left | −1.5 | −3.0 |
| 010 | Absent | Same as Sample 005 | Same as left | −1.0 | −3.0 |
| 011 | Present | Same as Sample 001, except that sensitizing dye 11 was replaced by sensitizing dye III-1 | Same as left | +4.0 | −1.2 |
| 012 | Present | Same as Sample 002, except that sensitizing dye | Same as left | +4.0 | −2.5 |

TABLE 5-continued

| Sample | Presence or absence of 7th layer | Sensitizing dye of 12th layer | Sensitizing dye of 13th layer | $SN_{GR}$ ratio (dB) | $SN_{BGR}$ ratio (dB) |
|---|---|---|---|---|---|
| | | 10 was replaced by sensitizing dye I-1 | | | |
| 013 | Present | Sensitizing dye 10 only | Same as left | +3.5 | −5.5 |
| 014 | Present | Sensitizing dye III-1 only | Same as left | +3.5 | −4.5 |
| 015 | Present | Same as Sample 011 | Sensitizing dye 9 only | +4.0 | −2.0 |

The thus obtained samples were subjected to the same exposure as performed for the sample 001, and the SN ratio was calculated. The results are also specified in Table 5. Furthermore, practical photographing was performed under a mixed light source consisting of a fluorescent lamp and sunlight, thereby recognizing the effect of the present invention.

The samples 001 to 005 and 011 to 015 had an $SN_{GR}$ ratio of 0 dB or more and were favorably free from greenishness characteristic of fluorescent lamps. Further, yellowishness was relieved by the mixing of the sensitizing dyes specified in the present invention into the emulsion of the blue-sensitive layer, thereby realizing further enhanced reproduction. The $SN_{BGR}$ ratio thereof was −4 dB or more.

Example 2

Emulsion coating was performed on a support of triacetylcellulose film in the same manner as in Example 1, thereby obtaining a sample. This sample was subjected to the same exposure and testing of fluorescent lamp adaptability. As a result, the effectiveness of the present invention was demonstrated.

The present invention enabled obtaining a highly sensitive silver halide color photographic lightsensitive material whose dependency on light source is slight.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photographic lightsensitive material comprising at least one red-sensitive silver halide emulsion layer, at least one green-sensitive silver halide emulsion layer and at least one blue-sensitive silver halide emulsion layer on a support, wherein the lightsensitive material has an ISO speed of 640 or more; and has a variation, in terms of a $SN_{GR}$ ratio, of magenta and cyan colors of 0 dB or more when the lightsensitive material is subjected to each of white light exposure, white fluorescent lamp exposure and three band fluorescent lamp exposure.

2. The lightsensitive material according to claim 1, wherein the lightsensitive material has a variation, in terms of a $SN_{BGR}$ ratio, of yellow, magenta and cyan colors of −4 dB or more when the lightsensitive material is subjected to each of white light exposure, white fluorescent lamp exposure and three band fluorescent lamp exposure.

3. The lightsensitive material according to claim 2, wherein the blue-sensitive layer contains a sensitizing dye selected from a group consisting of sensitizing dyes represented by formula (I) and sensitizing dyes represented by formula (II), and a sensitizing dye represented by formula (III):

(I)

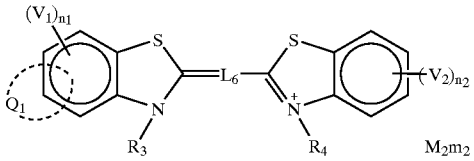

wherein each of $R_3$ and $R_4$ independently represents an alkyl group, an aryl group or a heterocyclic group; $L_6$ represents a methine group; $M_2$ represents a charge balancing counter ion; $m_2$ represents a number required for neutralizing a molecular charge; $Q_1$ represents an aromatic ring; each of $V_1$ and $V_2$ independently represents a monovalent substituent; $n_1$ represents 0, 1 or 2; and $n_2$ represents 0, 1, 2, 3 or 4, (II)

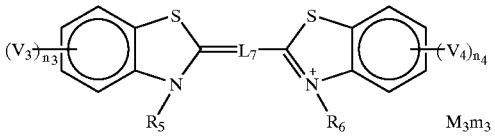

wherein each of $R_5$ and $R_6$ independently represents an alkyl group, an aryl group or a heterocyclic group; $L_7$ represents a methine group; $M_3$ represents a charge balancing counter ion; $m_3$ represents a number required for neutralizing a molecular charge; each of $V_3$ and $V_4$ independently represents a monovalent substituent; and each of $n_3$ and $n_4$ independently represents 0, 1, 2, 3 or 4, provided that when $n_3$ is two or more, two of $V_3$ substituents do not bond with each other to thereby form an aromatic ring and when n4 is two or more, two of $V_4$ substituents do not bond with each other to thereby form an aromatic ring, (III)

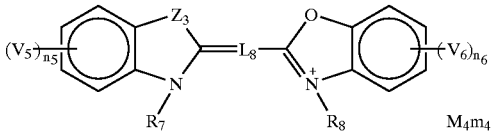

wherein each of $R_7$ and $R_8$ independently represents an alkyl group, an aryl group or a heterocyclic group; $L_8$ represents a methine group; $M_4$ represents a charge balancing counter ion; $m_4$ represents a number required for neutralizing a molecular charge; each of $V_5$ and $V_6$ independently represents a monovalent substituent; each of $n_5$ and $n_6$ independently represents 0, 1, 2, 3 or 4; and $Z_3$ represents an oxygen atom or a sulfur atom.

4. The lightsensitive material according to claim 2, wherein the blue-sensitive emulsion layer contains a sensitizing dye represented by formula (I), a sensitizing dye represented by formula (II) and a sensitizing dye represented by formula (III), wherein each of the substituents has the same meanings as defined in claim 3.

5. The lightsensitive material according to claim 1, wherein the lightsensitive material contains a silver halide emulsion having an average aspect ratio of 8 or more.

6. The lightsensitive material according to claim 1, wherein the lightsensitive material satisfies the relationships:

$520\ nm < \lambda_G \leqq 580\ nm$;

$500\ nm < \lambda_{-R} < 560\ nm$; and $\lambda_G - \lambda_{-R} \geqq 5\ nm$ wherein $\lambda_G$ represents a weight-average wavelength of spectral sensitivity distribution of the green-sensitive layer;

$\lambda_{-R}$ represents a weight-average wavelength of spectral sensitivity distribution of interlayer effect magnitude exerted to the red-sensitive layer from other layers at a wavelength in a rage of 500 nm to 600 nm.

7. The lightsensitive material according to claim 6, wherein the lightsensitive material satisfies the relationship: $\lambda_G-\lambda_{-R}\geqq 10$ nm.

8. The lightsensitive material according to claim 5, wherein the tabular grains have 10 or more dislocation lines in average per grain.

9. The lightsensitive material according to claim 8, wherein the dislocation lines were introduced by using an iodide ion-releasing agent.

10. The lightsensitive material according to claim 5, wherein the tabular grains were selenium-sensitized.

11. The lightsensitive material according to claim 5, wherein the tabular grains contain a complex selected from a group consisting of hexacyanoiron (II) complex and hexacyanoruthenium complex.

12. The lightsensitive material according to claim 3, wherein the sensitizing dye represented by formula (I) is selected from the group consisting of

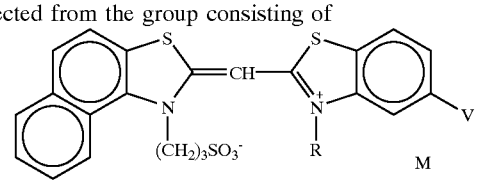

(I-1) V=Cl, R=$(CH_2)_3SO_3^-$, M=$HN^+(C_2H_5)_3$,
(I-2) V=$OCH_3$, R=$(CH_2)_3SO_3^-$, M=$HN^+(C_2H_5)3$,
(I-3) V=CN, R=$(CH_2)_3SO_3^-$, M=$HN^+(C_2H_5)_3$,
(I-4) V=$CO_2CH_3$, R=$(CH_2)_3SO_3^-$, M=$HN^+(C_2H_5)_3$,
(I-5) V=$CH_3$, R=$(CH_2)_4SO_3^-$, M=$Na^+$,
(I-6) V=$OCH_3$,

R = $(CH_2)_2CH(CH_3)SO_3^-$,

M=$K^+$,
(I-7) V=F, R=$CH_2CONHSO_2CH_3$, M=–,
(I-8) V=Br, R=$CH_2CO_2H$, M=–, and
(I-9)

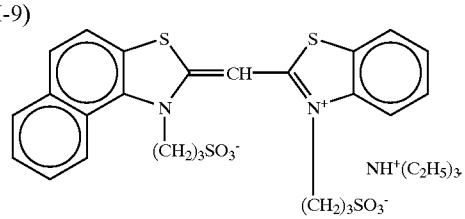

13. The lightsensitive material according to claim 3, wherein the sensitizing dye represented by formula (II) is selected from the group consisting of

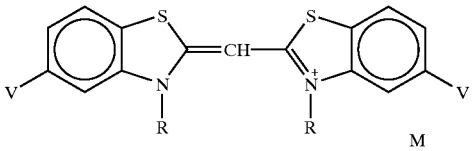

(II-1) V=Cl, R=$(CH_2)_4SO_3^-$, M=$HN^+(C_2H_5)_3$
(II-2) V=Cl,

R = $(CH_2)_2CH(CH_3)SO_3^-$,

M=$HN^+(C_2H_5)_3$
(II-3) V=Br, R=$(CH_2)_4SO_3^-$, M=$HN(C_2H_5)_3$
(II-4) V=F, R=$(CH_2)_3SO_3^-$, M=$Na^+$
(II-5) V=CN, R=$CH_2CO_2H$, M=$Br^{31}$
(II-6)

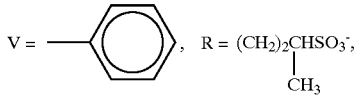

M=$HN(C_2H_5)_3$
(II-7) V=Cl, R=$CH_2CONHSO_2CH_3$, M=$Br^-$

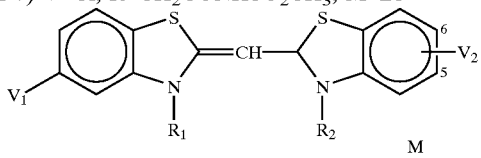

(II-8) $V_1=V_2=5$-Cl, $R_1=(CH_2)_4SO_3^-$, $R_2=CH_2CONHSO_2CH_3$, M=–
(II-9)

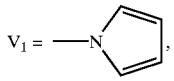

$V_2$=5-Cl, $R_1=R_2=(CH_2)_3SO_3^-$, M=$HN^+(C_2H_5)_3$ and
(II-10)

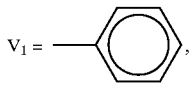

$V_2$=5,6-$(OCH_3)_2$ $R_1=R_2$ = $(CH_2)_2CH(CH_3)SO_3^-$,

M=$HN^+(C_2H_5)_3$.

14. The lightsensitive material according to claim 3, wherein the sensitizing dye represented by formula (III) is selected from the group consisting of

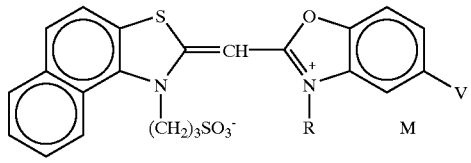

(III-1)

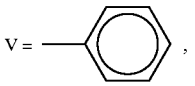

R=$(CH_2)_4SO_3^-$, M=$HN^+(C_2H_5)_3$ (III-2) V=Br, R=$(CH_2)_3SO_3^-$, M=$HN^+(C_2H_5)_3$ (III-3) V=Cl, R=$CH_2CO_2H$, M=–

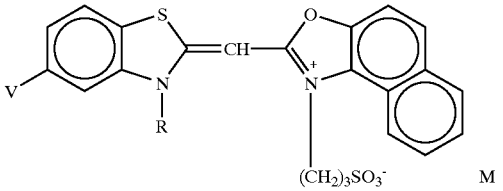

(III-4) V=Cl, R=$(CH_2)_3SO_3^-$, M=$HN^+(C_2H_5)_3$ (III-5) V=CN,

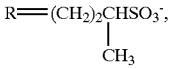

M=$Na^+$ (III-6) V=$OCH_3$, R=$CH_2CONHSO_2CH_3$, M=–

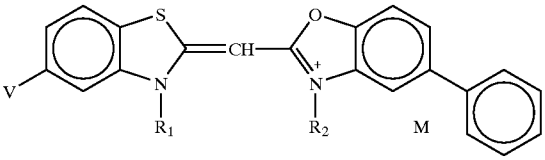

(III-7) V=Cl, $R_1$=$R_2$=$(CH_2)_3SO_3^-$, M=$HN^+(C_2H_5)_3$ (III-8) V=Cl,

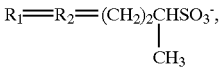

M=$HN^+(C_2H_5)_3$ (III-9) V=F, $R_1$=$CH_2CONHSO_2CH_3$, $R_2$=$(CH_2)_3SO_3^-$, M=–

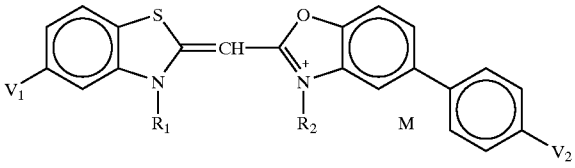

(III-10) $V_1$=Cl, $V_2$=Br, $R_1$=$R_2$=$(CH_2)_4SO_3^-$, M=$HN^+(C_2H_5)_3$ (III-11) $V_1$=Br, $V_2$=H, $R_1$=$R_2$=$(CH_2)_4SO_3^-$, M=$HN^+(C_2H_5)_3$ (III-12) $V_1$=Br, $V_2$=Br, $R_1$=$R_2$$(CH_2)_4SO_3^-$, M=$HN^+(C_2H_5)_3$

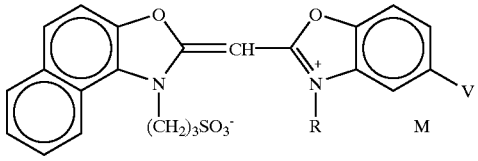

(III-13) V=Cl, R=$(CH_2)_3SO_3^-$, M=$HN^-(C_2H_5)_3$ (III-14)

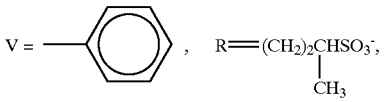

M=$Na^+$ (III-15)

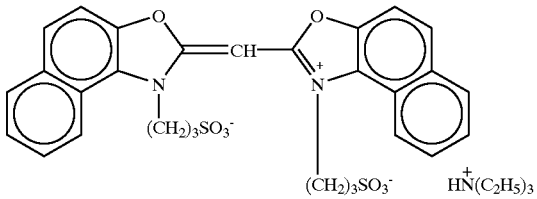

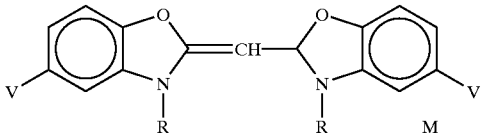

(III-16)

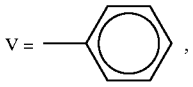

R=$(CH_2)_3SO_3^-$, M=$HN^+(C_2H_5)_3$ (III-17) V=Cl, R=$(CH_2)_4SO_3^-$, M=$Na^+$ and (III-18)

(III-18)

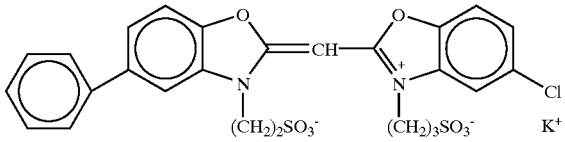

* * * * *